US012298046B2

(12) United States Patent
Yoshimi et al.

(10) Patent No.: US 12,298,046 B2
(45) Date of Patent: May 13, 2025

(54) AIR CONDITIONER

(71) Applicant: DAIKIN INDUSTRIES, LTD., Osaka (JP)

(72) Inventors: Atsushi Yoshimi, Osaka (JP); Takuro Yamada, Osaka (JP); Eiji Kumakura, Osaka (JP); Ikuhiro Iwata, Osaka (JP); Takeru Miyazaki, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 205 days.

(21) Appl. No.: 17/957,421

(22) Filed: Sep. 30, 2022

(65) Prior Publication Data

US 2023/0021512 A1 Jan. 26, 2023

Related U.S. Application Data

(63) Continuation of application No. PCT/JP2021/013192, filed on Mar. 29, 2021.

(30) Foreign Application Priority Data

Mar. 31, 2020 (JP) ..... 2020-062743

(51) Int. Cl.
*F25B 41/20* (2021.01)
*F25B 13/00* (2006.01)

(52) U.S. Cl.
CPC ..... *F25B 41/20* (2021.01); *F25B 13/00* (2013.01)

(58) Field of Classification Search
CPC .... F25B 41/20; F25B 13/00; F25B 2313/007; F25B 2313/023; F25B 2313/0231; F25B 9/008; F25B 2341/001
See application file for complete search history.

(56) References Cited

U.S. PATENT DOCUMENTS

2011/0259042 A1* 10/2011 Nishino ..... F28F 9/0207 62/527
2014/0096557 A1* 4/2014 Higashiiue ..... F25B 1/06 62/324.6

(Continued)

FOREIGN PATENT DOCUMENTS

EP 3263374 A1 1/2018
JP 2005337659 A 12/2005

(Continued)

OTHER PUBLICATIONS

Extended European Search Report issued in corresponding European Application No. 21781735.2, issued Jul. 24, 2023 (10 pages).

(Continued)

*Primary Examiner* — Marc E Norman
(74) *Attorney, Agent, or Firm* — Osha Bergman Watanabe & Burton LLP

(57) ABSTRACT

An air conditioner includes: a heat-source-side unit including a compressor and a heat-source-side heat exchanger; use-side units each including a use-side heat exchanger; an intermediate unit that causes the use-side heat exchanger of each of the use-side units to individually function as an evaporator or a radiator of a refrigerant; and three or more connection pipes that connect the heat-source-side unit to the intermediate unit. The intermediate unit includes: an ejector that pressurizes the refrigerant; and a gas-liquid separator into which the refrigerant flowing out from the ejector flows. The refrigerant that has released heat in any of the use-side units that perform a heating operation is not pressurized by the ejector.

7 Claims, 13 Drawing Sheets

(56) References Cited

U.S. PATENT DOCUMENTS

| | | | | |
|---|---|---|---|---|
| 2016/0200175 | A1 | 7/2016 | Nakajima et al. | |
| 2023/0027378 | A1* | 1/2023 | Kumakura | F25B 9/008 |

FOREIGN PATENT DOCUMENTS

| | | | |
|---|---|---|---|
| JP | 2006234263 | A | 9/2006 |
| JP | 2010236706 | A | 10/2010 |
| JP | 2015064194 | A | 4/2015 |
| JP | 2016070596 | A | 5/2016 |

OTHER PUBLICATIONS

English translation of International Preliminary Report on Patentability issued in corresponding International Application No. PCT/JP2021/013192 dated Sep. 29, 2022 (6 pages).
International Search Report issued in corresponding International Application No. PCT/JP2021/013192, mailed Apr. 27, 2021, with translation (6 pages).
Written Opinion issued in corresponding International Application No. PCT/JP2021/013192, mailed Apr. 27, 2021 (4 pages).

* cited by examiner

AIR CONDITIONER

CROSS-REFERENCE TO RELATED APPLICATIONS

This is a continuation application of International Patent Application No. PCT/JP2021/013192, filed Mar. 29, 2021, and claims priority to Japanese Patent Application No. 2020-062743, filed on Mar. 31, 2020. The contents of these priority applications are incorporated herein by reference.

TECHNICAL FIELD

The present disclosure relates to an air conditioner.

BACKGROUND

To date, among air conditioners each including a plurality of use units, an air conditioner that can perform an operation in which some use units each perform a cooling operation and some use units each perform a heating operation is known. As an example of such an air conditioner, Japanese Unexamined Patent Publication No. 2005-337659 (PTL 1) discloses a three-pipe type air conditioner having three refrigerant connection pipes.

SUMMARY

An air conditioner according to one or more embodiments includes a heat-source-side unit, a plurality of use-side units, an intermediate unit, and three or more connection pipes. The heat-source-side unit includes a compressor and a heat-source-side heat exchanger. The plurality of use-side units each include a use-side heat exchanger. The intermediate unit performs switching so as to cause a plurality of the use-side heat exchangers to individually function as an evaporator or a radiator of a refrigerant. The three or more connection pipes connect the heat-source-side unit to the intermediate unit. The intermediate unit includes an ejector and a gas-liquid separator. The ejector pressurizes the refrigerant. The refrigerant that has flowed out from the ejector flows into the gas-liquid separator. It is configured such that the refrigerant that has radiated heat in the use-side unit that performs a heating operation is not pressurized by the ejector.

DETAILED DESCRIPTION

An air conditioner according to one or more embodiments of the present disclosure will be described with reference to the drawings.

(1) Overall Configuration

Figure 1:
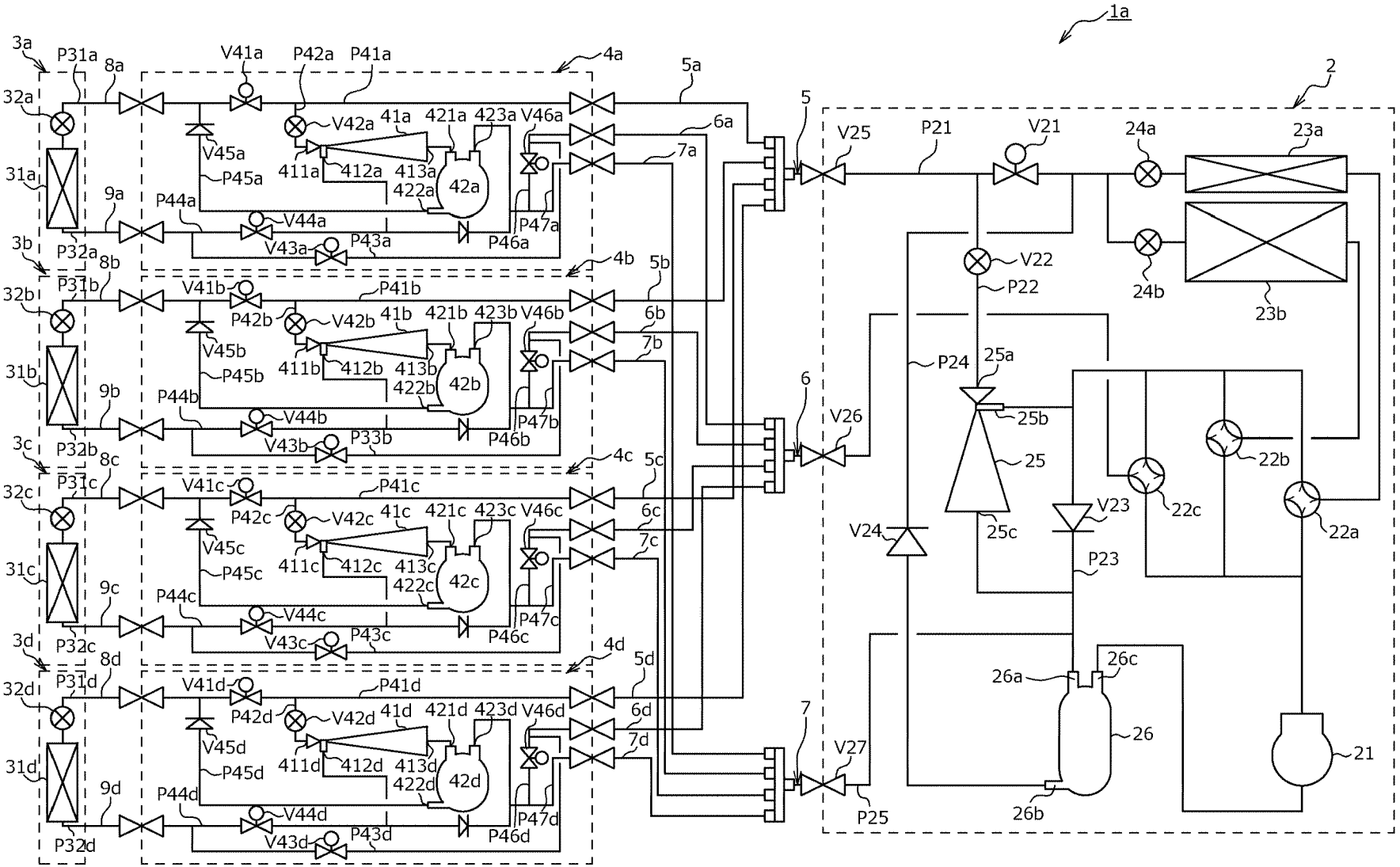
FIG. 1 is a schematic view of an air conditioner according to first embodiments.

As illustrated in FIG. 1, an air conditioner 1*a* according to one or more embodiments of the present disclosure is a device that performs cooling and heating of an indoor space of a building or the like by performing a vapor-compression refrigeration cycle. The air conditioner 1*a* includes: a heat-source-side unit 2; a plurality of (here, four) use-side units 3*a*, 3*b*, 3*c*, and 3*d*; a plurality of (here, four) intermediate units 4*a*, 4*b*, 4*c*, and 4*d*; a first connection pipe 5; a second connection pipe 6; a third connection pipe 7; fourth connection pipes 8*a*, 8*b*, 8*c*, and 8*d*; fifth connection pipes 9*a*, 9*b*, 9*c*, and 9*d*; and a control unit (i.e., controller) 50 illustrated in FIG. 2. A refrigerant circuit of the air conditioner 1*a* is constituted by connecting: the heat-source-side unit 2; the use-side units 3*a*, 3*b*, 3*c*, and 3*d*; the intermediate units 4*a*, 4*b*, 4*c*, and 4*d*; and the connection pipes 5, 6, and 7, 8*a*, 8*b*, 8*c*, and 8*d*, 9*a*, 9*b*, 9*c*, and 9*d*. The air conditioner 1*a* is configured so that each of the use-side units 3*a*, 3*b*, 3*c*, and 3*d* can independently perform a cooling operation or a heating operation, by using the intermediate units 4*a*, 4*b*, 4*c*, and 4*d*.

The control unit 50 controls the constituent devices of the heat-source-side unit 2, the use-side units 3*a*, 3*b*, 3*c*, and 3*d*, and the intermediate units 4*a*, 4*b*, 4*c*, and 4*d*.

(1-2) Detailed Configuration

(1-2-1) Connection Pipe

Three connection pipes connect the heat-source-side unit 2 to the intermediate units 4*a*, 4*b*, 4*c*, and 4*d*. Here, the first connection pipe 5, the second connection pipe 6, and the third connection pipe 7 connect the heat-source-side unit 2 to the intermediate units 4*a*, 4*b*, 4*c*, and 4*d*. The first connection pipe 5 is a high-pressure connection pipe through which a refrigerant having a higher pressure than the refrigerant in the third connection pipe 7 passes. The second connection pipe 6 is a high-pressure (at least, a relatively-high-pressure) connection pipe through which the refrigerant having a higher pressure than the refrigerant in the third connection pipe 7 passes. The third connection pipe is a gas connection pipe on the low-pressure side.

The first connection pipe 5 includes: a merged pipe portion that extends from the heat-source-side unit 2; and branch pipe portions 5*a*, 5*b*, 5*c*, and 5*d* that are a plurality of (hear, four) pipes into which the merged pipe portion branches ahead of the intermediate units 4*a*, 4*b*, 4*c*, and 4*d*. The second connection pipe 6 includes: a merged pipe portion that extends from the heat-source-side unit 2; and branch pipe portions 6*a*, 6*b*, 6*c*, and 6*d* that are a plurality of (here, four) pipe portions into which the merged pipe portion branches ahead of the intermediate units 4*a*, 4*b*, 4*c*, and 4*d*. The third connection pipe 7 includes: a merged pipe portion that extends from the heat-source-side unit 2; and branch pipe portions 7*a*, 7*b*, 7*c*, and 7*d* that are a plurality of (here, four) pipe portions into which the merged pipe portion branches ahead of the intermediate units 4*a*, 4*b*, 4*c*, and 4*d*.

The fourth connection pipes 8*a*, 8*b*, 8*c*, and 8*d* and the fifth connection pipes 9*a*, 9*b*, 9*c*, and 9*d* connect the use-side units 3*a*, 3*b*, 3*c*, and 3*d* to the intermediate units 4*a*, 4*b*, 4*c*, and 4*d*. The fourth connection pipes 8*a*, 8*b*, 8*c*, and 8*d* are connected to the branch pipe portions 5*a*, 5*b*, 5*c*, and 5*d* of the first connection pipe 5 via the intermediate units 4*a*, 4*b*, 4*c*, and 4*d*. The fifth connection pipes 9*a*, 9*b*, 9*c*, and 9*d* are connected to the branch pipe portions 6*a*, 6*b*, 6*c*, and 6*d* of the second connection pipe 6 and the branch pipe portions 7*a*, 7*b*, 7*c*, and 7*d* of the third connection pipe 7 via the intermediate units 4*a*, 4*b*, 4*c*, and 4*d*.

Thus, the air conditioner 1*a* according to one or more embodiments is a three-pipe type device in which three connection pipes connect the heat-source-side unit 2 to the intermediate units 4*a*, 4*b*, 4*c*, and 4*d*.

(1-2-2) Heat-Source-Side Unit

The heat-source-side unit 2 is installed on the rooftop of a building or the like or around a building or the like. The heat-source-side unit 2 constitutes a part of the refrigerant circuit by being connected to the use-side units 3*a*, 3*b*, 3*c*, and 3*d* via: the first connection pipe 5; the second connection pipe 6; the third connection pipe 7; the fourth connection pipes 8*a*, 8*b*, 8*c*, and 8*d*; the fifth connection pipes 9*a*, 9*b*, 9*c*, and 9*d*; and the intermediate units 4*a*, 4*b*, 4*c*, and 4*d*.

The heat-source-side unit 2 mainly includes: a compressor 21; one or more (here, three) switching mechanisms 22*a*, 22*b*, and 22*c*; one or more (here, two) heat-source-side heat exchangers 23*a* and 23*b*; one or more heat-source-side expansion valves 24*a* and 24*b*; an ejector 25; and a gas-liquid separator 26.

The compressor 21 is a device that compresses a low-pressure refrigerant to have a high pressure. Here, as the compressor 21, a compressor having a hermetic structure in which a rotary-type or scroll-type positive-displacement compression element (not shown) is rotatably driven by a compressor motor is used. Here, the rotation speed of the compressor motor can be controlled by an inverter or the like, and thus the capacity of the compressor 21 can be controlled.

In one or more embodiments, the compressor 21 discharges the refrigerant in a supercritical state. Therefore, the refrigerant in a supercritical state flows through a part of the refrigerant circuit. The refrigerant compressed by the compressor 21 contains carbon dioxide. Here, carbon dioxide is used as the refrigerant.

The switching mechanisms 22*a*, 22*b*, and 22*c* are each a four-way switching valve that can switch the flow direction of the refrigerant in the refrigerant circuit.

The first and second switching mechanisms 22*a* and 22*b* are electric valves that switch between a heat-source-side heat-radiation state in which the heat-source-side heat exchangers 23*a* and 23*b* each function as a radiator of the refrigerant (a refrigerant-heat radiator) and a heat-source-side evaporation state in which the heat-source-side heat exchangers 23*a* and 23*b* each function as an evaporator of the refrigerant (a refrigerant evaporator).

The first switching mechanism 22*a* is a device that can switch the flow of the refrigerant in the refrigerant circuit as follows: when causing the first heat-source-side heat exchanger 23*a* to function as the refrigerant-heat radiator, the first switching mechanism 22*a* connects the discharge side of the compressor 21 to the gas side of the first heat-source-side heat exchanger 23*a* (see the broken lines in the first switching mechanism 22*a* in FIG. 1); and when causing the first heat-source-side heat exchanger 23*a* to function as the refrigerant evaporator, the first switching mechanism 22*a* connects the suction side of the compressor 21 to the gas side of the first heat-source-side heat exchanger 23*a* (see the solid lines in the first switching mechanism 22*a* in FIG. 1).

The second switching mechanism 22*b* is a device that can switch the flow of the refrigerant in the refrigerant circuit as follows: when causing the second heat-source-side heat exchanger 23*b* to function as the refrigerant-heat radiator, the second switching mechanism 22*b* connects the discharge side of the compressor 21 to the gas side of the second heat-source-side heat exchanger 23*b* (see the broken lines in the second switching mechanism 22*b* in FIG. 1); and when causing the second heat-source-side heat exchanger 23*b* to function as the refrigerant evaporator, the second switching mechanism 22*b* connects the suction side of the compressor 21 to the gas side of the second heat-source-side heat exchanger 23*b* (see the solid lines in the second switching mechanism 22*b* in FIG. 1).

The third switching mechanism 22*c* is a device that can switch the flow of the refrigerant in the refrigerant circuit as follows: when sending the refrigerant discharged from the compressor 21 to the second connection pipe 6, the third switching mechanism 22*c* connects the discharge side of the compressor 21 to the second connection pipe 6 (see the solid lines in the third switching mechanism 22*c* in FIG. 1); and when sending the refrigerant flowing in the second connection pipe 6 to the compressor 21, the third switching mechanism 22*c* connects the suction side of the compressor 21 to the second connection pipe 6 (see the broken lines in the third switching mechanism 22*c* in FIG. 1).

The switching mechanisms 22*a*, 22*b*, and 22*c* each are not limited to a mechanism constituted by a four-way switching valve, and each may be, for example, a mechanism that is configured to be capable of switching the flow direction of the refrigerant as described above by combining a plurality of electromagnetic valves and refrigerant pipes.

The first heat-source-side heat exchanger 23*a* and the second heat-source-side heat exchanger 23*b* each perform heat exchange between the refrigerant and outdoor air. The first heat-source-side heat exchanger 23*a* and the second heat-source-side heat exchanger 23*b* are each a heat exchanger that functions as the refrigerant-heat radiator or as the refrigerant evaporator.

The opening degree of each of the first heat-source-side expansion valve 24*a* and the second heat-source-side expansion valve 24*b* can be changed. The degree of decompression is adjusted by adjusting each of the opening degree of the first heat-source-side expansion valve 24*a* and the opening degree of the second heat-source-side expansion valve 24*b*. To be specific, the first heat-source-side expansion valve 24*a* is an electric expansion valve whose opening degree can be adjusted, for example, to adjust the flow rate of the refrigerant that flows through the first heat-source-side heat exchanger 23*a*. The second heat-source-side expansion valve 24*b* is an electric expansion valve whose opening degree can be adjusted, for example, to adjust the flow rate of the refrigerant that flows through the second heat-source-side heat exchanger 23*b*.

The ejector 25 pressurizes the refrigerant that has exchanged heat in the heat-source-side heat exchangers 23*a* and 23*b* by using a driving flow. To be specific, the ejector 41 is a pressurizing mechanism that is provided in the refrigerant circuit so as to suck and pressurize a low-pressure refrigerant by using a high-pressure refrigerant as the driving flow and that supplies the pressurized refrigerant to the compressor 21.

The ejector 25 includes a driving-flow inlet 25*a*, a suction-flow inlet 25*b*, and a discharge opening 25*c*. The driving flow flows into the driving-flow inlet 25*a*. The refrigerant that has exchanged heat in the heat-source-side heat exchangers 23*a* and 23*b* flows into the suction-flow inlet 25*b*. The discharge opening 25*c* pressurizes the refrigerant that has exchanged heat in the heat-source-side heat exchangers 23*a* and 23*b* and discharges the refrigerant. The refrigerant discharged from the discharge opening 25*c* is in a gas-liquid two-phase state.

The refrigerant that has flowed out from the ejector 25 flows into the gas-liquid separator 26. The gas-liquid separator 26 includes a refrigerant inlet 26*a*, a liquid-side outlet 26*b*, and a gas-side outlet 26*c*. The refrigerant inlet 26*a* communicates with the discharge opening 25*c* of the ejector 25. The refrigerant in a gas-liquid two-phase state flows into the refrigerant inlet 26*a*. A liquid refrigerant that has been separated flows into the liquid-side outlet 26*b*. A gas refrigerant that has been separated flows out from the gas-side outlet 26*c*.

The heat-source-side unit 2 further includes a heat-source-side first valve V21, a heat-source-side second valve V22, a heat-source-side third valve V23, and a heat-source-side fourth valve V24.

The heat-source-side first valve V21 is provided in a heat-source-side first pipe P21 that connects the first heat-source-side heat exchanger 23*a* and the second heat-source-side heat exchanger 23*b* to the first connection pipe 5. Here, the heat-source-side first valve V21 is an electric valve whose opening degree can be adjusted.

The heat-source-side second valve V22 is provided in a heat-source-side second pipe P22 that connects the first connection pipe 5 to the driving-flow inlet 25*a* of the ejector 25. The heat-source-side second pipe P22 branches from a part of the heat-source-side first pipe P21 between the first connection pipe 5 and the heat-source-side first valve V21. Here, the heat-source-side second valve V22 is an electric valve that can be opened and closed.

The heat-source-side third valve V23 is provided in a heat-source-side third pipe P23 that connects the second connection pipe 6 to the refrigerant inlet 26*a* of the gas-liquid separator 26. The heat-source-side third valve V23 is a check valve that allows the refrigerant to flow only in the direction from the second connection pipe 6 to the gas-liquid separator 26. Here, the heat-source-side third valve V23 is provided between the third switching mechanism 22*c* and the refrigerant inlet 26*a*.

The heat-source-side fourth valve V24 is provided in a heat-source-side fourth pipe P24 that connects the first heat-source-side heat exchanger 23*a* and the second heat-source-side heat exchanger 23*b* to the liquid-side outlet 26*b* of the gas-liquid separator 26. The heat-source-side fourth valve V24 is a check valve that allows the refrigerant to flow only in the direction from the liquid-side outlet 26*b* to the first heat-source-side heat exchanger 23*a* and the second heat-source-side heat exchanger 23*b*. Here, the heat-source-side fourth valve V24 is provided between the liquid-side outlet 26*b*, and the first heat-source-side expansion valve 24*a* and the second heat-source-side expansion valve 24*b*.

A first shutoff valve V25 is provided at a connection portion between the heat-source-side unit 2 and the first connection pipe 5. A second shutoff valve V26 is provided at a connection portion between the heat-source-side unit 2 and the second connection pipe 6. A third shutoff valve V27 is provided at a connection portion between the heat-source-side unit 2 and the third connection pipe 7. The first shutoff valve V25, the second shutoff valve V26, and the third shutoff valve V27 are valves that are manually opened and closed.

(1-2-3) Use-Side Unit

The use-side units 3*a*, 3*b*, 3*c*, and 3*d* are each, for example, installed in or hung from the ceiling of an indoor space of a building or mounted on a wall of the indoor space. The use-side units 3*a*, 3*b*, 3*c*, and 3*d* constitute a part of the refrigerant circuit by being connected to the heat-source-side unit 2 via: the first connection pipe 5; the second connection pipe 6; the third connection pipe 7; the fourth connection pipes 8*a*, 8*b*, 8*c*, and 8*d*; the fifth connection pipes 9*a*, 9*b*, 9*c*, and 9*d*; and the intermediate units 4*a*, 4*b*, 4*c*, and 4*d*.

Next, the configuration of the use-side units 3*a*, 3*b*, 3*c*, and 3*d* will be described. The use-side units 3*a*, 3*b*, 3*c*, and 3*d* include a first use-side unit 3*a*, a second use-side unit 3*b*, a third use-side unit 3*c*, and a fourth use-side unit 3*d* that are connected to each other in parallel.

The first use-side unit 3*a* includes a first use-side heat exchanger 31*a* and a first use-side expansion valve 32*a*. The second use-side unit 3*b* includes a second use-side heat exchanger 31*b* and a second use-side expansion valve 32*b*. The third use-side unit 3*c* includes a third use-side heat exchanger 31*c* and a third use-side expansion valve 32*c*. The fourth use-side unit 3*d* includes a fourth use-side heat exchanger 31*d* and a fourth use-side expansion valve 32*d*. Each of the use-side heat exchangers 31*a*, 31*b*, 31*c*, and 31*d* and a corresponding one of the use-side expansion valves 32*a*, 32*b*, 32*c*, and 32*d* are connected to each other in series.

The use-side heat exchangers 31*a*, 31*b*, 31*c*, and 31*d* are each a heat exchanger that handles an air-conditioning load (thermal load) in an indoor space by exchanging heat between the refrigerant and indoor air. The use-side heat exchangers 31*a*, 31*b*, 31*c*, and 31*d* each function as the refrigerant evaporator to cool indoor air during a cooling operation and each function as the refrigerant-heat radiator to heat indoor air during a heating operation.

The opening degree of each of the use-side expansion valves 32*a*, 32*b*, 32*c*, and 32*d* can be changed. The degree of decompression of each of the use-side expansion valves 32*a*, 32*b*, 32*c*, and 32*d* is adjusted by adjusting the opening degree of each of the use-side expansion valves 32*a*, 32*b*, 32*c*, and 32*d*. To be specific, the use-side expansion valves 32*a*, 32*b*, 32*c*, and 32*d* are each an electric expansion valve whose opening degree can be adjusted to, for example, adjust the flow rate of the refrigerant that flows through a corresponding one of the use-side heat exchangers 31*a*, 31*b*, 31*c*, and 31*d*.

The use-side first pipes P31*a*, P31*b*, P31*c*, and P31*d* connect the use-side heat exchangers 31*a*, 31*b*, 31*c*, and 31*d* to the fourth connection pipes 8*a*, 8*b*, 8*c*, and 8*d*. In the use-side first pipes P31*a*, P31*b*, P31*c*, and P31*d*, the use-side expansion valves 32*a*, 32*b*, 32*c*, and 32*d* are disposed between the fourth connection pipes 8*a*, 8*b*, 8*c*, and 8*d* and the use-side heat exchangers 31*a*, 31*b*, 31*c*, and 31*d*. The use-side second pipes P32*a*, P32*b*, P32*c*, and P32*d* connect the use-side heat exchangers 31*a*, 31*b*, 31*c*, and 31*d* to the fifth connection pipes 9*a*, 9*b*, 9*c*, and 9*d*.

Although an air conditioner including four use-side units is described here, the present disclosure is also applicable to a case where more than four or less than four use-side units are connected to one heat-source-side unit 2 to form one refrigerant circuit.

(1-2-4) Intermediate Unit

The intermediate units 4*a*, 4*b*, 4*c*, and 4*d* perform switching so as to cause the plurality of use-side heat exchangers 31*a*, 31*b*, 31*c*, and 31*d* to individually function as a refrigerant evaporator or the refrigerant-heat radiator. The intermediate unit 4 is disposed in an indoor space of a building together with the use-side units 3*a*, 3*b*, 3*c*, and 3*d*. The intermediate units 4*a*, 4*b*, 4*c*, and 4*d* constitute a part of the refrigerant circuit by being interposed between the use-side units 3*a*, 3*b*, 3*c*, and 3*d* and the heat-source-side unit 2 together with the first connection pipe 5, the second connection pipe 6, the third connection pipe 7, the fourth connection pipes 8*a*, 8*b*, 8*c*, and 8*d*, and the fifth connection pipes 9*a*, 9*b*, 9*c*, and 9*d*.

In one or more embodiments, the intermediate units 4*a*, 4*b*, 4*c*, and 4*d* include a plurality of ejectors 41*a*, 41*b*, 41*c*, and 41*d*. In other words, the entirety of the intermediate units 4*a*, 4*b*, 4*c*, and 4*d* includes the plurality of ejectors 41*a*, 41*b*, 41*c*, and 41*d*. Each of the ejectors 41*a*, 41*b*, 41*c*, and 41*d* is connected to a corresponding one of the use-side units 3*a*, 3*b*, 3*c*, and 3*d*. Therefore, each of the ejectors 41*a*, 41*b*, 41*c*, and 41*d* can pressurize the refrigerant for a corresponding one of the use-side units 3*a*, 3*b*, 3*c*, and 3*d*. Here, the refrigerant that has radiated (released) heat in the use-side units 3*a*, 3*b*, 3*c*, and 3*d* that perform a heating operation is not pressurized by the ejectors 41*a*, 41*b*, 41*c*, and 41*d*. In other words, the ejectors 41*a*, 41*b*, 41*c*, and 41*d* that are connected to the use-side units 3*a*, 3*b*, 3*c*, and 3*d* that perform a heating operation do not function.

The intermediate units 4*a*, 4*b*, 4*c*, and 4*d* further include a plurality of gas-liquid separators 42*a*, 42*b*, 42*c*, and 42*d*. In other words, the entirety of the intermediate units 4*a*, 4*b*, 4*c*, and 4*d* further includes the plurality of gas-liquid separators 42*a*, 42*b*, 42*c*, and 42*d*. The refrigerant that has flowed out from each of the ejectors 41*a*, 41*b*, 41*c*, and 41*d* flows into a corresponding one of the gas-liquid separators 42*a*, 42*b*, 42*c*, and 42*d*.

Next, the configuration of the intermediate units 4*a*, 4*b*, 4*c*, and 4*d* will be described. In the following description, only the configuration of the intermediate unit 4*a* will be described, because the configuration of each of the intermediate units 4*b*, 4*c*, and 4*d* is similar to that of the intermediate unit 4*a*. Regarding elements of the intermediate units 4*b*, 4*c*, and 4*d*, suffixes "b", "c", and "d" will be added instead of a suffix "a" indicating corresponding elements of the intermediate unit 4*a*, and descriptions of such elements will be omitted.

One intermediate unit 4*a* includes one ejector 41*a* and one gas-liquid separator 42*a*.

The ejector 41*a* pressurizes the refrigerant. To be specific, the ejector 41 is a pressurizing mechanism that is provided in the refrigerant circuit so as to suck and pressurize a low-pressure refrigerant that has exchanged heat in the use-side heat exchanger 31*a* by using a high-pressure refrigerant as the driving flow and to supply the pressurized refrigerant to a low-pressure-side connection pipe.

The ejector 41*a* does not pressurize the refrigerant that flows through the use-side unit 3*a* that performs a heating operation. Here, the ejector 41*a* pressurizes the refrigerant that has evaporated in the use-side unit 3*a* that performs a cooling operation, by using the driving flow. It is also possible not to pressurize the refrigerant that has evaporated in the use-side unit 3*a* that performs a cooling operation.

The ejector 41*a* includes a driving-flow inlet 411*a*, a suction-flow inlet 412*a*, and a discharge opening 413*a*. The driving flow flows into the driving-flow inlet 411*a*. The driving-flow inlet 411*a* communicates with the use-side heat exchanger 31*a* that functions as the refrigerant evaporator. The refrigerant that has evaporated in the evaporator flows into the suction-flow inlet 412*a*. The discharge opening 413*a* pressurizes the refrigerant that has evaporated in the evaporator and discharges the refrigerant. The refrigerant discharged from the discharge opening 413*a* is in a gas-liquid two-phase state.

The refrigerant that has flowed out from the ejector 41*a* flows into the gas-liquid separator 42*a*. The gas-liquid separator 42*a* includes a refrigerant inlet 421*a*, a liquid-side outlet 422*a*, and a gas-side outlet 423*a*. The refrigerant inlet 421*a* communicates with the discharge opening 413*a* of the ejector 41*a*. The refrigerant in the gas-liquid two-phase state flows into the refrigerant inlet 421*a*. A liquid refrigerant that has been separated flows out from the liquid-side outlet 422*a*. A gas refrigerant that has been separated flows out from the gas-side outlet 423*a*.

The intermediate unit 4*a* further includes an intermediate first pipe P41*a*, an intermediate second pipe P42*a*, an intermediate third pipe P43*a*, an intermediate fourth pipe P44*a*, an intermediate fifth pipe P45*a*, an intermediate sixth pipe P46*a*, an intermediate seventh pipe P47*a*, an intermediate first valve V41*a*, an intermediate second valve V42*a*, an intermediate third valve V43*a*, an intermediate fourth valve V44*a*, an intermediate fifth valve V45*a*, and an intermediate sixth valve V46*a*.

The intermediate first pipe P41 allows the refrigerant to flow between the heat-source-side heat exchangers 23*a* and 23*b* and the first use-side heat exchanger 31*a*. Here, the intermediate first pipe P41 connects the branch pipe portion 5*a* of the first connection pipe 5 to the fourth connection pipe 8*a*. An intermediate first valve V41*a* is provided in the intermediate first pipe P41*a*. Here, the intermediate first valve V41*a* is an on-off valve.

The intermediate second pipe P42*a* branches from a part of the intermediate first pipe P41*a* between the heat-source-side heat exchangers 23*a* and 23*b* and the intermediate first valve V41*a*, and allows the refrigerant to flow to the driving-flow inlet 411*a* of the ejector 41*a*. An intermediate second valve V42*a* is provided in the intermediate second pipe P42*a*. Here, the intermediate second valve V42*a* is an on-off valve.

The intermediate third pipe P43*a* connects the fifth connection pipe 9*a* to the branch pipe portion 6*a* of the second connection pipe 6. An intermediate third valve V43*a* is provided in the intermediate third pipe P43. Here, the intermediate third valve V43*a* is an on-off valve.

The intermediate fourth pipe P44*a* branches from a part of the intermediate third pipe P43*a* between the fifth connection pipe 9*a* and the intermediate third valve V43*a*, and allows the refrigerant to flow to the suction-flow inlet 412*a* of the ejector 41*a*. An intermediate fourth valve V44*a* is provided in the intermediate fourth pipe P44*a*. Here, the intermediate fourth valve V44*a* is an on-off valve.

The intermediate fifth pipe P45*a* connects the liquid-side outlet 422*a* of the gas-liquid separator 42*a* to the fourth connection pipe 8*a*. An intermediate fifth valve V45*a* is provided in the intermediate fifth pipe P45*a*. The intermediate fifth valve V45*a* is a check valve that allows the refrigerant to flow only in the direction from the liquid-side outlet 422*a* to the fourth connection pipe 8*a*.

The intermediate sixth pipe P46*a* connects the gas-side outlet 423*a* of the gas-liquid separator 42*a* to the branch pipe portion 6*a* of the second connection pipe 6. An intermediate sixth valve V46*a* is provided in the intermediate sixth pipe P46. The intermediate sixth valve V46*a* is an electric valve.

The intermediate seventh pipe P47*a* connects the gas-side outlet 423*a* of the gas-liquid separator 42*a* to the branch pipe portion 7*a* of the third connection pipe 7.

Shutoff valves are provided at connection portions between the intermediate unit 4*a* and connection pipes. The shutoff valves are valves that are manually opened and closed. Here, three shutoff valves are provided at connection portions between the intermediate unit 4*a* and the first to third connection pipes 5 to 7. To be specific, the three shutoff valves are provided at: a connection portion between the intermediate unit 4*a* and the branch pipe portion 5*a* of the first connection pipe 5, a connection portion between the intermediate unit 4*a* and the branch pipe portion 6*a* of the second connection pipe 6, and a connection portion between the intermediate unit 4*a* and the branch pipe portion 7*a* of the third connection pipe 7. Here, two shutoff valves are provided at the connection portions between the intermediate unit 4*a* and the fourth and fifth connection pipes 8*a* and 9*a*. To be specific, the two shutoff valves are provided at a connection portion between the intermediate unit 4*a* and the fourth connection pipe 8*a* and at a connection portion between the intermediate unit 4*a* and the fifth connection pipe 9*a*.

(1-2-5) Control Unit

Figure 2:
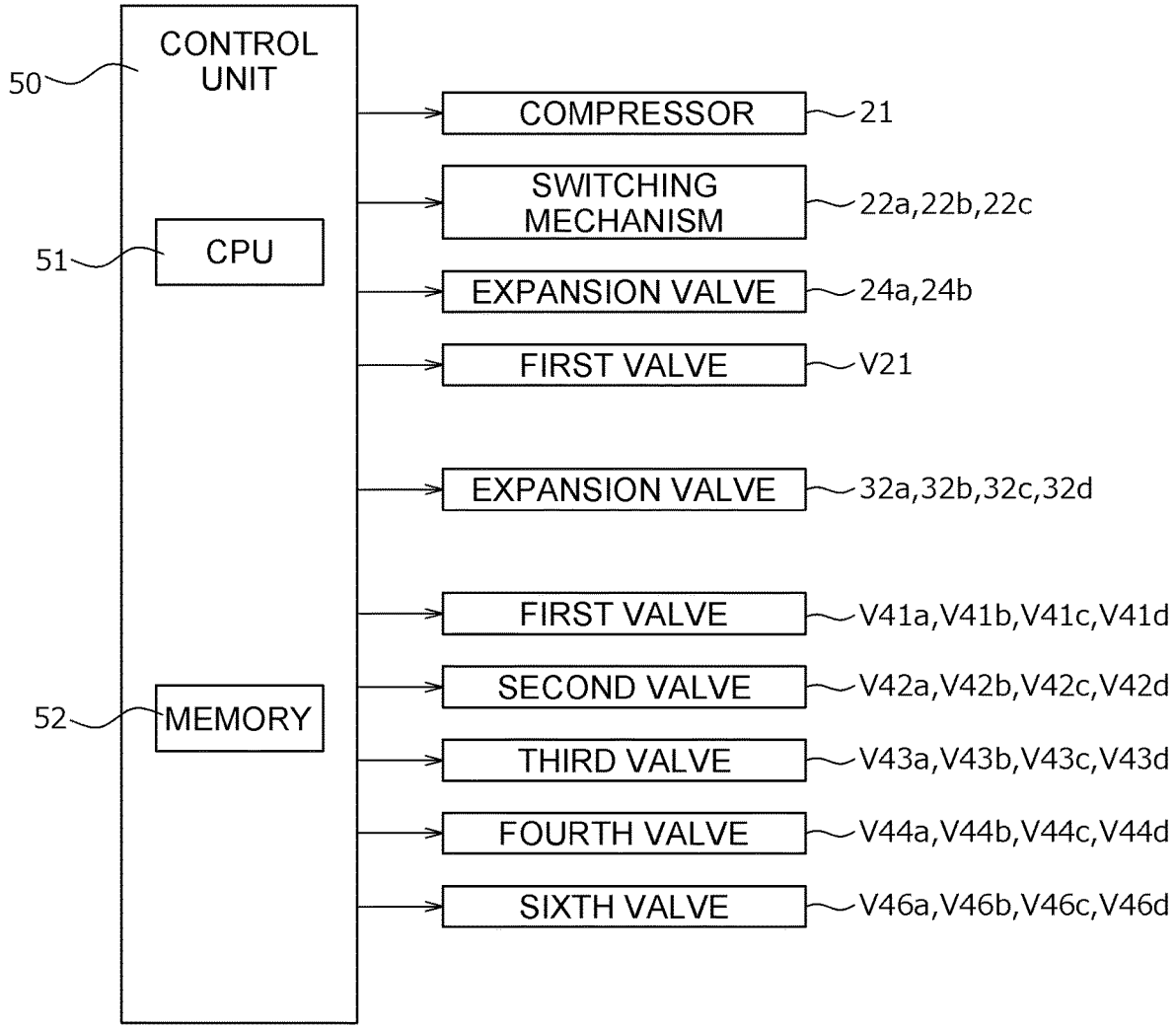
FIG. 2 is a schematic block diagram of the air conditioner according to the first embodiments.

The control unit 50 illustrated in FIG. 2 controls the constituent devices of the heat-source-side unit 2, the use-side units 3*a*, 3*b*, 3*c*, and 3*d*, and the intermediate unit 4. The control unit 50 is, for example, implemented in a computer. The computer includes, for example, a control arithmetic device and a storage device. A processor can be used as the control arithmetic device. The control unit 50 illustrated in FIG. 2 includes a CPU 51 as the processor. The control arithmetic device, for example, reads a program stored in the storage device and performs predetermined image processing, arithmetic processing, or sequence processing in accordance with the program. Moreover, for example, in accordance with the program, the control arithmetic device can write an arithmetic result in the storage device and can read information stored in the storage device. The storage device can be used as a database. The control unit 50 includes a memory 52 as the storage device.

The control unit 50 controls the following: the compressor 21, the switching mechanisms 22*a*, 22*b*, and 22*c*, the heat-source-side expansion valves 24*a* and 24*b*, and the heat-source-side first valve V21 of the heat-source-side unit 2; the use-side expansion valves 32*a*, 32*b*, 32*c*, and 32*d* of the use-side units 3*a*, 3*b*, 3*c*, and 3*d*; and the intermediate first valves V41*a*, V41*b*, V41*c*, and V41*d*, the intermediate second valves V42*a*, V42*b*, V42*c*, and V42*d*, the intermediate third valves V43*a*, V43*b*, V43*c*, and V43*d*, the intermediate fourth valves V44*a*, V44*b*, V44*c*, and V44*d*, and the intermediate sixth valves V46*a*, V46*b*, V46*c*, and V46*d* of the intermediate unit 4.

To be specific, the control unit 50 controls whether or not to cause each of the ejectors 41*a*, 41*b*, 41*c*, and 41*d* to function by controlling a corresponding one of the intermediate first valves V41*a*, V41*b*, V41*c*, and V41*d* to be fully opened or fully closed. Here, the control unit 50 controls to what degree each of the ejectors 41*a*, 41*b*, 41*c*, and 41*d* pressurizes the refrigerant that has released heat in a corresponding one of the use-side units 3*a*, 3*b*, 3*c*, and 3*d* by adjusting the opening degree of a corresponding one of the intermediate second valves V42*a*, V42*b*, V42*c*, and V42*d*.

The control unit 50 performs control so as not to cause the ejectors 41*a*, 41*b*, 41*c*, and 41*d* to function when the power recovery amount is smaller than a predetermined amount and so as to cause the ejectors 41*a*, 41*b*, 41*c*, and 41*d* to function when the power recovery amount is larger than the predetermined amount. For example, the control unit 50 performs control so as not to cause each of the ejectors 41*a*, 41*b*, 41*c*, and 41*d* to function when a temperature detected by a temperature sensor provided in a corresponding one of the driving-flow inlets 411*a*, 411*b*, 411*c*, and 411*d* of the ejectors 41*a*, 41*b*, 41*c*, and 41*d* is lower than a predetermined temperature, and so as to cause each of the ejectors 41*a*, 41*b*, 41*c*, and 41*d* to function when the temperature detected by the temperature sensor is higher than or equal to the predetermined temperature.

(1-3) Operational Action

Figure 3:
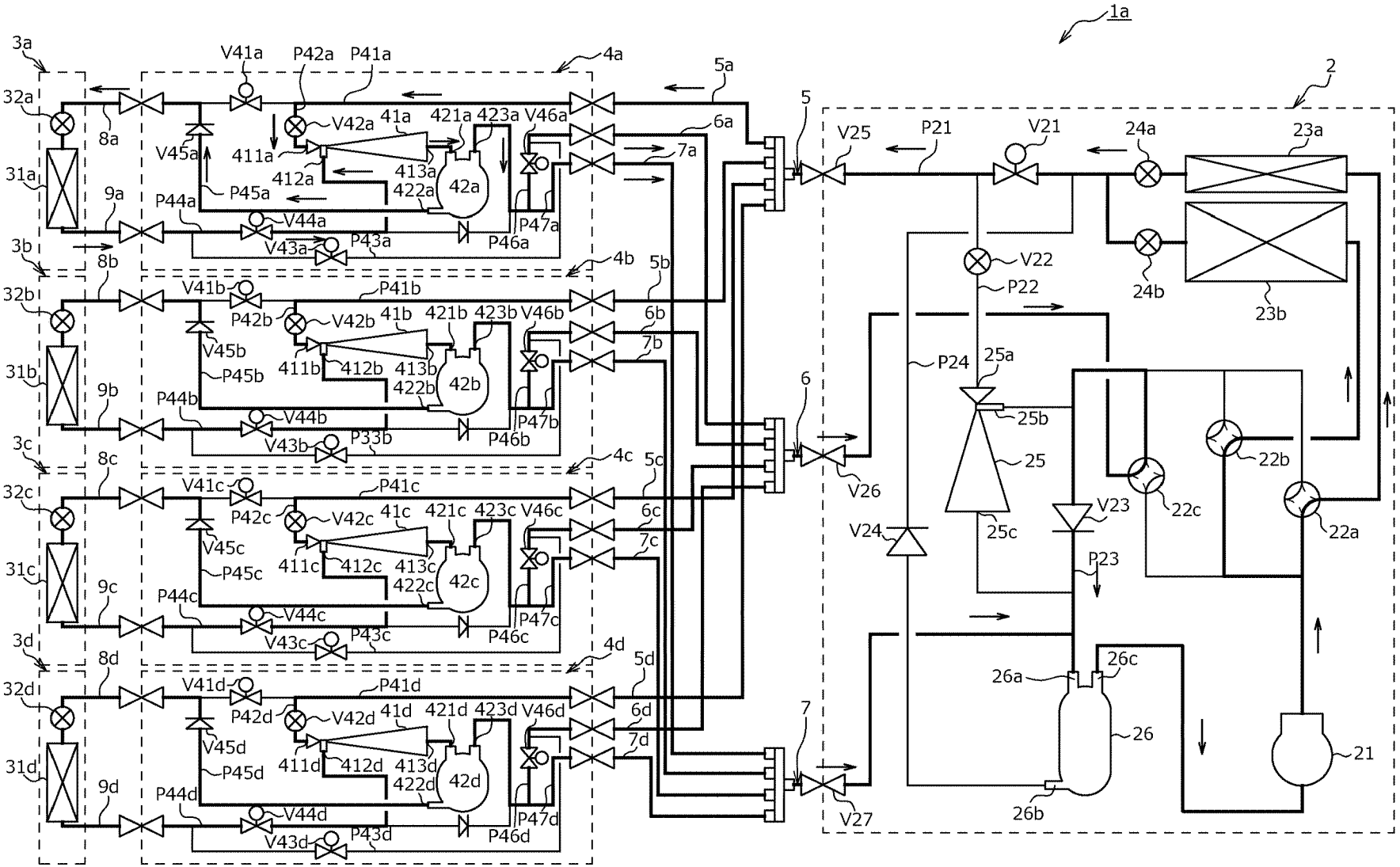
FIG. 3 is a schematic view of the air conditioner according to the first embodiments (illustrating the flow of the refrigerant during a cooling-only operation).

The operations of the air conditioner 1*a* according to one or more embodiments include a cooling-only operation, a cooling-main operation, a cooling-heating-balanced operation, a heating-main operation, and a heating-only operation. The cooling-only operation is an operation in which all of the use-side units 3*a*, 3*b*, 3*c*, and 3*d* perform cooling. The cooling-main operation is an operation in which cooling and heating are both performed so that the sum of the cooling-operation loads of the plurality of use-side units 3*a*, 3*b*, 3*c*, and 3*d* is larger than the sum of the heating-operation loads. The cooling-heating-balanced operation is an operation in which cooling and heating are both performed so that the sum of the cooling-operation loads of the plurality of use-side units 3*a*, 3*b*, 3*c*, and 3*d* is approximately equal to the sum of the heating-operation loads. The heating-main operation is an operation in which cooling and heating are both performed so that the sum of the heating-operation loads of the plurality of use-side units 3*a*, 3*b*, 3*c*, and 3*d* is larger than the sum of the cooling-operation loads. The heating-only operation is an operation in which all of the use-side units 3*a*, 3*b*, 3*c*, and 3*d* perform heating. Hereafter, referring to FIGS. 3 to and 7, actions in the five operations of the air conditioner 1*a* will be described. In FIGS. 3 to and 7, thick-line pipes represent pipes through which the refrigerant flows, and thin-line pipes represent pipes through which the refrigerant does not flow. Valves provided in the thick-line pipes are opened, and valves provided in the thin-line pipes are closed.

Here, the ejectors 41*a*, 41*b*, 41*c*, and 41*d* of the intermediate units 4*a*, 4*b*, 4*c*, and 4*d* are configured to be capable of functioning or not functioning in the cooling-only operation, the cooling-main operation, the cooling-heating-balanced operation, and the heating-main operation. Therefore, in the cooling-only operation, the cooling-main operation, the cooling-heating-balanced operation, and the heating-main operation, it is possible to select whether to cause the ejectors 41*a*, 41*b*, 41*c*, and 41*d* to function or not to cause the ejectors 41*a*, 41*b*, 41*c*, and 41*d* to function. On the other hand, the ejectors 41*a*, 41*b*, 41*c*, and 41*d* do not function in the heating-only operation.

Here, in the heating-main operation and the heating-only operation, the ejector 25 of the heat-source-side unit 2 is caused to function.

(1-3-1) Cooling-Only Operation (1-3-1-1) Case where Ejector is Caused to Function As illustrated in FIG. 3, in the cooling-only operation, for example, all of the use-side units 3*a*, 3*b*, 3*c*, and 3*d* each perform a cooling operation (that is, an operation in which all of the use-side heat exchangers 31*a*, 31*b*, 31*c*, and 31*d* each function as the refrigerant evaporator and the heat-source-side heat exchangers 23*a* and 23*b* each function as the refrigerant-heat radiator).

At this time, in the heat-source-side unit 2, the control unit 50 switches the switching mechanisms 22*a* and 22*b* so as to connect the discharge side of the compressor 21 to the gas side of the first heat-source-side heat exchanger 23*a* and the second heat-source-side heat exchanger 23*b* (the state of the switching mechanisms 22*a* and 22*b* shown by a solid line in FIG. 3), in order to cause the first heat-source-side heat exchanger 23*a* and the second heat-source-side heat exchanger 23*b* to each function as the refrigerant-heat radiator. The control unit 50 switches the switching mechanism 22*c* so as to connect the suction side of the compressor 21 to the second connection pipe 6 (the state of the switching mechanism 22*c* shown by a solid line in FIG. 3), in order to send the refrigerant that flows in the second connection pipe 6 to the suction side of the compressor 21. The control unit 50 opens (here, fully opens) the first heat-source-side expansion valve 24*a* and the second heat-source-side expansion valve 24*b*, opens the heat-source-side first valve V21, and fully closes the heat-source-side second valve V22.

In the intermediate units 4*a*, 4*b*, 4*c*, and 4*d*, in order to cause the ejectors 41*a*, 41*b*, 41*c*, and 41*d* to function, the control unit 50 closes the intermediate first valves V41*a*, V41*b*, V41*c*, and V41*d*, opens the intermediate second valves V42*a*, V42*b*, V42*c*, and V42*d*, closes the intermediate third valves V43*a*, V43*b*, V43*c*, and V43*d*, opens the intermediate fourth valves V44*a*, V44*b*, V44*c*, and V44*d*, and opens the intermediate sixth valves V46*a*, V46*b*, V46*c*, and V46*d*.

In the use-side units 3*a*, 3*b*, 3*c*, and 3*d*, the control unit 50 adjusts the opening degree of each of the use-side expansion valves 32*a*, 32*b*, 32*c*, and 33*d* in accordance with the cooling load of a corresponding one of the use-side units 3*a*, 3*b*, 3*c*, and 3*d*.

When the control unit 50 thus controls the constituent devices of the heat-source-side unit 2, the use-side units 3*a*, 3*b*, 3*c*, and 3*d*, and the intermediate units 4*a*, 4*b*, 4*c*, and 4*d*, the refrigerant in a supercritical state discharged from the compressor 21 is sent to the first heat-source-side heat exchanger 23*a* and the second heat-source-side heat exchanger 23*b* by way of the switching mechanisms 22*a* and 22*b*. The refrigerants sent to the first heat-source-side heat exchanger 23*a* and the second heat-source-side heat exchanger 23*b* release heat as a result of being cooled by exchanging heat with outdoor air in the first heat-source-side heat exchanger 23*a* and the second heat-source-side heat exchanger 23*b* each of which functions as the refrigerant-heat radiator. The refrigerants merge after passing through the first heat-source-side expansion valve 24*a* and the second heat-source-side expansion valve 24*b*, and flow out from the heat-source-side unit 2 further by way of the heat-source-side first valve V21.

The refrigerant that has flowed out from the heat-source-side unit 2 is sent to the intermediate units 4*a*, 4*b*, 4*c*, and 4*d* through the first connection pipe 5. Because the intermediate first valves V41*a*, V41*b*, V41*c*, and V41*d* are closed and the intermediate second valves V42*a*, V42*b*, V42*c*, and V42*d* are opened, the refrigerant sent to the intermediate units 4*a*, 4*b*, 4*c*, and 4*d* flows into the driving-flow inlets 411*a*, 411*b*, 411*c*, and 411*d* of the ejectors 41*a*, 41*b*, 41*c*, and 41*d*. The refrigerant is mixed with the refrigerant that flows into the suction-flow inlets 412*a*, 412*b*, 412*c*, and 412*d* (refrigerant that has evaporated in the use-side heat exchangers 31*a*, 31*b*, 31*c*, and 31*d* each of which functions as the refrigerant evaporator), and is discharged from the discharge openings 413*a*, 413*b*, 413*c*, and 413*d*. The refrigerant in a gas-liquid two-phase state, which has flowed out from the ejectors 41*a*, 41*b*, 41*c*, and 41*d*, flows into the refrigerant inlets 421*a*, 421*b*, 421*c*, and 421*d* of the gas-liquid separators 42*a*, 42*b*, 42*c*, and 42*d*. Then, the refrigerant separated by the gas-liquid separators 42*a*, 42*b*, 42*c*, and 42*d* and flowing out from the liquid-side outlets 422*a*, 422*b*, 422*c*, and 422*d* and flows out from the intermediate units 4*a*, 4*b*, 4*c*, and 4*d* by way of the intermediate fifth valves V45*a*, V45*b*, V45*c*, and V45*d*.

The refrigerant that has flowed out from the intermediate units 4*a*, 4*b*, 4*c*, and 4*d* is sent to the use-side units 3*a*, 3*b*, 3*c*, and 3*d* through the fourth connection pipes 8*a*, 8*b*, 8*c*, and 8*d*. The refrigerant sent to the use-side units 3*a*, 3*b*, 3*c*, and 3*d* is sent to the use-side heat exchangers 31*a*, 31*b*, 31*c*, and 31*d* by way of the use-side expansion valves 32*a*, 32*b*, 32*c*, and 32*d*. The refrigerant evaporates as a result of being heated by exchanging heat with indoor air, which is supplied from an indoor space, in the use-side heat exchangers 31*a*, 31*b*, 31*c*, and 31*d* each of which functions as the refrigerant evaporator, and then flows out from the use-side units 3*a*, 3*b*, 3*c*, and 3*d*. On the other hand, indoor air cooled in the use-side heat exchangers 31*a*, 31*b*, 31*c*, and 31*d* is sent to the indoor space, and thus cooling of the indoor space is performed.

The refrigerant that has flowed out from the use-side units 3*a*, 3*b*, 3*c*, and 3*d* is sent to the intermediate units 4*a*, 4*b*, 4*c*, and 4*d* through the fifth connection pipes 9*a*, 9*b*, 9*c*, and 9*d*. Because the intermediate third valves V43*a*, V43*b*, V43*c*, and V43*d* are closed and the intermediate fourth valves V44*a*, V44*b*, V44*c*, and V44*d* are opened, the refrigerant sent to the intermediate units 4*a*, 4*b*, 4*c*, and 4*d* flows into the suction-flow inlets 412*a*, 412*b*, 412*c*, and 412*d* of the ejectors 41*a*, 41*b*, 41*c*, and 41*d*. The low-pressure refrigerant that has flowed into the ejectors 41*a*, 41*b*, 41*c*, and 41*d* is pressurized by being mixed in the ejectors 41*a*, 41*b*, 41*c*, and 41*d* with the refrigerant that has flowed thereinto from the driving-flow inlets 411*a*, 411*b*, 411*c*, and 411*d* described above. The refrigerant in a two phase state that has been pressurized and discharged from the discharge openings 413*a*, 413*b*, 413*c*, and 413*d* flows into the refrigerant inlets 421*a*, 421*b*, 421*c*, and 421*d* of the gas-liquid separators 42*a*, 42*b*, 42*c*, and 42*d*. Then, the refrigerant separated by the gas-liquid separators 42*a*, 42*b*, 42*c*, and 42*d* and flowing out from the gas-side outlet 423*a*, 423*b*, 423*c*, and 423*d* is branched into the intermediate sixth pipes P46*a*, P46*b*, P46*c*, and P46*d* and the intermediate seventh pipes P47*a*, P47*b*, P47*c*, and P47*d*, and flows out from the intermediate units 4*a*, 4*b*, 4*c*, and 4*d*.

The refrigerant that has flowed out from the intermediate sixth pipes P46*a*, P46*b*, P46*c*, and P46*d* of the intermediate units 4*a*, 4*b*, 4*c*, and 4*d* is sent to the heat-source-side unit 2 through the second connection pipe 6. The refrigerant that has flowed out from the intermediate seventh pipes P47*a*, P47*b*, P47*c*, and P47*d* of the intermediate units 4*a*, 4*b*, 4*c*, and 4*d* is sent to the heat-source-side unit 2 through the third connection pipe 7.

The refrigerant sent from the second connection pipe 6 to the heat-source-side unit 2 flows into the refrigerant inlet 26*a* of the gas-liquid separator 26 by way of the third switching mechanism 22*c* and the heat-source-side third valve V23. The refrigerant sent from the third connection pipe 7 to the heat-source-side unit 2 also flows into the refrigerant inlet 26*a* of the gas-liquid separator 26. Then, the refrigerant separated by the gas-liquid separator 26 and flowing out from the gas-side outlet 26*c* is sucked into the compressor 21.

Thus, during the cooling-only operation described above, the ejectors 41*a*, 41*b*, 41*c*, and 41*d* of the intermediate units 4*a*, 4*b*, 4*c*, and 4*d* are each caused to function to pressurize the refrigerant that has evaporated in a corresponding one of the use-side units 3*a*, 3*b*, 3*c*, and 3*d* each of which performs a cooling operation, and then the refrigerant is returned to the compressor 21 through the second connection pipe 6 and the third connection pipe 7.

(1-3-1-2) Case where Ejector is not Caused to Function

In the intermediate units 4*a*, 4*b*, 4*c*, and 4*d*, when the ejectors 41*a*, 41*b*, 41*c*, and 41*d* are not caused to function, the control unit 50 opens the intermediate first valves V41*a*, V41*b*, V41*c*, and V41*d*, closes the intermediate second valves V42*a*, V42*b*, V42*c*, and V42*d*, opens the intermediate third valves V43*a*, V43*b*, V43*c*, and V43*d*, opens the intermediate fourth valves V44*a*, V44*b*, V44*c*, and V44*d*, and opens the intermediate sixth valves V46*a*, V46*b*, V46*c*, and V46*d*.

In this case, because the intermediate first valves V41*a*, V41*b*, V41*c*, and V41*d* are opened and the intermediate second valves V42*a*, V42*b*, V42*c*, and V42*d* are closed, the refrigerant sent from the heat-source-side unit 2 to the intermediate units 4*a*, 4*b*, 4*c*, and 4*d* flows out to the use-side units 3*a*, 3*b*, 3*c*, and 3*d* through the intermediate first pipe P41 and the fourth connection pipes 8*a*, 8*b*, 8*c*, and 8*d*, without passing through the ejectors 41*a*, 41*b*, 41*c*, and 41*d*.

Because the intermediate third valves V43*a*, V43*b*, V43*c*, and V43*d* and the intermediate fourth valves V44*a*, V44*b*, V44*c*, and V44*d* are open and the driving flow does not flow through the ejectors 41*a*, 41*b*, 41*c*, and 41*d*, the refrigerant sent from the use-side units 3*a*, 3*b*, 3*c*, and 3*d* to the intermediate units 4*a*, 4*b*, 4*c*, and 4*d* through the fifth connection pipes 9*a*, 9*b*, 9*c*, and 9*d* flows out to the heat-source-side unit 2 through the intermediate third pipe P43 and the second connection pipe 6, without passing through the ejectors 41*a*, 41*b*, 41*c*, and 41*d*.

Figure 4:
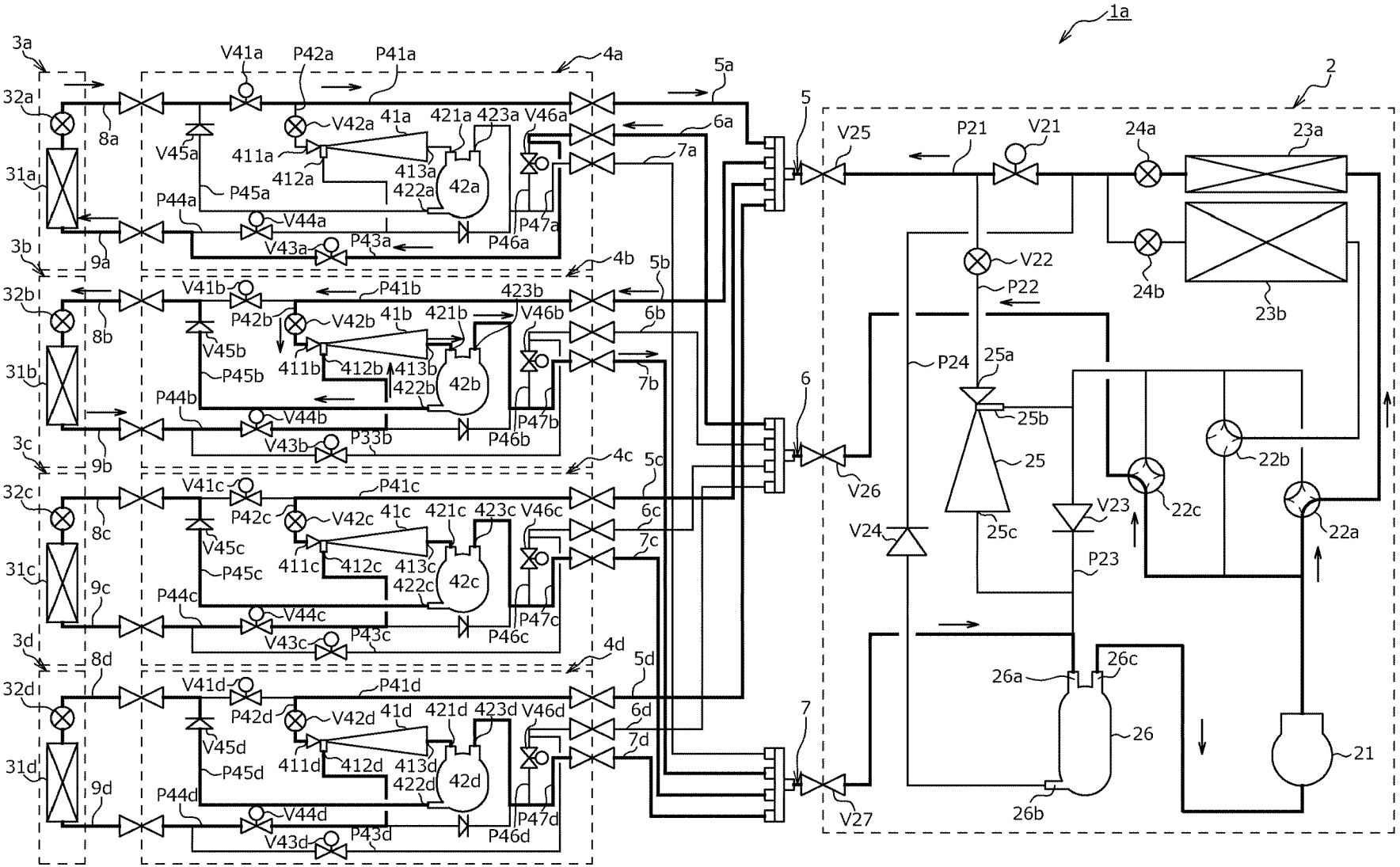
FIG. 4 is a schematic view of the air conditioner according to the first embodiments (illustrating the flow of the refrigerant during a cooling-main operation).

(1-3-2) Cooling-Main Operation (1-3-2-1) Case where Ejector is Caused to Function As illustrated in FIG. 4, in the cooling-main operation, for example, the use-side units 3*b*, 3*c*, and 3*d* each perform a cooling operation and the use-side unit 3*a* performs a heating operation (that is, the use-side heat exchangers 31*b*, 31*c*, and 31*d* each function as the refrigerant evaporator and the use-side heat exchanger 31*a* functions as the refrigerant-heat radiator).

At this time, in the heat-source-side unit 2, the control unit 50 switches the switching mechanism 22*a* so as to connect the discharge side of the compressor 21 to the gas side of the first heat-source-side heat exchanger 23*a* (the state of the switching mechanism 22*a* shown by a solid line in FIG. 4), in order to cause the first heat-source-side heat exchanger 23*a* to function as the refrigerant-heat radiator. The control unit 50 switches the switching mechanism 22*c* so as to connect the discharge side of the compressor 21 to the second connection pipe 6 (the state of the switching mechanism 22*c* shown by a solid line in FIG. 4), in order to send the refrigerant discharged from the compressor 21 to the second connection pipe 6. Here, because the refrigerant does not flow through the switching mechanism 22*b*, the switching mechanism 22*b* is not controlled by the control unit 50. The control unit 50 opens the first heat-source-side expansion valve 24*a*, fully closes the second heat-source-side expansion valve 24*b* that has been slightly opened, opens the heat-source-side first valve V21, and fully closes the heat-source-side second valve V22.

In the intermediate unit 4*a*, the control unit 50 opens the intermediate first valve V41*a*, fully closes the intermediate second valve V42*a*, opens the intermediate third valve V43*a*, closes the intermediate fourth valve V44*a*, and closes the intermediate sixth valve V46*a*. In the intermediate units 4*b*, 4*c*, and 4*d*, the control unit 50 closes the intermediate first valves V41*b*, V41*c*, and V41*d*, opens the intermediate second valves V42*b*, V42*c*, and V42*d*, closes the intermediate third valves V43*b*, V43*c*, and V43*d*, opens the intermediate fourth valves V44*b*, V44*c*, and V44*d*, and closes the intermediate sixth valves V46*b*, V46*c*, and V46*d*, in order to cause the ejectors 41*b*, 41*c*, and 41*d* to function.

In the use-side units 3*a*, 3*b*, 3*c*, and 3*d*, the control unit 50 adjusts the opening degree of each of the use-side expansion valves 32*a*, 32*b*, 32*c*, and 33*d* in accordance with the heating load of the use-side unit 3*a* and the cooling load of each of the use-side units 3*b*, 3*c*, and 3*d*.

When the control unit 50 thus controls the constituent devices of the heat-source-side unit 2, the use-side units 3*a*, 3*b*, 3*c*, and 3*d*, and the intermediate units 4*a*, 4*b*, 4*c*, and 4*d*, a part of the refrigerant in a supercritical state discharged from the compressor 21 is sent to the first heat-source-side heat exchanger 23*a* via the first switching mechanism 22*a*, and the remaining part of the refrigerant flows out from the heat-source-side unit 2 to the second connection pipe 6 via the third switching mechanism 22*c*. The refrigerant sent to the first heat-source-side heat exchanger 23*a* releases heat as a result of being cooled by exchanging heat with outdoor air in the first heat-source-side heat exchanger 23*a* that functions as the refrigerant-heat radiator. The refrigerant flows out from the heat-source-side unit 2 to the first connection pipe 5 by way of the first heat-source-side expansion valve 24*a* and the heat-source-side first valve V21.

The refrigerant that has flowed out to the second connection pipe 6 is sent to the intermediate unit 4*a* through the branch pipe portion 6*a*. The high-pressure refrigerant sent to the intermediate unit 4*a* flows into the intermediate third pipe P43*a*, and flows out from the intermediate unit 4*a* by way of the intermediate third valve V43*a*.

The refrigerant that has flowed out from the intermediate unit 4*a* is sent to the use-side unit 3*a* through the fifth connection pipe 9*a*. The refrigerant sent to the use-side unit 3*a* is sent to the use-side heat exchanger 31*a*. The high-pressure refrigerant sent to the use-side heat exchanger 31*a* releases heat as a result of being cooled by exchanging heat with indoor air, which is supplied from an indoor space, in the use-side heat exchanger 31*a* that functions as the refrigerant-heat radiator. The refrigerant flows out from the use-side unit 3*a* through the use-side expansion valve 32*a* that is fully opened. On the other hand, the indoor air heated in the use-side heat exchanger 31*a* is sent to the indoor space, and thus heating of the indoor space is performed.

The refrigerant that has flowed out from the use-side unit 3*a* is sent to the intermediate unit 4*a* through the fourth connection pipe 8*a*. The refrigerant sent to the intermediate unit 4*a* flows into the intermediate first pipe P41*a*, and flows out from the intermediate unit 4*a* by way of the intermediate first valve V41*a*.

The refrigerant that has flowed out from the intermediate unit 4*a* passes through the branch pipe portion 5*a* and, at the merging portion of the first connection pipe 5, merges with the refrigerant that has flowed out from the first heat-source-side heat exchanger 23*a* to the first connection pipe 5. The merged refrigerant is sent to the intermediate units 4*b*, 4*c*, and 4*d* through the branch pipe portions 5*b*, 5*c*, and 5*d*.

The refrigerant sent to the intermediate units 4*b*, 4*c*, and 4*d* flows into the driving-flow inlets 411*b*, 411*c*, and 411*d* of the ejectors 41*b*, 41*c*, and 41*d* through the intermediate first pipes P41*b*, P41*c*, and P41*d* and the intermediate second pipes P42*b*, P42*c*, and P42*d*. The refrigerant is mixed with the refrigerant from the suction-flow inlets 412*b*, 412*c*, and 412*d*, which has evaporated in the evaporator, and is discharged from the discharge openings 413*b*, 413*c*, and 413*d*. The refrigerant in a gas-liquid two-phase state, which has flowed out from the ejectors 41*b*, 41*c*, and 41*d*, flows into the refrigerant inlets 421*b*, 421*c*, and 421*d* of the gas-liquid separators 42*b*, 42*c*, and 42*d*. Then, the refrigerant separated by the gas-liquid separators 42*b*, 42*c*, and 42*d* and flowing out from the liquid-side outlets 422*b*, 422*c*, and 422*d* flows out from the intermediate units 4*b*, 4*c*, and 4*d* by way of the intermediate fifth valves V45*b*, V45*c*, and V45*d*.

The refrigerant that has flowed out from the intermediate units 4*b*, 4*c*, and 4*d* is sent to the use-side units 3*b*, 3*c*, and 3*d* through the fourth connection pipes 8*b*, 8*c*, and 8*d*. The refrigerant sent to the use-side units 3*b*, 3*c*, and 3*d* is sent to the use-side heat exchangers 31*b*, 31*c*, and 31*d* by way of the use-side expansion valves 32*b*, 32*c*, and 32*d*. The refrigerant sent to the use-side heat exchangers 31*b*, 31*c*, and 31*d* evaporates as a result of being heated by exchanging heat with indoor air, which is supplied from an indoor space, in the use-side heat exchangers 31*b*, 31*c*, and 31*d* each of which functions as the refrigerant evaporator. The refrigerant flows out from the use-side units 3*b*, 3*c*, and 3*d*. On the other hand, indoor air cooled in the use-side heat exchangers 31*b*, 31*c*, and 31*d* is sent to the indoor space, and thus cooling of the indoor space is performed.

The refrigerant that has flowed out from the use-side units 3*b*, 3*c*, and 3*d* is sent to the intermediate units 4*b*, 4*c*, and 4*d* through the fifth connection pipes 9*b*, 9*c*, and 9*d*. The refrigerant sent to the intermediate units 4*b*, 4*c*, and 4*d* flows into the suction-flow inlets 412*b*, 412*c*, and 412*d* of the ejectors 41*b*, 41*c*, and 41*d*. The low-pressure refrigerant that has flowed into the ejectors 41*b*, 41*c*, and 41*d* is pressurized by being mixed in the ejectors 41*b*, 41*c*, and 41*d* with the refrigerant that has flowed thereinto from the driving-flow inlets 411*b*, 411*c*, and 411*d* described above. The refrigerant in a two phase state that has been pressurized and discharged flows into the refrigerant inlets 421*b*, 421*c*, and 421*d* of the gas-liquid separators 42*b*, 42*c*, and 42*d*. Then, the refrigerant separated by the gas-liquid separators 42*b*, 42*c*, and 42*d* and flowing out from the gas-side outlets 423*b*, 423*c*, and 423*d* flows out from the intermediate units 4*b*, 4*c*, and 4*d* through the intermediate seventh pipes P47*b*, P47*c*, and P47*d*.

The refrigerant that has flowed out from the intermediate units 4*b*, 4*c*, and 4*d* is sent to the heat-source-side unit 2 through the branch pipe portions 7*b*, 7*c*, and 7*d* of the third connection pipe 7.

The refrigerant sent to the heat-source-side unit 2 flows into the refrigerant inlet 26*a* of the gas-liquid separator 26. Then, the refrigerant separated by the gas-liquid separator 26 and flowing out from the gas-side outlet 26*c* is sucked into the compressor 21.

Thus, during the cooling-main operation described above, the ejectors 41*a*, 41*b*, 41*c*, and 41*d* of the intermediate units 4*b*, 4*c*, and 4*d* are caused to function to pressurize the refrigerant that has evaporated in the use-side units 3*b*, 3*c*, and 3*d* each of which performs a cooling operation, and then the refrigerant is returned to the compressor 21 through the third connection pipe 7. The refrigerant that has released heat in the use-side unit 3*a* that performs a heating operation is not pressurized by the ejector 41*a*.

(1-3-2-2) Case where Ejector is not Caused to Function

In the intermediate units 4*b*, 4*c*, and 4*d*, when the ejectors 41*b*, 41*c*, and 41*d* are not caused to function, the control unit 50 opens the intermediate first valves V41*b*, V41*c*, and V41*d*, closes the intermediate second valves V42*b*, V42*c*, and V42*d*, closes the intermediate third valves V43*b*, V43*c*, and V43*d*, opens the intermediate fourth valves V44*b*, V44*c*, and V44*d*, and closes the intermediate sixth valves V46*b*, V46*c*, and V46*d*.

In this case, the refrigerant sent from the heat-source-side unit 2 to the intermediate units 4*b*, 4*c*, and 4*d* flows out to the use-side units 3*b*, 3*c*, and 3*d* through the intermediate first pipe P41 and the fourth connection pipes 8*b*, 8*c*, and 8*d*, without passing through the ejectors 41*b*, 41*c*, and 41*d*. The refrigerant sent from the use-side units 3*b*, 3*c*, and 3*d* to the intermediate units 4*b*, 4*c*, and 4*d* flows out from the intermediate seventh pipes P47*b*, P47*c*, and P47*d* by way of the intermediate third pipe P43, the intermediate fourth valves V44*b*, V44*c*, and V44*d*, and the check valve, without passing through the ejectors 41*b*, 41*c*, and 41*d*. The refrigerant that has flowed out from the intermediate units 4*b*, 4*c*, and 4*d* flows into the heat-source-side unit 2 through the third connection pipe 7.

Figure 5:
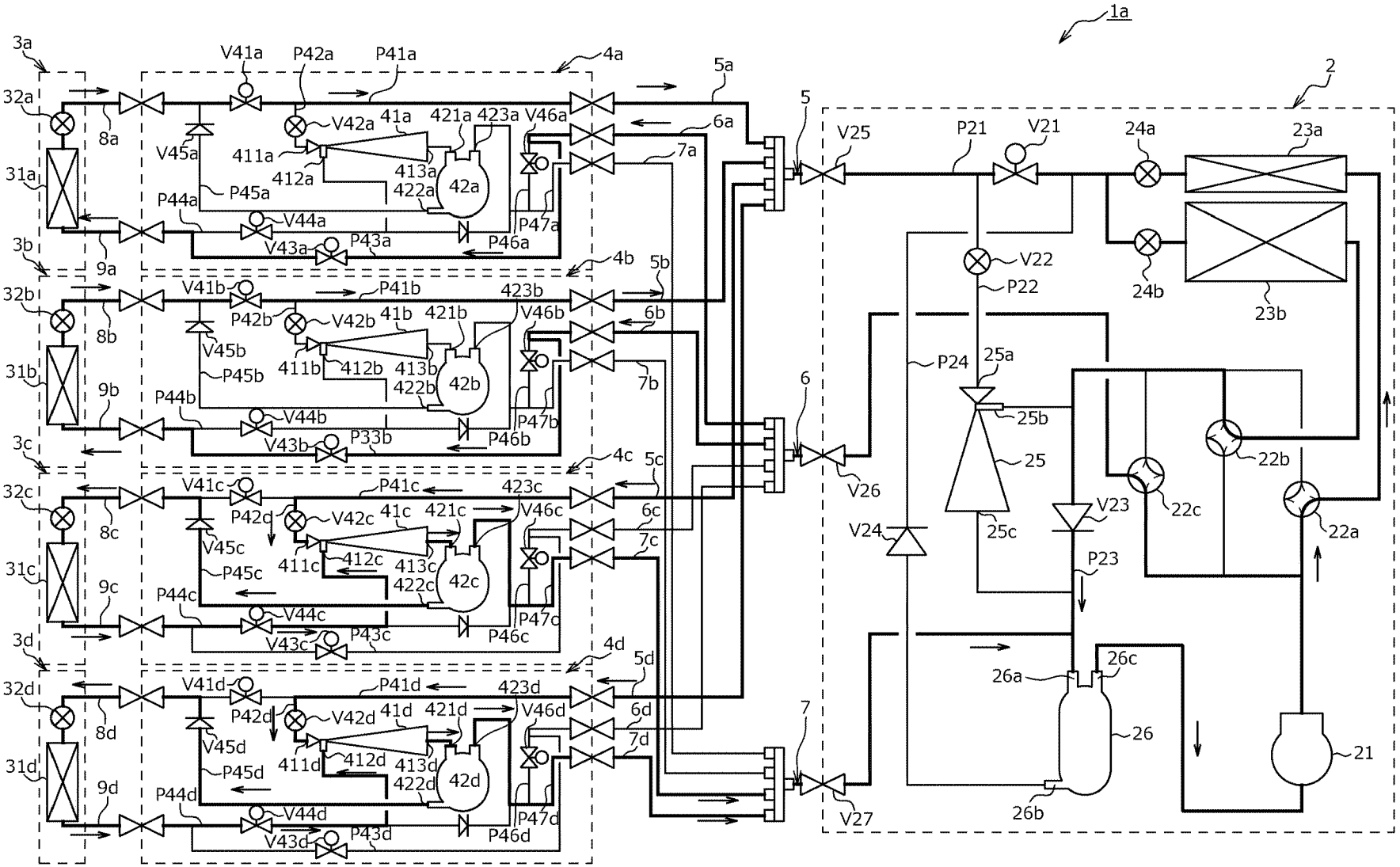
FIG. 5 is a schematic view of the air conditioner according to the first embodiments (illustrating the flow of the refrigerant during a cooling-heating-balanced operation).

(1-3-3) Cooling-Heating-Balanced Operation (1-3-3-1) Case where Ejector is Caused to Function As illustrated in FIG. 5, in the cooling-heating-balanced operation, for example, the use-side units 3*c* and 3*d* each perform a cooling operation and the use-side units 3*a* and 3*b* each perform a heating operation (that is, an operation in which the use-side heat exchangers 31*c* and 31*d* each function as the refrigerant evaporator and the use-side heat exchangers 31*a* and 31*b* each function as the refrigerant-heat radiator).

At this time, in the heat-source-side unit 2, the control unit 50 switches the first switching mechanism 22*a* so as to connect the discharge side of the compressor 21 to the gas side of the third heat-source-side heat exchanger 23*a* (the state of the switching mechanism 22*a* shown by a solid line in FIG. 5), in order to cause the third heat-source-side heat exchanger 23*a* to function as the refrigerant-heat radiator. The control unit 50 switches the second switching mechanism 22*b* so as to connect the suction side of the compressor 21 to the gas side of the second heat-source-side heat exchanger 23*b* (the state of the switching mechanism 22*b* shown by a solid line in FIG. 5). The control unit 50 switches the third switching mechanism 22*c* so as to connect the discharge side of the compressor 21 to the second connection pipe 6 (the state of the switching mechanism 22*c* shown by a solid line in FIG. 5), in order to send the refrigerant discharged from the compressor 21 to the second connection pipe 6. The control unit 50 opens the first heat-source-side expansion valve 24*a*, fully closes the second heat-source-side expansion valve 24*b* that has been slightly opened, opens the heat-source-side first valve V21, and fully closes the heat-source-side second valve V22.

In the intermediate units 4*a* and 4*b*, the control unit 50 opens the intermediate first valves V41*a* and V41*b*, fully closes the intermediate second valves V42*a* and V42*b*, opens the intermediate third valves V43*a* and V43*b*, closes the intermediate fourth valves V44*a* and V44*b*, and closes the intermediate sixth valves V46*a* and V46*b*. In the intermediate units 4*c* and 4*d*, in order to cause the ejectors 41*c* and 41*d* to function, the control unit 50 closes the intermediate first valves V41*c* and V41*d*, opens the intermediate second valves V42*c* and V42*d*, closes the intermediate third valves V43*c* and V43*d*, opens the intermediate fourth valves V44*c* and V44*d*, and closes the intermediate sixth valves V46*c* and V46*d*.

In the use-side units 3*a*, 3*b*, 3*c*, and 3*d*, the control unit 50 adjusts the opening degree of each of the use-side expansion valves 32*a*, 32*b*, 32*c*, and 33*d* in accordance with the heating load of each of the use-side units 3*a* and 3*b* and the cooling load of each of the use-side units 3*c* and 3*d*.

Thus, the control unit 50 controls the constituent devices of the heat-source-side unit 2, the use-side units 3*a*, 3*b*, 3*c*, and 3*d*, and the intermediate units 4*a*, 4*b*, 4*c*, and 4*d*. First, a case where the sum of the cooling-operation loads of the use-side units 3*c* and 3*d* is equal to the sum of the heating-operation loads of the use-side units 3*a* and 3*b* will be described.

A part of the refrigerant in a supercritical state discharged from the compressor 21 is sent to the first heat-source-side heat exchanger 23*a* via the first switching mechanism 22*a*, and the remaining part of the refrigerant flows out from the heat-source-side unit 2 to the second connection pipe 6 via the third switching mechanism 22*c*.

The refrigerant sent to the first heat-source-side heat exchanger 23*a* releases heat as a result of being cooled by exchanging heat with outdoor air in the first heat-source-side heat exchanger 23*a* that functions as the refrigerant-heat radiator. Then, the refrigerant is sent from the first heat-source-side heat exchanger 23*a* to the second heat-source-side heat exchanger 23*b* by way of the first heat-source-side expansion valve 24*a* and the second heat-source-side expansion valve 24*b*. The refrigerant sent to the second heat-source-side heat exchanger 23*b* passes through the gas-liquid separator 26 by way of the second switching mechanism 22*b* and the heat-source-side third valve V23, and returns to the compressor 21.

The refrigerant that has flowed out to the second connection pipe 6 is sent to the intermediate units 4*a* and 4*b* through the branch pipe portions 6*a* and 6*b*. The high-pressure refrigerant sent to the intermediate units 4*a* and 4*b* flows into the intermediate third pipes P43*a* and P43*b*, and flows out from the intermediate units 4*a* and 4*b* by way of intermediate third valves V43*a* and V43*b*.

The refrigerant that has flowed out from the intermediate units 4*a* and 4*b* is sent to the use-side units 3*a* and 3*b* through the fifth connection pipes 9*a* and 9*b*. The refrigerant sent to the use-side units 3*a* and 3*b* is sent to the use-side heat exchangers 31*a* and 31*b*. The high-pressure refrigerant sent to the use-side heat exchangers 31*a* and 31*b* releases heat as a result of being cooled by exchanging heat with indoor air, which is supplied from an indoor space, in the use-side heat exchangers 31*a* and 31*b* each of which functions as the refrigerant-heat radiator. The refrigerant flows out from the use-side units 3*a* and 3*b* through the use-side expansion valves 32*a* and 32*b* that are fully opened. On the other hand, the indoor air heated in the use-side heat exchangers 31*a* and 31*b* is sent to the indoor space, and thus heating of the indoor space is performed.

The refrigerant that has flowed out from the use-side units 3*a* and 3*b* is sent to the intermediate units 4*a* and 4*b* through the fourth connection pipes 8*a* and 8*b*. The refrigerant sent to the intermediate units 4*a* and 4*b* flows into the intermediate first pipes P41*a* and P41*b*, and flows out from the intermediate units 4*a* and 4*b* by way of the intermediate first valves V41*a* and V41*b*.

The refrigerant that has flowed out from the intermediate units 4*a* and 4*b* flows through the branch pipe portions 5*a* and 5*b*, flows into the branch pipe portions 5*c* and 5*d* at the merging portion of the first connection pipe 5, and is sent to the intermediate units 4*c* and 4*d*. The refrigerant sent to the intermediate units 4*c* and 4*d* flows into the driving-flow inlets 411*c* and 411*d* of the ejectors 41*c* and 41*d*. The refrigerant is mixed with the refrigerant from the suction-flow inlets 412*c* and 412*d*, which has evaporated in the evaporator, and is discharged from the discharge openings 413*c* and 413*d*. The refrigerant in a gas-liquid two-phase state, which has flowed out from the ejectors 41*c* and 41*d*, flows into the refrigerant inlets 421*c* and 421*d* of the gas-liquid separators 42*c* and 42*d*. Then, the refrigerant separated by the gas-liquid separators 42*c* and 42*d* and flowing out from the liquid-side outlets 422*c* and 422*d* flows out from the intermediate units 4*b*, 4*c*, and 4*d* by way of the intermediate fifth valves V45*c* and V45*d*.

The refrigerant that has flowed out from the intermediate units 4*c* and 4*d* is sent to the use-side units 3*c* and 3*d* through the fourth connection pipes 8*c* and 8*d*. The refrigerant sent to the use-side units 3*c* and 3*d* is sent to the use-side heat exchangers 31*c* and 31*d* by way of the use-side expansion valves 32*c* and 32*d*. The refrigerant sent to the use-side heat exchangers 31*c* and 31*d* evaporates as a result of being heated by exchanging heat with indoor air, which is supplied from an indoor space, in the use-side heat exchangers 31*c* and 31*d* each of which functions as the refrigerant evaporator. The refrigerant flows out from the use-side units 3*c* and 3*d*. On the other hand, the indoor air cooled in the use-side heat exchangers 31*c* and 31*d* is sent to the indoor space, and thus cooling of the indoor space is performed.

The refrigerant that has flowed out from the use-side units 3*c* and 3*d* is sent to the intermediate units 4*c* and 4*d* through the fifth connection pipes 9*c* and 9*d*. The refrigerant sent to the intermediate units 4*c* and 4*d* flows into the suction-flow inlets 412*c* and 412*d* of the ejectors 41*c* and 41*d*. The low-pressure refrigerant that has flowed into the ejectors 41*c* and 41*d* is pressurized by being mixed in the ejectors 41*c* and 41*d* with the refrigerant that has flowed thereinto from the driving-flow inlets 411*c* and 411*d* described above. The refrigerant in a two phase state that has been pressurized and discharged flows into the refrigerant inlets 421*c* and 421*d* of the gas-liquid separators 42*c* and 42*d*. Then, the refrigerant separated by the gas-liquid separators 42*c* and 42*d* and flowing out from the gas-side outlets 423*c* and 423*d* flows out from the intermediate units 4*c* and 4*d* through the intermediate seventh pipes P47*c* and P47*d*.

The refrigerant that has flowed out from the intermediate units 4*c* and 4*d* is sent to the heat-source-side unit 2 through the branch pipe portions 7*c* and 7*d* of the third connection pipe 7.

The refrigerant sent to the heat-source-side unit 2 flows into the refrigerant inlet 26*a* of the gas-liquid separator 26. Then, the refrigerant separated by the gas-liquid separator 26 and flowing out from the gas-side outlet 26*c* is sucked into the compressor 21.

Next, a case where the sum of the cooling-operation loads of the use-side units 3*c* and 3*d* is larger than the sum of the heating-operation loads of the use-side units 3*a* and 3*b* will be described.

In the heat-source-side unit 2, the refrigerant that has been sent to the first heat-source-side heat exchanger 23*a*, which functions as the refrigerant-heat radiator, and that has released heat flows out from the heat-source-side unit 2 and flows to the first connection pipe 5 by way of the first heat-source-side expansion valve 24*a* and the heat-source-side first valve V21. Then, at the merging portion of the first connection pipe 5, the refrigerant merges with the refrigerant that has flowed out from the intermediate units 4*a* and 4*b* to the branch pipe portions 5*a* and 5*b* (refrigerant that has exchanged heat in the use-side heat exchangers 31*a* and 31*b*). The merged refrigerant is sent to the intermediate units 4*c* and 4*d* through the branch pipe portions 5*c* and 5*d*.

Next, a case where the sum of the heating-operation loads of the use-side units 3*a* and 3*b* is larger than the sum of the cooling-operation loads of the use-side units 3*c* and 3*d* will be described.

The refrigerant that has exchanged heat in the use-side heat exchangers 31*a* and 31*b* and flowed out from the intermediate units 4*a* and 4*b* flows through the branch pipe portions 5*a* and 5*b*. At the merging portion of the first connection pipe 5, a part of the refrigerant flows to the heat-source-side unit 2, and the remaining part of the refrigerant flows to the branch pipe portions 5*c* and 5*d* and is sent to the intermediate units 4*c* and 4*d*. The refrigerant that has flowed to the heat-source-side unit 2 flows through the heat-source-side first pipe P21, and is sent to the second heat-source-side heat exchanger 23*b* by way of the heat-source-side first valve V21 and the second heat-source-side expansion valve 24*b*. The refrigerant that has evaporated in the second heat-source-side heat exchanger 23*b* flows into the refrigerant inlet 26*a* of the gas-liquid separator 26 by way of the second switching mechanism 22*b* and the heat-source-side third valve V23. Then, the refrigerant separated by the gas-liquid separator 26 and flowing out from the gas-side outlet 26*c* is sucked into the compressor 21.

Thus, during the cooling-balanced operation described above, the ejectors 41*c* and 41*d* of the intermediate units 4*c* and 4*d* is caused to function to pressurize the refrigerant that has evaporated in the use-side units 3*c* and 3*d* that performs a cooling operation, and then the refrigerant is returned to the compressor 21 through the third connection pipe 7. The refrigerant that has released heat in the use-side units 3*a* and 3*b* each of which performs a heating operation is not pressurized by the ejectors 41*a* and 41*b*.

(1-3-3-2) Case where Ejector is not Caused to Function

In the intermediate units 4*c* and 4*d*, in a case where the ejectors 41*c* and 41*d* are not caused to function, the control unit 50 opens the intermediate first valves V41*c* and V41*d*, closes the intermediate second valves V42*c* and V42*d*, closes the intermediate third valves V43*c* and V43*d*, opens the intermediate fourth valves V44*c* and V44*d*, and closes the intermediate sixth valves V46*c* and V46*d*. The action in this case is similar to that of the intermediate units 4*c* and 4*d* in the cooling-main operation.

Figure 6:
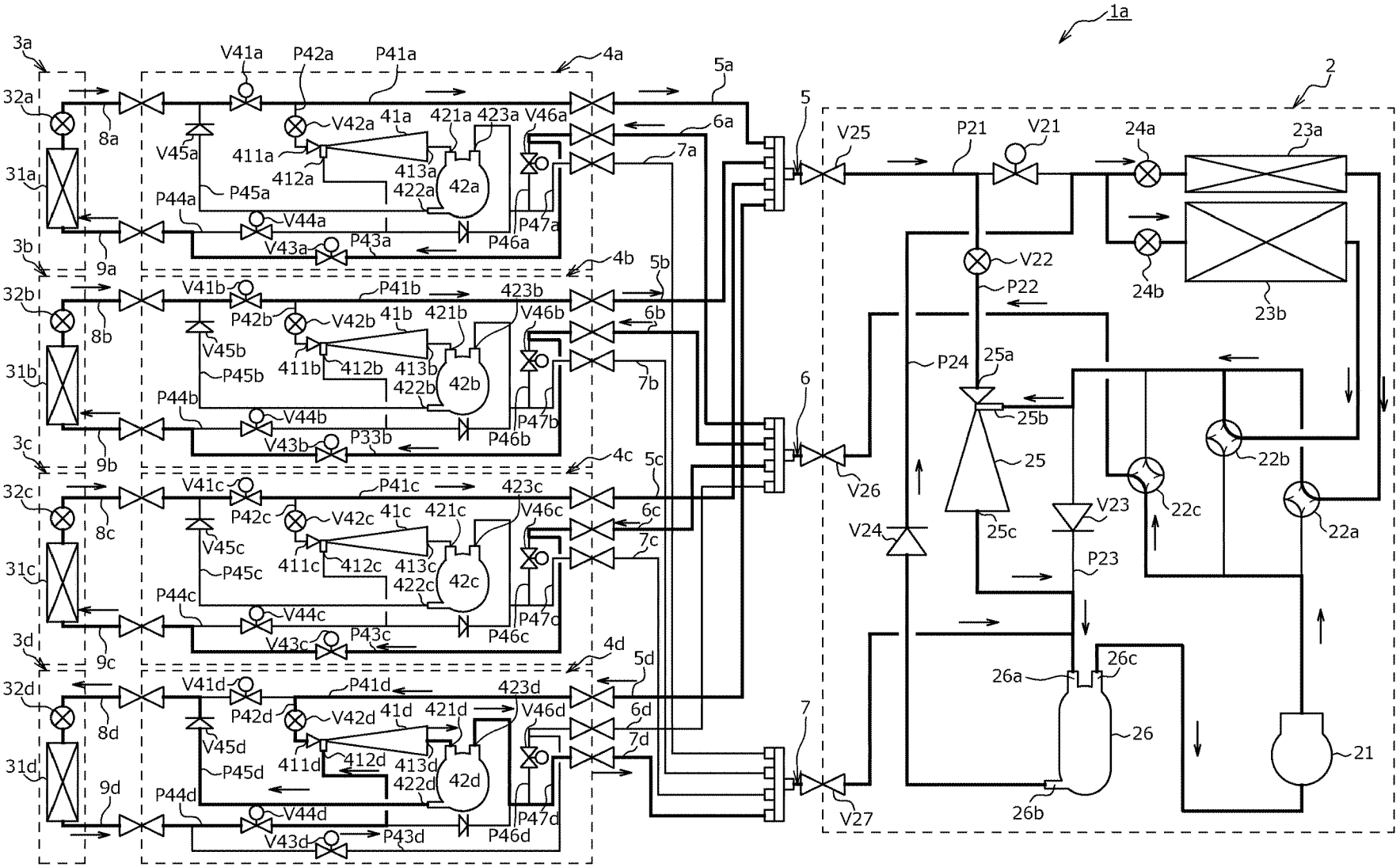
FIG. 6 is a schematic view of the air conditioner according to the first embodiments (illustrating the flow of the refrigerant during a heating-main operation).

(1-3-4) Heating-Main Operation (1-3-4-1) Case where Ejector is Caused to Function As illustrated in FIG. 6, in the heating-main operation, for example, the use-side unit 3*d* performs a cooling operation, and the use-side units 3*a*, 3*b*, and 3*c* each perform a heating operation (that is, an operation in which the use-side heat exchanger 31*d* functions as the refrigerant evaporator and the use-side heat exchangers 31*a*, 31*b*, and 31*c* each function as the refrigerant-heat radiator).

At this time, in the heat-source-side unit 2, the control unit 50 switches the first switching mechanism 22*a* and the second switching mechanism 22*b* so as to connect the suction side of the compressor 21 to the gas side of the first heat-source-side heat exchanger 23*a* and the second heat-source-side heat exchanger 23*b* (the state shown by the solid lines of the first switching mechanisms 22*a* and 22*b* in FIG. 6), in order to cause the first heat-source-side heat exchanger 23*a* and the second heat-source-side heat exchanger 23*b* to each function as the refrigerant evaporator. The control unit 50 switches the switching mechanism 22*c* so as to connect the discharge side of the compressor 21 to the second connection pipe 6 (the state of the switching mechanism 22*c* shown by a solid line in FIG. 6), in order to send the refrigerant discharged from the compressor 21 to the second connection pipe 6. The control unit 50 opens the first heat-source-side expansion valve 24*a*, opens the second heat-source-side expansion valve 24*b*, closes the heat-source-side first valve V21, and opens the heat-source-side second valve V22.

In the intermediate units 4*a*, 4*b*, and 4*c*, the control unit 50 opens the intermediate first valves V41*a*, V41*b*, and V41*c*, fully closes the intermediate second valves V42*a*, V42*b*, and V42*c*, opens the intermediate third valves V43*a*, V43*b*, and V43*c*, closes the intermediate fourth valves V44*a*, V44*b*, and V44*c*, and closes the intermediate sixth valves V46*a*, V46*b*, and V46*c*. In the intermediate unit 4*d*, in order to cause the ejector 41*d* to function, the control unit 50 closes the intermediate first valve V41*d*, opens the intermediate second valve V42*d*, closes the intermediate third valve V43*d*, opens the intermediate fourth valve V44*d*, and closes the intermediate sixth valve V46*d*.

In the use-side units 3*a*, 3*b*, 3*c*, and 3*d*, the control unit 50 adjusts the opening degree of each of the use-side expansion valves 32*a*, 32*b*, 32*c*, and 33*d* in accordance with the heating load of a corresponding one of the use-side units 3*a*, 3*b*, and 3*c* and the cooling load of the use-side unit 3*d*.

When the control unit 50 thus controls the constituent devices of the heat-source-side unit 2, the use-side units 3*a*, 3*b*, 3*c*, and 3*d*, and the intermediate units 4*a*, 4*b*, 4*c*, and 4*d*, the refrigerant in a supercritical state discharged from the compressor 21 flows out from the heat-source-side unit 2 to the second connection pipe 6 through the third switching mechanism 22*c*.

The refrigerant that has flowed out to the second connection pipe 6 is sent to the intermediate units 4*a*, 4*b*, and 4*c* through the branch pipe portions 6*a*, 6*b*, and 6*c*. The high-pressure refrigerant sent to the intermediate units 4*a*, 4*b*, and 4*c* flows into the intermediate third pipes P43*a*, P43*b*, and P43*c*, and flows out from the intermediate units 4*a*, 4*b*, and 4*c* by way of the intermediate third valves V43*a*, V43*b*, and V43*c*.

The refrigerant that has flowed out from the intermediate units 4*a*, 4*b*, and 4*c* is sent to the use-side units 3*a*, 3*b*, and 3*c* through the fifth connection pipes 9*a*, 9*b*, and 9*c*. Then, the high-pressure refrigerant sent to the use-side heat exchangers 31*a*, 31*b*, and 31*c* releases heat as a result of being cooled by exchanging heat with indoor air, which is supplied from an indoor space, in the use-side heat exchangers 31*a*, 31*b*, and 31*c* each of which functions as the refrigerant-heat radiator. The refrigerant flows out from the use-side units 3*a*, 3*b*, and 3*c* through the use-side expansion valves 32*a* and 32*b*, 32*c*. On the other hand, the indoor air heated in the use-side heat exchanger 31*a* is sent to the indoor space, and thus heating of the indoor space is performed.

The refrigerant that has flowed out from the use-side units 3*a*, 3*b*, and 3*c* is sent to the intermediate units 4*a*, 4*b*, and 4*c* through the fourth connection pipes 8*a*, 8*b*, and 8*c*. The refrigerant sent to the intermediate units 4*a*, 4*b*, and 4*c* flows into the intermediate first pipes P41*a*, P41*b*, and P41*c*, and flows out from the intermediate units 4*a*, 4*b*, and 4*c* by way of the intermediate first valves V41*a*, V41*b*, and V41*c*.

A part of the refrigerant that has flowed out from the intermediate units 4*a*, 4*b*, and 4*c* flows into the heat-source-side unit 2 through the branch pipe portions 5*a*, 5*b*, and 5*c* at the merging portion of the first connection pipe 5, and the remaining part of the refrigerant flows into the branch pipe portion 5*d*.

The refrigerant that has flowed into the branch pipe portion 5*d* is sent to the intermediate unit 4*d*. The refrigerant sent to the intermediate unit 4*d* flows into the driving-flow inlet 411*d* of the ejector 41*d*. The refrigerant is mixed with the refrigerant from the suction-flow inlet 412*d*, which has evaporated in the evaporator, and is discharged from the discharge opening 413*d*. The refrigerant in a gas-liquid two-phase state, which has flowed out from the ejector 41*d*, flows into the refrigerant inlet 421*d* of the gas-liquid separator 42*d*. Then, the refrigerant separated by the gas-liquid separator 42*d* and flowing out from the liquid-side outlet 422*d* flows out from the intermediate unit 4*d* by way of the intermediate fifth valve V45*d*.

The refrigerant that has flowed out from the intermediate unit 4*d* is sent to the use-side unit 3*d* through the fourth connection pipe 8*d*. The refrigerant sent to the use-side unit 3*d* is sent to the use-side heat exchanger 31*d* that functions as the refrigerant evaporator by way of the use-side expansion valve 32*d*, and evaporates as a result of being heated by exchanging heat with indoor air supplied from an indoor space. The refrigerant flows out from the use-side unit 3*d*. On the other hand, the indoor air cooled in the use-side heat exchanger 31*d* is sent to the indoor space, and thus cooling of the indoor space is performed.

The refrigerant that has flowed out from the use-side unit 3*d* is sent to the intermediate unit 4*d* through the fifth connection pipe 9*d*. The refrigerant sent to the intermediate unit 4*d* flows into the suction-flow inlet 412*d* of the ejector 41*d*, and is pressurized by being mixed in the ejector 41*d* with the refrigerant that has flowed thereinto from the driving-flow inlet 411*d* described above. The refrigerant in a two phase state that has been pressurized and discharged flows into the refrigerant inlet 421*d* of the gas-liquid separator 42*d*. Then, the refrigerant separated by the gas-liquid separator 42*d* and flowing out from the gas-side outlet 423*d* flows out from the intermediate unit 4*d* through the intermediate seventh pipe P47*d*.

The refrigerant that has flowed out from the intermediate unit 4*d* is sent to the heat-source-side unit 2 through the branch pipe portion 7*d* of the third connection pipe 7. The refrigerant flows into the refrigerant inlet 26*a* of the gas-liquid separator 26.

At the merging portion of the first connection pipe 5, the refrigerant that has flowed into the heat-source-side unit 2 (a part of the refrigerant that has exchanged heat in the use-side heat exchangers 31*a*, 31*b*, and 31*c*) flows into the driving-flow inlet 25*a* of the ejector 25. The refrigerant is mixed with the refrigerant that has flowed from the suction-flow inlet 25*b* (the refrigerant evaporated in the heat-source-side heat exchangers 23*a* and 23*b* each of which functions as the refrigerant evaporator), and is discharged from the discharge opening 25*c*. The refrigerant in a gas-liquid two-phase state, which has flowed out from the ejector 25, flows into the refrigerant inlet 26*a* of the gas-liquid separator 26.

Thus, in the gas-liquid separator 26, the refrigerant from the intermediate units 4*a*, 4*b*, and 4*c* merges with the refrigerant from the intermediate unit 4*d*. Then, the refrigerant separated by the gas-liquid separator 26 and flowing out from the liquid-side outlet 26*b* branches so as to flow to the first heat-source-side expansion valve 24*a* and the second heat-source-side expansion valve 24*b* by way of the heat-source-side fourth valve V24, and is sent to the first heat-source-side heat exchanger 23*a* and the second heat-source-side heat exchanger 23*b*. The refrigerant sent to the first heat-source-side heat exchanger 23*a* and the second heat-source-side heat exchanger 23*b* evaporates as a result of being heated by exchanging heat with outdoor air in the first heat-source-side heat exchanger 23*a* and the second heat-source-side heat exchanger 23*b* each of which functions as the refrigerant evaporator. The evaporated refrigerant flows into the suction-flow inlet 25*b* of the ejector 25 by way of the first switching mechanism 22*a* and the second switching mechanism 22*b*. The low-pressure refrigerant is pressurized by being mixed in the ejector 41*d* with the refrigerant that has flowed thereinto from the driving-flow inlet 25*a* described above. The refrigerant in a two phase state that has been pressurized and discharged flows into the refrigerant inlet 26*a* of the gas-liquid separator 26.

Then, the refrigerant separated by the gas-liquid separator 26 and flowing out from the gas-side outlet 26*c* is sucked into the compressor 21.

Thus, during the heating-main operation described above, the ejector 41*d* of the intermediate unit 4*d* is caused to function to pressurize the refrigerant that has evaporated in the use-side unit 3*d* that performs a cooling operation, and then the refrigerant is returned to the compressor 21 through the third connection pipe 7. The refrigerant that has released heat in the use-side units 3*a*, 3*b*, and 3*c* each of which performs a heating operation is not pressurized by the ejectors 41*a*, 41*b*, and 41*c*.

(1-3-4-2) Case where Ejector is not caused to Function

In the intermediate unit 4*d*, when the ejector 41*d* is not caused to function, the control unit 50 opens the intermediate first valve V41*d*, closes the intermediate second valve V42*d*, closes the intermediate third valve V43*d*, opens the intermediate fourth valve V44*d*, and closes the intermediate sixth valve V46*d*. The action in this case is similar to that of the intermediate unit 4*d* in the cooling-main operation.

(1-3-5) Heating-Only Operation

Figure 7:
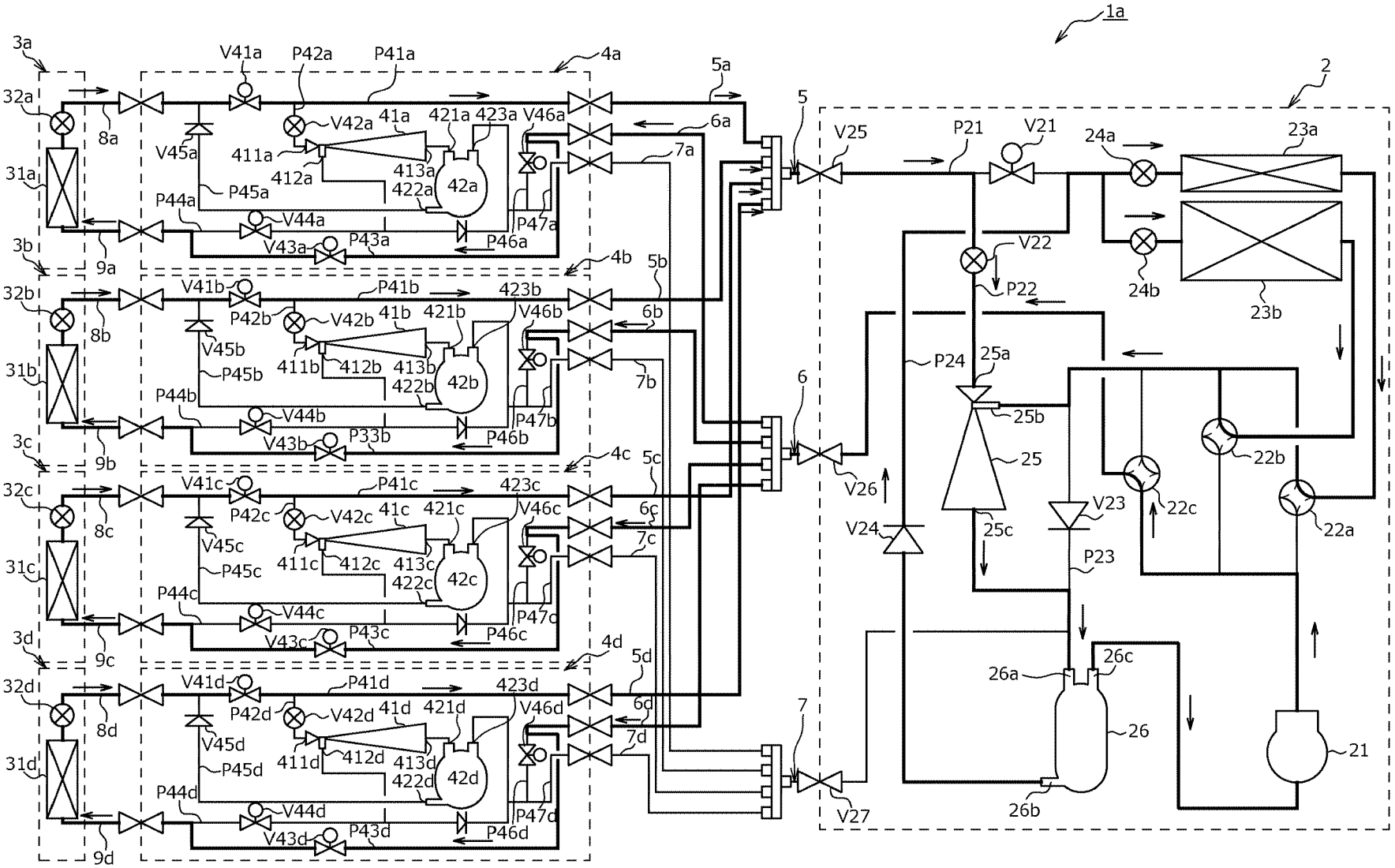
FIG. 7 is a schematic view of the air conditioner according to the first embodiments (illustrating the flow of the refrigerant during a heating-only operation).

As illustrated in FIG. 7, in the heating-only operation, for example, all of the use-side units 3*a*, 3*b*, 3*c*, and 3*d* each perform a heating operation (that is, an operation in which all of the use-side heat exchangers 31*a*, 31*b*, 31*c*, and 31*d* each function as the refrigerant-heat radiator and the heat-source-side heat exchangers 23*a* and 23*b* each function as the refrigerant evaporator).

At this time, in the heat-source-side unit 2, the control unit 50 switches the first switching mechanism 22*a* and the second switching mechanism 22*b* so as to connect the suction side of the compressor 21 to the gas side of the first heat-source-side heat exchanger 23*a* and the second heat-source-side heat exchanger 23*b* (the state shown by the solid lines of the switching mechanisms 22*a* and 22*b* in FIG. 7), in order to cause the first heat-source-side heat exchanger 23*a* and the second heat-source-side heat exchanger 23*b* to each function as the refrigerant evaporator. The control unit 50 switches the third switching mechanism 22*c* so as to connect the discharge side of the compressor 21 to the second connection pipe 6 (the state of the switching mechanism 22*c* shown by a solid line in FIG. 7), in order to send the refrigerant discharged from the compressor 21 to the second connection pipe 6. The control unit 50 opens the first heat-source-side expansion valve 24*a*, opens the second heat-source-side expansion valve 24*b*, closes the heat-source-side first valve V21, and opens the heat-source-side second valve V22.

In the intermediate units 4*a*, 4*b*, 4*c*, and 4*d*, the control unit 50 opens the intermediate first valves V41*a*, V41*b*, V41*c*, and V41*d*, fully closes the intermediate second valves V42*a*, V42*b*, V42*c*, and V42*d*, opens the intermediate third valves V43*a*, V43*b*, V43*c*, and V43*d*, closes the intermediate fourth valves V44*a*, V44*b*, V44*c*, and V44*d*, and closes the intermediate sixth valves V46*a*, V46*b*, V46*c*, and V46*d*.

In the use-side units 3*a*, 3*b*, 3*c*, and 3*d*, the control unit 50 adjusts the opening degree of each of the use-side expansion valves 32*a*, 32*b*, 32*c*, and 33*d* in accordance with the heating load of a corresponding one of the use-side units 3*a*, 3*b*, 3*c*, and 3*d*.

When the control unit 50 thus controls the constituent devices of the heat-source-side unit 2, the use-side units 3*a*, 3*b*, 3*c*, and 3*d*, and the intermediate units 4*a*, 4*b*, 4*c*, and 4*d*, the refrigerant in a supercritical state discharged from the compressor 21 flows out from the heat-source-side unit 2 to the second connection pipe 6 through the third switching mechanism 22*c*.

The refrigerant that has flowed out to the second connection pipe 6 is sent to the intermediate units 4*a*, 4*b*, 4*c*, and 4*d* through the branch pipe portions 6*a*, 6*b*, 6*c*, and 6*d*. The high-pressure refrigerant sent to the intermediate units 4*a*, 4*b*, 4*c*, and 4*d* flows into the intermediate third pipes P43*a*, P43*b*, P43*c*, and P43*d*, passes through the intermediate third valves V43*a*, V43*b*, V43*c*, and V43*d*, and flows out from the intermediate units 4*a*, 4*b*, 4*c*, and 4*d*.

The refrigerant that has flowed out from the intermediate units 4*a*, 4*b*, 4*c*, and 4*d* is sent to the use-side units 3*a*, 3*b*, 3*c*, and 3*d* through the fifth connection pipes 9*a*, 9*b*, 9*c*, and 9*d*. Then, the high-pressure refrigerant sent to the use-side heat exchangers 31*a*, 31*b*, 31*c*, and 31*d* releases heat as a result of being cooled by exchanging heat with indoor air, which is supplied from an indoor space, in the use-side heat exchangers 31*a*, 31*b*, 31*c*, and 31*d* each of which functions as the refrigerant-heat radiator. The refrigerant flows out from the use-side units 3*a*, 3*b*, 3*c*, and 3*d* through the use-side expansion valves 32*a*, 32*b*, 32*c*, and 32*d*. On the other hand, the indoor air heated in the use-side heat exchangers 31*a*, 31*b*, 31*c*, and 31*d* is sent to the indoor space, and thus heating of the indoor space is performed.

The refrigerant that has flowed out from the use-side units 3*a*, 3*b*, 3*c*, and 3*d* is sent to the intermediate units 4*a*, 4*b*, 4*c*, and 4*d* through the fourth connection pipes 8*a*, 8*b*, 8*c*, and 8*d*. The refrigerant sent to the intermediate units 4*a*, 4*b*, 4*c*, and 4*d* flows into the intermediate first pipes P41*a*, P41*b*, P41*c*, and P41*d*, and flows out from the intermediate units 4*a*, 4*b*, 4*c*, and 4*d* by way of the intermediate first valves V41*a*, V41*b*, V41*c*, and V41*d*.

The refrigerant that has flowed out from the intermediate units 4*a*, 4*b*, 4*c*, and 4*d* passes through the branch pipe portions 5*a*, 5*b*, 5*c*, and 5*d*, merges at the merging portion of the first connection pipe 5, and flows into the heat-source-side unit 2. The refrigerant that has flowed into the heat-source-side unit 2 flows into the driving-flow inlet 25*a* of the ejector 25. The refrigerant is mixed with the refrigerant from the suction-flow inlet 25*b*, which has evaporated in the evaporator, and is discharged from the discharge opening 25*c*. The refrigerant in a gas-liquid two-phase state, which has flowed out from the ejector 25, flows into the refrigerant inlet 26*a* of the gas-liquid separator 26. Then, the refrigerant separated by the gas-liquid separator 26 and flowing out from the liquid-side outlet 26*b* branches so as to flow to the first heat-source-side expansion valve 24*a* and the second heat-source-side expansion valve 24*b* by way of the heat-source-side fourth valve V24, and is sent to the first heat-source-side heat exchanger 23*a* and the second heat-source-side heat exchanger 23*b*. The refrigerant sent to the first heat-source-side heat exchanger 23*a* and the second heat-source-side heat exchanger 23*b* evaporates as a result of being heated by exchanging heat with outdoor air in the first heat-source-side heat exchanger 23*a* and the second heat-source-side heat exchanger 23*b* each of which functions as the refrigerant evaporator. The evaporated refrigerant merges by way of the first switching mechanism 22*a* and the second switching mechanism 22*b*, and flows into the suction-flow inlet 25*b* of the ejector 25. The low-pressure refrigerant is pressurized by being mixed in the ejector 25 with the refrigerant that has flowed thereinto from the driving-flow inlet 25*a* described above. The refrigerant in a two phase state that has been pressurized and discharged flows into the refrigerant inlet 26*a* of the gas-liquid separator 26. Then, the refrigerant separated by the gas-liquid separator 26 and flowing out from the gas-side outlet 26*c* is sucked into the compressor 21.

Thus, the ejectors 41*a*, 41*b*, 41*c*, and 41*d* of the intermediate units 4*a*, 4*b*, 4*c*, and 4*d* are not caused to function during the heating-only operation described above. In other words, the refrigerant that has released heat in the use-side units 3*a*, 3*b*, 3*c*, and 3*d* that perform a heating operation is not pressurized by the ejectors 41*a*, 41*b*, 41*c*, and 41*d*.

(1-4) Features

The air conditioner 1*a* according to one or more embodiments includes: the heat-source-side unit 2; the plurality of use-side units 3*a*, 3*b*, 3*c*, and 3*d*; the intermediate units 4*a*, 4*b*, 4*c*, and 4*d*; and the three or more connection pipes 5, 6, and 7. The heat-source-side unit 2 includes the compressor 21 and the heat-source-side heat exchangers 23*a* and 23*b*. The plurality of use-side units 3*a*, 3*b*, 3*c*, and 3*d* include the use-side heat exchangers 31*a*, 31*b*, 31*c*, and 31*d*. The intermediate units 4*a*, 4*b*, 4*c*, and 4*d* perform switching so as to cause the plurality of use-side heat exchangers 31*a*, 31*b*, 31*c*, and 31*d* to individually function as the refrigerant evaporator or the refrigerant-heat radiator. The three or more connection pipes 5, 6, and 7 connect the heat-source-side unit 2 to the intermediate units 4*a*, 4*b*, 4*c*, and 4*d*. The intermediate units 4*a*, 4*b*, 4*c*, and 4*d* include the ejectors 41*a*, 41*b*, 41*c*, and 41*d* and the gas-liquid separators 42*a*, 42*b*, 42*c*, and 42*d*. The ejectors 41*a*, 41*b*, 41*c*, and 41*d* pressurize the refrigerant. The refrigerant that has flowed out from the ejectors 41*a*, 41*b*, 41*c*, and 41*d* flows into the gas-liquid separators 42*a*, 42*b*, 42*c*, and 42*d*. (It is configured such that) the refrigerant that has released heat in any of the use-side units 3*a*, 3*b*, 3*c*, and 3*d* that performs a heating operation is not pressurized by the ejectors 41*a*, 41*b*, 41*c*, and 41*d*.

In the air conditioner 1*a* according to one or more embodiments, the intermediate units 4*a*, 4*b*, 4*c*, and 4*d* include the ejectors 41*a*, 41*b*, 41*c*, and 41*d* for recovering power. The refrigerant that has released heat in any of the use-side units 3*a*, 3*b*, 3*c*, and 3*d* that performs a heating operation is not pressurized by the ejectors 41*a*, 41*b*, 41*c*, and 41*d*. Therefore, it is possible to pressurize, by using the ejectors 41*a*, 41*b*, 41*c*, and 41*d*, the refrigerant that has exchanged heat in the use-side heat exchangers 31*a*, 31*b*, 31*c*, and 31*d* that perform an operation having a relatively large advantage, without causing the ejectors 41*a*, 41*b*, 41*c*, and 41*d* to function for the use-side heat exchangers 31*a*, 31*b*, 31*c*, and 31*d* that perform the heating operation having a relatively small advantage. Accordingly, it is possible to recover power by using the ejectors 41*a*, 41*b*, 41*c*, and 41*d* of the intermediate units 4*a*, 4*b*, 4*c*, and 4*d*.

Here, the air conditioner 1*a* is configured so that the refrigerant that has evaporated in the use-side units 3*a*, 3*b*, 3*c*, and 3*d* that perform a cooling operation flows through the ejectors 41*a*, 41*b*, 41*c*, and 41*d*. Thus, the refrigerant that has evaporated in the use-side heat exchangers 31*a*, 31*b*, 31*c*, and 31*d* that perform the cooling operation having a relatively large advantage can be pressurized by using the ejectors 41*a*, 41*b*, 41*c*, and 41*d*. Therefore, the air conditioner 1*a* that recovers power can be realized.

Here, the intermediate units 4*a*, 4*b*, 4*c*, and 4*d* further include: the intermediate first pipes P41*a*, P41*b*, P41*c*, and P41*d*; the intermediate first valves V41*a*, V41*b*, V41*c*, and V41*d*; the intermediate second pipes P42*a*, P42*b*, P42*c*, and P42*d*; and the intermediate second valves V42*a*, V42*b*, V42*c*, and V42*d*. The intermediate first pipes P41*a*, P41*b*, P41*c*, and P41*d* are pipes for allowing the refrigerant to flow between the heat-source-side heat exchangers 23*a* and 23*b* and the use-side heat exchangers 31*a*, 31*b*, 31*c*, and 31*d*. The intermediate first valves V41*a*, V41*b*, V41*c*, and V41*d* are provided in the intermediate first pipes P41*a*, P41*b*, P41*c*, and P41*d*. The intermediate second pipes P42*a*, P42*b*, P42*c*, and P42*d* are pipes that branch from a part of the intermediate first pipes P41*a*, P41*b*, P41*c*, and P41*d* between the heat-source-side heat exchangers 23*a* and 23*b* and the intermediate first valves V41*a*, V41*b*, V41*c*, and V41*d* and that allow the refrigerant to flow to the driving-flow inlets 411*a*, 411*b*, 411*c*, and 411*d* of the ejectors 41*a*, 41*b*, 41*c*, and 41*d*. The intermediate second valves V42*a*, V42*b*, V42*c*, and V42*d* are provided in the intermediate second pipes P42*a*, P42*b*, P42*c*, and P42*d*. The air conditioner 1*a* further includes the control unit 50 that controls the intermediate first valves V41*a*, V41*b*, V41*c*, and V41*d* and the intermediate second valves V42*a*, V42*b*, V42*c*, and V42*d*.

When the control unit 50 opens the intermediate first valves V41*a*, V41*b*, V41*c*, and V41*d* and closes the intermediate second valves V42*a*, V42*b*, V42*c*, and V42*d*, it is possible to supply the refrigerant that flows in the use-side heat exchangers 31*a*, 31*b*, 31*c*, and 31*d* via the intermediate first pipes P41*a*, P41*b*, P41*c*, and P41*d* to the use-side heat exchangers 31*a*, 31*b*, 31*c*, and 31*d*, without allowing the refrigerant to pass through the ejectors 41*a*, 41*b*, 41*c*, and 41*d*. Moreover, when the control unit 50 closes the intermediate first valves V41*a*, V41*b*, V41*c*, and V41*d* and opens the intermediate second valves V42*a*, V42*b*, V42*c*, and V42*d*, it is possible to supply the refrigerant that flows in the use-side heat exchangers 31*a*, 31*b*, 31*c*, and 31*d* via the intermediate second pipes P42*a*, P42*b*, P42*c*, and P42*d*, the ejectors 41*a*, 41*b*, 41*c*, and 41*d*, and the gas-liquid separators 42*a*, 42*b*, 42*c*, and 42*d* to the heat-source-side heat exchangers 23*a* and 23*b* in a state in which the refrigerant is pressurized by the ejectors 41*a*, 41*b*, 41*c*, and 41*d*. Thus, it is possible to select whether or not to allow the driving flow to flow through the ejectors 41*a*, 41*b*, 41*c*, and 41*d* by using the intermediate first valves V41*a*, V41*b*, V41*c*, and V41*d* and the intermediate second valves V42*a*, V42*b*, V42*c*, and V42*d*. Therefore, it is possible to select whether to cause the ejectors 41*a*, 41*b*, 41*c*, and 41*d* to function or not to cause the ejectors 41*a*, 41*b*, 41*c*, and 41*d* to function.

Here, the intermediate units 4*a*, 4*b*, 4*c*, and 4*d* include the plurality of ejectors 41*a*, 41*b*, 41*c*, and 41*d*. Each of the ejectors 41*a*, 41*b*, 41*c*, and 41*d* is connected to a corresponding one of the use-side units 3*a*, 3*b*, 3*c*, and 3*d*. Thus, the air conditioner 1*a* according to one or more embodiments can also be applied to the refrigerant circuit in which each of the ejectors 41*a*, 41*b*, 41*c*, and 41*d* can pressurize the refrigerant for a corresponding one of the use-side units 3*a*, 3*b*, 3*c*, and 3*d*.

Here, the compressor 21 discharges the refrigerant in a supercritical state. Thus, because the refrigerant in a supercritical state flows through a part of the intermediate units 4*a*, 4*b*, 4*c*, and 4*d*, the refrigerant in a supercritical state can be used as the driving flow. Therefore, it is possible to increase the advantageous effect of using the ejectors 41*a*, 41*b*, 41*c*, and 41*d*.

Here, the refrigerant that is compressed by the compressor 21 contains carbon dioxide. The refrigerant including carbon dioxide can be caused to enter a supercritical state. Therefore, it is possible to easily realize the air conditioner 1*a* in which the advantageous effect of using the ejector 41*a*, 41*b*, 41*c*, and 41*d* is increased.

(2) Second Embodiments

(2-1) Overall Configuration

Figure 8:
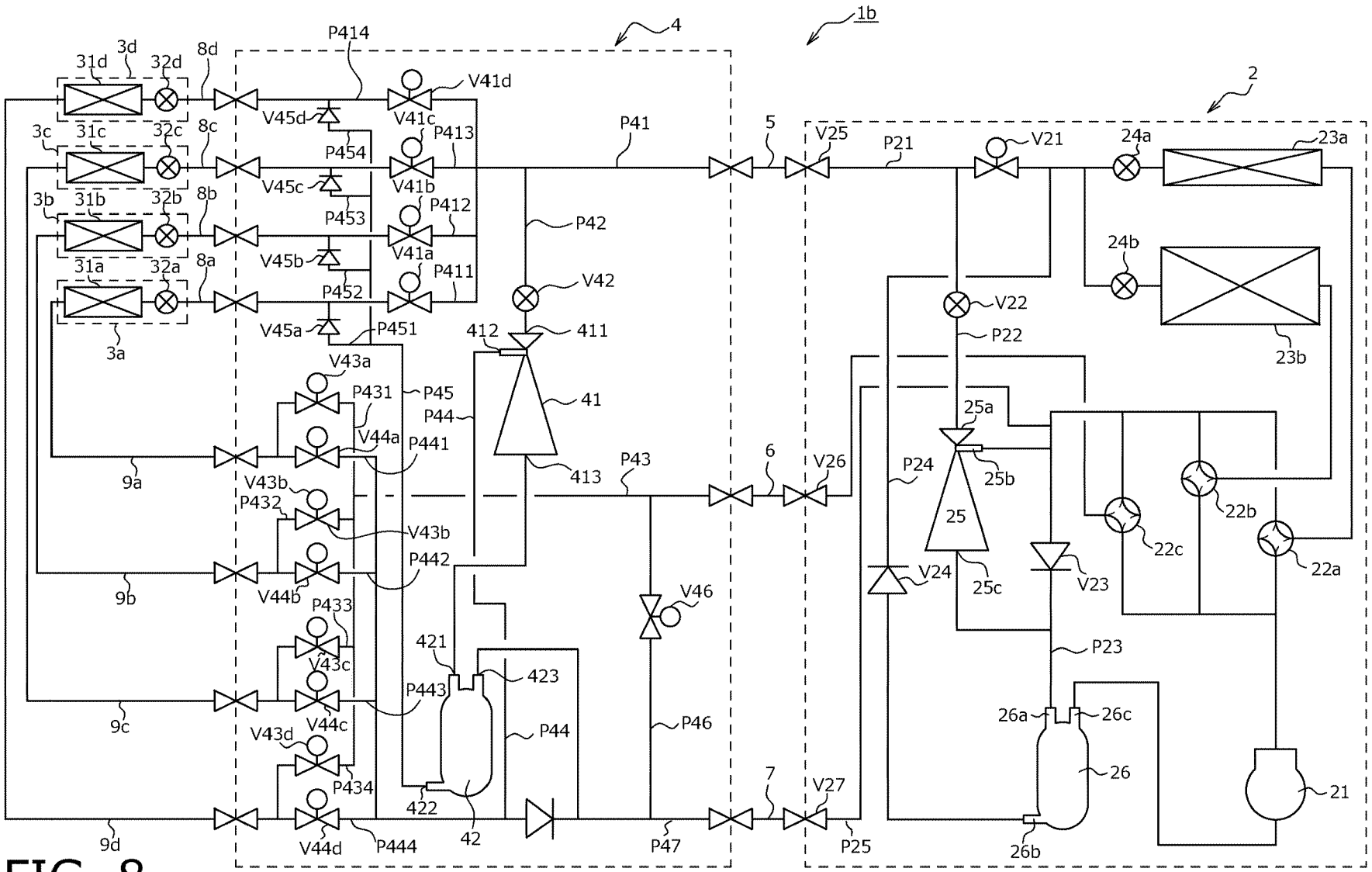
FIG. 8 is a schematic view of an air conditioner according to second embodiments.

As illustrated in FIG. 8, an air conditioner 1*b* according to second embodiments basically has a configuration similar to that of the air conditioner 1*a* according to the first embodiments, but differs mainly in that an ejector 41 is connected to a plurality of use-side units 3*a*, 3*b*, 3*c*, and 3*d*. The air conditioner 1*b* according to one or more embodiments includes a heat-source-side unit 2, one intermediate unit 4, four use-side units 3*a*, 3*b*, 3*c*, and 3*d*, and a control unit 50.

(2-2) Detailed Configuration

(2-2-1) Connection Pipe

A first connection pipe 5, a second connection pipe 6, and a third connection pipe 7 according to one or more embodiments differ from those of the first embodiments only in that they do not have a branch pipe portion.

(2-2-2) Heat-Source-Side Unit

The heat-source-side unit 2 according to one or more embodiments differs from that of the first embodiments in a heat-source-side fifth pipe P25 that is connected to the third connection pipe 7. To be specific, the heat-source-side fourth pipe P25 that is connected to the third connection pipe 7 according to the first embodiments illustrated in FIG. 1 is connected between the heat-source-side second valve V23 and the refrigerant inlet 26*a* of the gas-liquid separator 26. The heat-source-side second pipe P25 according to one or more embodiments illustrated in FIG. 8 is connected between the third connection pipe 7 and the heat-source-side fourth valve V23.

(2-2-3) Use-Side Unit

The use-side units 3*a*, 3*b*, 3*c*, and 3*d* according to one or more embodiments are similar to those of the first embodiments.

(2-2-4) Intermediate Unit

The intermediate unit 4 includes one ejector 41 and one gas-liquid separator 42.

The one ejector 41 performs switching so as to cause the plurality of use-side heat exchangers 31*a*, 31*b*, 31*c*, and 31*d* to individually function as the refrigerant evaporator or the refrigerant-heat radiator. The ejector 41 is connected to the plurality of use-side units 3*a*, 3*b*, 3*c*, and 3*d*. Therefore, one ejector 41 can pressurize the refrigerant for each of the use-side units 3*a*, 3*b*, 3*c*, and 3*d*. The refrigerant that has flowed out from the ejector 41 flows into the gas-liquid separator 42.

The ejector 41 according to one or more embodiments has a configuration similar to that of the ejectors 41*a*, 41*b*, 41*c*, and 41*d* according to the first embodiments. To be specific, the ejector 41 includes a driving-flow inlet 411, a suction-flow inlet 412, and a discharge opening 413.

The gas-liquid separator 42 according to one or more embodiments has a configuration similar to that of the gas-liquid separators 42*a*, 42*b*, 42*c*, and 42*d* according to the first embodiments. To be specific, the gas-liquid separator 42 includes the refrigerant inlet 421, a liquid-side outlet 422, and a gas-side outlet 423.

The intermediate unit 4 further includes an intermediate first pipe P41, an intermediate second pipe P42, an intermediate third pipe P43, an intermediate fourth pipe P44, an intermediate fifth pipe P45, an intermediate sixth pipe P46, an intermediate seventh pipe P47, intermediate first valves V41*a*, V41*b*, V41*c*, and V41*d*, an intermediate second valve V42, an intermediate third valve V43*a*, an intermediate fourth valve V44*a*, an intermediate fifth valve V45*a*, and an intermediate sixth valve V46*a*.

The intermediate first pipe P41 allows the refrigerant to flow between the heat-source-side heat exchangers 23*a* and 23*b* and the first use-side heat exchangers 31*a*, 31*b*, and 31*c*, 31*d*. Here, the intermediate first pipe P41 connects the first connection pipe 5 to the fourth connection pipes 8*a*, 8*b*, 8*c*, and 8*d*. For that purpose, the intermediate first pipe P41 includes first branch pipes P411, P412, P413, and P414 that are four pipes that branch from the first connection pipe 5 and that are connected to the fourth connection pipes 8*a*, 8*b*, 8*c*, and 8*d*.

Intermediate first valves V41*a*, V41*b*, V41*c*, and V41*d* are provided in the first branch pipes P411, P412, P413, and P414. Here, the intermediate first valves V41*a*, V41*b*, V41*c*, and V41*d* are each an on-off valve.

The intermediate second pipe P42 branches from a part of the intermediate first pipe P41 between the heat-source-side heat exchangers 23*a* and 23*b* and the intermediate first valves V41*a*, V41*b*, V41*c*, and V41*d*, and allows the refrigerant to flow to the driving-flow inlet 411 of the ejector 41. Here, the intermediate second pipe P42 branches from a part of the intermediate first pipe P41 between the first connection pipe 5 and the intermediate first branch pipes P411, P412, P413, and P414.

An intermediate second valve V42 is provided in the intermediate second pipe P42. Here, the intermediate second valve V42 is an on-off valve.

The intermediate third pipe P43 connects the fifth connection pipes 9*a*, 9*b*, 9*c*, and 9*d* to the second connection pipe 6. For that purpose, the intermediate third pipe P43 includes third branch pipes P431, P432, P433, and P434 that are four pipes that branch from the second connection pipe 6 and that are connected to the fifth connection pipes 9*a*, 9*b*, 9*c*, and 9*d*.

Intermediate third valves V43*a*, V43*b*, V43*c*, and V43*d* are provided in the third branch pipes P431, P432, P433, and P434. Here, the intermediate third valves V43*a*, V43*b*, V43*c*, and V43*d* are each an on-off valve.

The intermediate fourth pipe P44 connects the fifth connection pipes 9*a*, 9*b*, 9*c*, and 9*d* to the suction-flow inlet 412 of the ejector 41. For that purpose, the intermediate fourth pipe P44 includes four fourth branch pipes P441, P442, P443, and P444 that are connected to the fifth connection pipes 9*a*, 9*b*, 9*c*, and 9*d*. The four fourth branch pipes P441, P442, P443, and P444 merge at a position ahead of the suction-flow inlet 412.

Intermediate fourth valves V44*a*, V44*b*, V44*c*, and V44*d* are provided in the fourth branch pipes P441, P442, P443, and P444. Here, the intermediate fourth valves V44*a*, V44*b*, V44*c*, and V44*d* are each an on-off valve.

The intermediate fifth pipe P45 connects the liquid-side outlet 422 of the gas-liquid separator 42 to the fourth connection pipes 8*a*, 8*b*, 8*c*, and 8*d*. For that purpose, the intermediate fifth pipe P45 includes four fifth branch pipes P451, P452, P453, and P454 that are connected to the fourth connection pipes 8*a*, 8*b*, 8*c*, and 8*d*.

Intermediate fifth valves V45*a*, V45*b*, V45*c*, and V45*d* are provided in the fifth branch pipes P451, P452, P453, and P454. The intermediate fifth valves V45*a*, V45*b*, V45*c*, and V45*d* are each a check valve that allows the refrigerant to flow only in the direction from the liquid-side outlet 422*a* to the fourth connection pipes 8*a*, 8*b*, 8*c*, and 8*d*.

The intermediate sixth pipe P46 connects the gas-side outlet 423 of the gas-liquid separator 42 to the second connection pipe 6. An intermediate sixth valve V46 is provided in the intermediate sixth pipe P46. The intermediate sixth valve V46 is an electric valve.

The intermediate seventh pipe P47 connects the gas-side outlet 423 of the gas-liquid separator 42 to the third connection pipe 7.

Shutoff valves are provided at connection portions between the intermediate unit 4 and connection pipes. The shutoff valves are valves that are manually opened and closed. Here, three shutoff valves are provided at connection portions between the intermediate unit 4 and the first, second, and third connection pipes 5, 6, and 7. To be specific, the three shutoff valves are provided at a connection portion between the intermediate unit 4 and the first connection pipe 5, a connection portion between the intermediate unit 4 and the second connection pipe 6, and a connection portion between the intermediate unit 4 and the third connection pipe 7. Here, eight shutoff valves are provided at connection portions between the intermediate unit 4 and the fourth and fifth connection pipes 8*a*, 8*b*, 8*c*, 8*d*, 9*a*, 9*b*, 9*c*, and 9*d*. To be specific, the eight shutoff valve is provided connection portions between the intermediate unit 4 and the fourth connection pipes 8*a*, 8*b*, 8*c*, and 8*d* and connection portions between the intermediate unit 4 and the fifth connection pipes 9*a*, 9*b*, 9*c*, and 9*d*.

(2-2-5) Control Unit

As in the first embodiments, the control unit 50 controls the constituent devices of the heat-source-side unit 2, the use-side units 3*a*, 3*b*, 3*c*, and 3*d*, and the intermediate unit 4. To be specific, the control unit 50 controls the following: the compressor 21 and the switching mechanisms 22*a*, 22*b*, and 22*c* of the heat-source-side unit 2; the use-side expansion valves 32*a*, 32*b*, 32*c*, and 32*d* of the use-side units 3*a*, 3*b*, 3*c*, and 3*d*; and the intermediate first valves V41*a*, V41*b*, V41*c*, and V41*d*, the intermediate second valve V42, the intermediate third valves V43*a*, V43*b*, V43*c*, and V43*d*, the intermediate fourth valves V44*a*, V44*b*, V44*c*, and V44*d*, and the intermediate sixth valve V46 of the intermediate unit 4.

To be specific, the control unit 50 controls whether or not to cause the ejector 41 to function by controlling the intermediate first valves V41*a*, V41*b*, V41*c*, and V41*d* to be fully opened or fully closed. Here, the control unit 50 controls to what degree the ejector 41 pressurizes the refrigerant that has released heat in the use-side units 3*a*, 3*b*, 3*c*, and 3*d* by adjusting the opening degree of the intermediate second valve V42.

The control unit 50 performs control so as not to cause the ejector 41 to function when the power recovery amount is smaller than a predetermined amount and so as to cause the ejector 41 to function when the power recovery amount is larger than the predetermined amount.

(2-3) Operational Action

Figure 9:
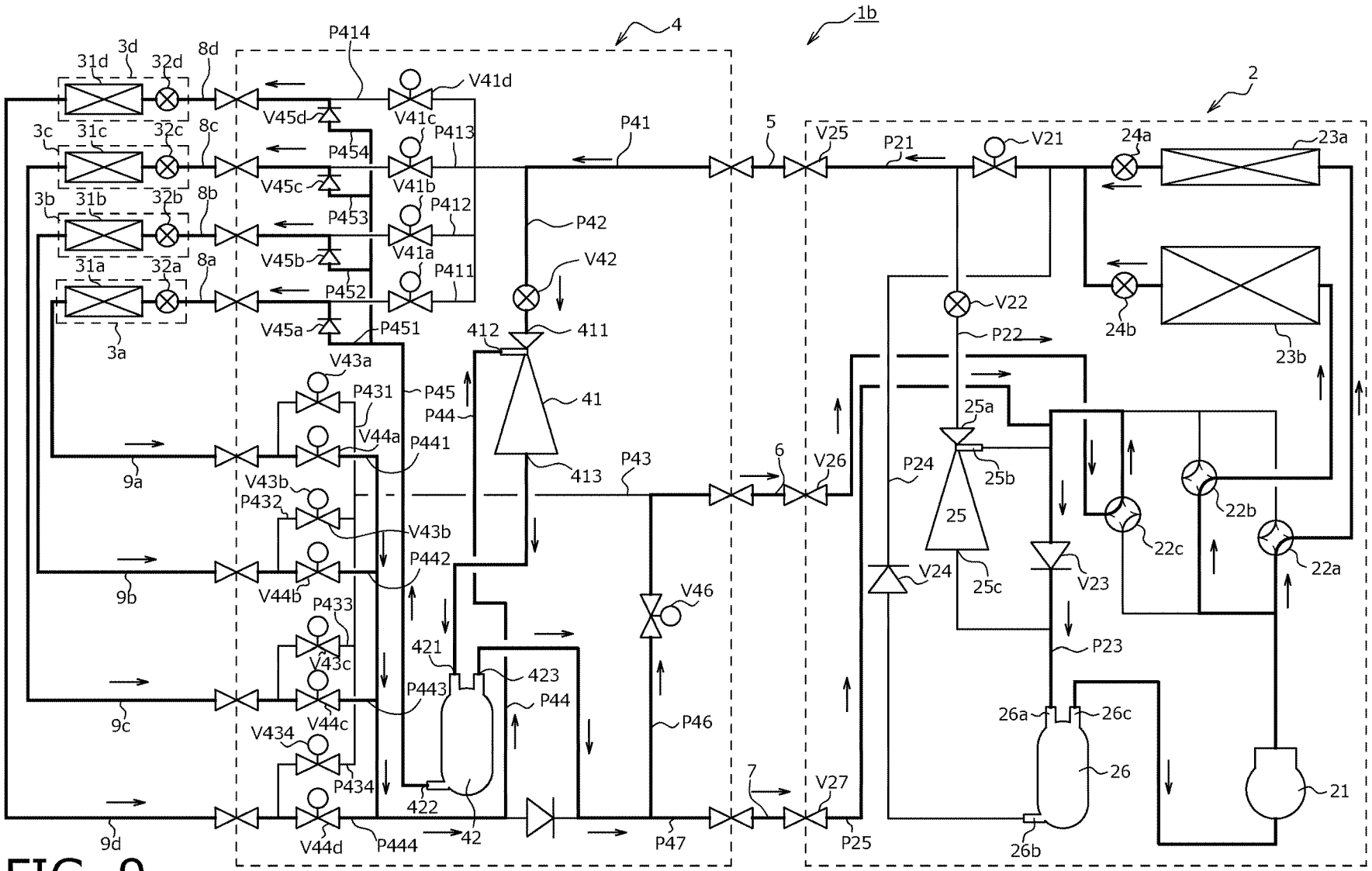
FIG. 9 is a schematic view of the air conditioner according to the second embodiments (illustrating the flow of the refrigerant during a cooling-only operation).

As in the first embodiments, the operations of the air conditioner 1*b* according to one or more embodiments include a cooling-only operation, a cooling-main operation, a cooling-heating-balanced operation, a heating-main operation, and a heating-only operation. Hereafter, referring to FIGS. 9 to and 13, actions in the five operations of the air conditioner 1*b* will be described. In FIGS. 9 to and 13, thick-line pipes represent pipes through which the refrigerant flows, and thin-line pipes represent pipes through which the refrigerant does not flow. Valves provided in the thick-line pipes are opened, and valves provided in the thin-line pipes are closed.

Here, the ejector 41 of the intermediate unit 4 is configured to be capable of functioning or not functioning in the cooling-only operation, the cooling-main operation, the cooling-heating-balanced operation, and the heating-main operation. On the other hand, the ejector is configured to not function in the heating-only operation.

(2-3-1) Cooling-Only Operation (2-3-1-1) Case where Ejector is Caused to Function As illustrated in FIG. 9, in the cooling-only operation, for example, all of the use-side units 3*a*, 3*b*, 3*c*, and 3*d* each perform a cooling operation.

At this time, in the heat-source-side unit 2, the control unit 50 switches the switching mechanisms 22*a* and 22*b* so as to connect the discharge side of the compressor 21 to the gas side of the first heat-source-side heat exchanger 23*a* and the second heat-source-side heat exchanger 23*b* (the state of the switching mechanisms 22*a* and 22*b* shown by a solid line in FIG. 9), in order to cause the first heat-source-side heat exchanger 23*a* and the second heat-source-side heat exchanger 23*b* to each function as the refrigerant-heat radiator. The control unit 50 switches the switching mechanism 22*c* so as to connect the suction side of the compressor 21 to the second connection pipe 6 (the state of the switching mechanism 22*c* shown by a solid line in FIG. 3), in order to send the refrigerant that flows in the second connection pipe 6 to the suction side of the compressor 21. The control unit 50 opens (here, fully opens) the first heat-source-side expansion valve 24*a* and the second heat-source-side expansion valve 24*b*, opens the heat-source-side first valve V21, and fully closes the heat-source-side second valve V22.

In the intermediate unit 4, in order to cause the ejector 41 to function, the control unit 50 closes the intermediate first valves V41*a*, V41*b*, V41*c*, and V41*d*, opens the intermediate second valve V42, closes the intermediate third valves V43*a*, V43*b*, V43*c*, and V43*d*, opens the intermediate fourth valves V44*a*, V44*b*, V44*c*, and V44*d*, and opens the intermediate sixth valve V46.

In the use-side units 3*a*, 3*b*, 3*c*, and 3*d*, the control unit 50 adjusts the opening degree of each of the use-side expansion valves 32*a*, 32*b*, 32*c*, and 33*d* in accordance with the cooling load of a corresponding one of the use-side units 3*a*, 3*b*, 3*c*, and 3*d*.

When the control unit 50 thus controls the constituent devices of the heat-source-side unit 2, the use-side units 3*a*, 3*b*, 3*c*, and 3*d*, and the intermediate unit 4, the refrigerant in a supercritical state discharged from the compressor 21 is sent to the first heat-source-side heat exchanger 23*a* and the second heat-source-side heat exchanger 23*b* by way of the switching mechanisms 22*a* and 22*b*. The refrigerants sent to the first heat-source-side heat exchanger 23*a* and the second heat-source-side heat exchanger 23*b* release heat as a result of being cooled by exchanging heat with outdoor air in the first heat-source-side heat exchanger 23*a* and the second heat-source-side heat exchanger 23*b* each of which functions as the refrigerant-heat radiator. The refrigerants merge after passing through the first heat-source-side expansion valve 24*a* and the second heat-source-side expansion valve 24*b*, and flow out from the heat-source-side unit 2 further by way of the heat-source-side first valve V21.

The refrigerant that has flowed out from the heat-source-side unit 2 is sent to the intermediate unit 4 through the first connection pipe 5. The refrigerant sent to the intermediate unit 4 flows into the driving-flow inlet 411 of the ejector 41. This refrigerant is mixed with the refrigerant from the suction-flow inlet 412, which has evaporated in the evaporator (refrigerant that has evaporated in the use-side heat exchangers 31*a*, 31*b*, 31*c*, and 31*d* each of which functions as the refrigerant evaporator), and is discharged from the discharge opening 413. The refrigerant in a gas-liquid two-phase state, which has flowed out from the ejector 41, flows into the refrigerant inlet 421 of the gas-liquid separator 42. Then, the refrigerant separated by the gas-liquid separator 42 and flowing out from the liquid-side outlet 422 flows out from the intermediate unit 4 by way of the intermediate fifth valves V45*a*, V45*b*, V45*c*, and V45*d*.

The refrigerant that has flowed out from the intermediate unit 4 is sent to the use-side units 3*a*, 3*b*, 3*c*, and 3*d* through the fourth connection pipes 8*a*, 8*b*, 8*c*, and 8*d*. The refrigerant sent to the use-side units 3*a*, 3*b*, 3*c*, and 3*d* is sent to the use-side heat exchangers 31*a*, 31*b*, 31*c*, and 31*d* by way of the use-side expansion valves 32*a*, 32*b*, 32*c*, and 32*d*. The refrigerant sent to the use-side heat exchangers 31*a*, 31*b*, 31*c*, and 31*d* evaporates as a result of being heated by exchanging heat with indoor air, which is supplied from an indoor space, in the use-side heat exchangers 31*a*, 31*b*, 31*c*, and 31*d* each of which functions as the refrigerant evaporator. The refrigerant flows out from the use-side units 3*a*, 3*b*, 3*c*, and 3*d*. On the other hand, indoor air cooled in the use-side heat exchangers 31*a*, 31*b*, 31*c*, and 31*d* is sent to the indoor space, and thus cooling of the indoor space is performed.

The refrigerant that has flowed out from the use-side units 3*a*, 3*b*, 3*c*, and 3*d* is sent to the intermediate unit 4 through the fifth connection pipes 9*a*, 9*b*, 9*c*, and 9*d*. The refrigerant sent to the intermediate unit 4 flows into the suction-flow inlet 412 of the ejector 41 by way of the intermediate fourth valves V44*a*, V44*b*, V44*c*, and V44*d*. The low-pressure refrigerant that has flowed into the ejector 41 is pressurized by being mixed in the ejector 41 with the refrigerant that has flowed thereinto from the driving-flow inlet 411 described above. The refrigerant in a two phase state that has been pressurized and discharged from the discharge opening 413 flows into the refrigerant inlet 421 of the gas-liquid separator 42. Then, the refrigerant separated by the gas-liquid separator 42 and flowing out from the gas-side outlet 423 is branched into the sixth intermediate pipe P46 and the seventh intermediate pipe P47, and flows out from the intermediate unit 4.

The refrigerant that has flowed out from the intermediate sixth pipe P46 of the intermediate unit 4 is sent to the heat-source-side unit 2 through the second connection pipe 6. The refrigerant that has flowed out from the intermediate seventh pipe P47 of the intermediate unit 4 is sent to the heat-source-side unit 2 through the third connection pipe 7.

The refrigerant sent from the second connection pipe 6 to the heat-source-side unit 2 flows into the refrigerant inlet 26*a* of the gas-liquid separator 26 by way of the switching mechanism 22*c* and the heat-source-side third valve V23. The refrigerant sent from the third connection pipe 7 to the heat-source-side unit 2 also flows into the refrigerant inlet 26*a* of the gas-liquid separator 26 by way of the heat-source-side third valve V23. Then, the refrigerant separated by the gas-liquid separator 26 and flowing out from the gas-side outlet 26*c* is sucked into the compressor 21.

Thus, during the cooling-only operation described above, the ejector 41 of the intermediate unit 4 are caused to function to pressurize the refrigerant that has evaporated in the use-side units 3*a*, 3*b*, 3*c*, and 3*d* that each perform a cooling operation, and then the refrigerant is returned to the compressor 21 through the second connection pipe 6 and the third connection pipe 7.

(2-3-1-2) Case where Ejector is not Caused to Function

In the intermediate unit 4, when the ejector 41 is not caused to function, the control unit 50 opens the intermediate first valves V41*a*, V41*b*, V41*c*, and V41*d*, closes the intermediate second valve V42, opens the intermediate third valves V43*a*, V43*b*, V43*c*, and V43*d*, opens the intermediate fourth valves V44*a*, V44*b*, V44*c*, and V44*d*, and opens the intermediate sixth valve V46.

In this case, the refrigerant sent from the heat-source-side unit 2 to the intermediate unit 4 flows out to the use-side units 3*a*, 3*b*, 3*c*, and 3*d* through the intermediate first pipe P41 and the fourth connection pipes 8*a*, 8*b*, 8*c*, and 8*d*, without passing through the ejector 41.

The refrigerant sent from the use-side units 3*a*, 3*b*, 3*c*, and 3*d* to the intermediate units 4*a*, 4*b*, 4*c*, and 4*d* through the fifth connection pipes 9*a*, 9*b*, 9*c*, and 9*d* flows out to the heat-source-side unit 2 through the intermediate third pipe P43 and the second connection pipe 6, without passing through the ejector 41.

Figure 10:
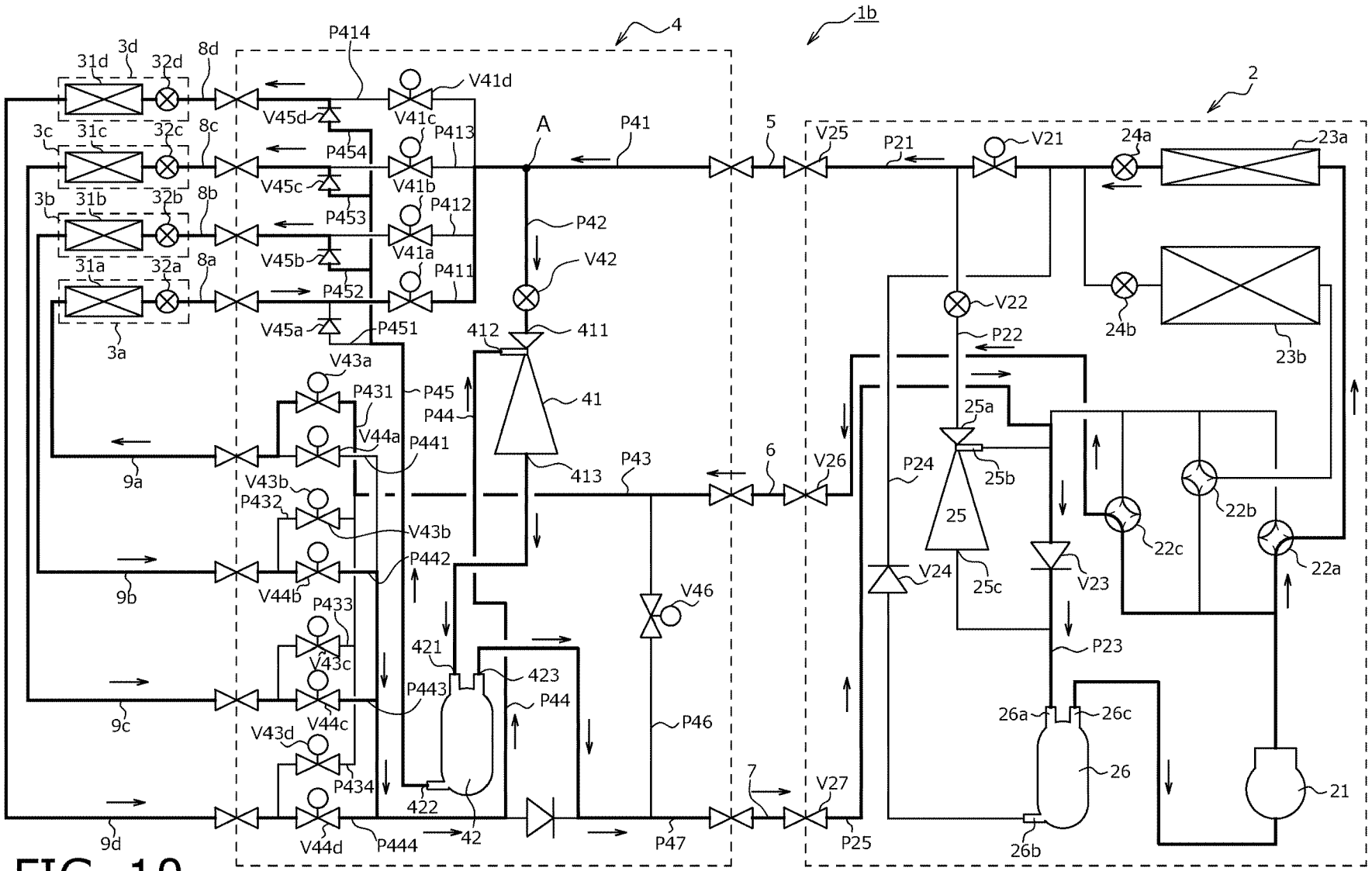
FIG. 10 is a schematic view of the air conditioner according to the second embodiments (illustrating the flow of the refrigerant during a cooling-main operation).

(2-3-2) Cooling-Main Operation (2-3-2-1) Case where Ejector is Caused to Function As illustrated in FIG. 10, in the cooling-main operation, for example, the use-side units 3*b*, 3*c*, and 3*d* each perform a cooling operation and the use-side unit 3*a* performs a heating operation.

At this time, in the heat-source-side unit 2, the control unit 50 switches the switching mechanism 22*a* so as to connect the discharge side of the compressor 21 to the gas side of the first heat-source-side heat exchanger 23*a* (the state of the switching mechanism 22*a* shown by a solid line in FIG. 10), in order to cause the first heat-source-side heat exchanger 23*a* to function as the refrigerant-heat radiator. The control unit 50 switches the switching mechanism 22*c* so as to connect the discharge side of the compressor 21 to the second connection pipe 6 (the state of the switching mechanism 22*c* shown by a solid line in FIG. 10), in order to send the refrigerant discharged from the compressor 21 to the second connection pipe 6. Here, because the refrigerant does not flow through the switching mechanism 22*b*, the switching mechanism 22*b* is not controlled by the control unit 50. The control unit 50 fully opens the first heat-source-side expansion valve 24*a*, fully closes the second heat-source-side expansion valve 24*b*, opens the heat-source-side first valve V21, and fully closes the heat-source-side second valve V22.

In the intermediate unit 4, the control unit 50 opens the intermediate first valve V41*a*, closes the intermediate first valves V41*b*, V41*c*, and V41*d*, opens the intermediate second valve V42, opens the intermediate third valve V43*a*, closes the intermediate third valves V43*b*, V43*c*, and V43*d*, closes the intermediate fourth valve V44*a*, opens the intermediate fourth valves V44*b*, V44*c*, and V44*d*, and closes the intermediate sixth valve V46*a*.

In the use-side units 3*a*, 3*b*, 3*c*, and 3*d*, the control unit 50 adjusts the opening degree of each of the use-side expansion valves 32*a*, 32*b*, 32*c*, and 33*d* in accordance with the heating load of the use-side unit 3*a* and the cooling load of each of the use-side units 3*b*, 3*c*, and 3*d*.

When the control unit 50 thus controls the constituent devices of the heat-source-side unit 2, the use-side units 3*a*, 3*b*, 3*c*, and 3*d*, and the intermediate unit 4, a part of the refrigerant in a supercritical state discharged from the compressor 21 is sent to the first heat-source-side heat exchanger 23*a* via the first switching mechanism 22*a*, and the remaining part of the refrigerant flows out from the heat-source-side unit 2 to the second connection pipe 6 via the third switching mechanism 22*c*. The refrigerant sent to the first heat-source-side heat exchanger 23*a* releases heat as a result of being cooled by exchanging heat with outdoor air in the first heat-source-side heat exchanger 23*a* that functions as the refrigerant-heat radiator. The refrigerant flows out from the heat-source-side unit 2 to the first connection pipe 5 by way of the first heat-source-side expansion valve 24*a* and the heat-source-side first valve V21. The refrigerant that has flowed out to the first connection pipe 5 is sent to the intermediate first pipe P41 of the intermediate unit 4.

The refrigerant that has flowed out to the second connection pipe 6 is sent to the intermediate third pipe P43 of the intermediate unit 4. The high-pressure refrigerant flows out from the intermediate unit 4 by way of the intermediate third valve V43*a*.

The refrigerant that has flowed out from the intermediate unit 4 is sent to the use-side unit 3*a* through the fifth connection pipe 9*a*. The refrigerant sent to the use-side unit 3*a* is sent to the use-side heat exchanger 31*a*. The high-pressure refrigerant sent to the use-side heat exchanger 31*a* releases heat as a result of being cooled by exchanging heat with indoor air, which is supplied from an indoor space, in the use-side heat exchanger 31*a* that functions as the refrigerant-heat radiator. The refrigerant flows out from the use-side unit 3*a* through the use-side expansion valve 32*a* that is fully opened. On the other hand, the indoor air heated in the use-side heat exchanger 31*a* is sent to the indoor space, and thus heating of the indoor space is performed.

The refrigerant that has flowed out from the use-side unit 3*a* is sent to the intermediate unit 4 through the fourth connection pipe 8*a*. The refrigerant sent to the intermediate unit 4 flows into the first branch pipe P411, and, at a point A, merges with the refrigerant that has flowed out from the first heat-source-side heat exchanger 23*a* to the first connection pipe 5 and flowed into the first branch pipe P411. The merged refrigerant flows into the driving-flow inlet 411 of the ejector 41 through the intermediate second pipe P42. Then, the refrigerant is mixed with the refrigerant from the suction-flow inlet 412, which has evaporated in the evaporator (refrigerant that has evaporated in the use-side heat exchangers 31*b*, 31*c*, and 31*d* each of which functions as the refrigerant evaporator), and is discharged from the discharge opening 413. The refrigerant in a gas-liquid two-phase state, which has flowed out from the ejector 41, flows into the refrigerant inlet 421 of the gas-liquid separator 42. Then, the refrigerant separated by the gas-liquid separator 42 and flowing out from the liquid-side outlet 422 branches into the fifth branch pipes P452, P453, and P454, and flows out from the intermediate unit 4 by way of the intermediate fifth valves V45*b*, V45*c*, and V45*d*.

The refrigerant that has flowed out from the intermediate unit 4 is sent to the use-side units 3*b*, 3*c*, and 3*d* through the fourth connection pipes 8*b*, 8*c*, and 8*d*. The refrigerant sent to the use-side units 3*b*, 3*c*, and 3*d* is sent to the use-side heat exchangers 31*b*, 31*c*, and 31*d* by way of the use-side expansion valves 32*b*, 32*c*, and 32*d*. The refrigerant sent to the use-side heat exchangers 31*b*, 31*c*, and 31*d* evaporates as a result of being heated by exchanging heat with indoor air, which is supplied from an indoor space, in the use-side heat exchangers 31*b*, 31*c*, and 31*d* each of which functions as the refrigerant evaporator. The refrigerant flows out from the use-side units 3*b*, 3*c*, and 3*d*. On the other hand, indoor air cooled in the use-side heat exchangers 31*b*, 31*c*, and 31*d* is sent to the indoor space, and thus cooling of the indoor space is performed.

The refrigerant that has flowed out from the use-side units 3*b*, 3*c*, and 3*d* is sent to the intermediate unit 4 through the fifth connection pipes 9*b*, 9*c*, and 9*d*. The refrigerant sent to the intermediate unit 4 merges in the intermediate fourth pipe P44 by way of the intermediate fourth valves V44*b*, V44*c*, and V44*d*, and flows into the suction-flow inlet 412 of the ejector 41. The low-pressure refrigerant that has flowed into the ejector 41 is pressurized by being mixed in the ejector 41 with the refrigerant that has flowed thereinto from the driving-flow inlet 411 described above. The refrigerant in a two phase state that has been pressurized and discharged flows into the refrigerant inlet 421 of the gas-liquid separator 42. Then, the refrigerant separated by the gas-liquid separator 42 and flowing out from the gas-side outlet 423 flows out from the intermediate unit 4 through the intermediate seventh pipe P47.

The refrigerant that has flowed out from the intermediate unit 4 is sent to the heat-source-side unit 2 through the third connection pipe 7.

The refrigerant sent to the heat-source-side unit 2 flows into the refrigerant inlet 26*a* of the gas-liquid separator 26 by way of the heat-source-side third valve V23. Then, the refrigerant separated by the gas-liquid separator 26 and flowing out from the gas-side outlet 26*c* is sucked into the compressor 21.

Thus, during the cooling-main operation described above, the ejector 41 of the intermediate unit 4 is caused to function to pressurize the refrigerant that has evaporated in the use-side units 3*b*, 3*c*, and 3*d* each of which performs a cooling operation, and then the refrigerant is returned to the compressor 21 through the third connection pipe 7. The refrigerant that has released heat in the use-side unit 3*a* that performs a heating operation is not pressurized by the ejector 41*a*.

(2-3-2-2) Case where Ejector is not Caused to Function

In the intermediate unit 4, when the ejector 41 is not caused to function, the control unit 50 opens the intermediate first valves V41*b*, V41*c*, and V41*d*, closes the intermediate second valve V42, closes the intermediate third valves V43*b*, V43*c*, and V43*d*, opens the intermediate fourth valves V44*b*, V44*c*, and V44*d*, and closes the intermediate sixth valve V46.

In this case, the refrigerant sent from the heat-source-side unit 2 to the intermediate unit 4 through the first connection pipe 5 flows out from the intermediate unit 4 through the intermediate first pipe P41 and the first branch pipes P412, P413, and P414, without passing through the ejector 41. The refrigerant flows out to the use-side units 3*b*, 3*c*, and 3*d* through the fourth connection pipes 8*b*, 8*c*, and 8*d*. The refrigerant that has exchanged heat in the use-side heat exchangers 31*a*, 31*b*, 31*c*, and 31*d* and has been sent from the use-side units 3*b*, 3*c*, and 3*d* to the intermediate units 4*b*, 4*c*, and 4*d* passes through the check valve by way of the intermediate fourth valves V44*b*, V44*c*, and V44*d*, and flows out from the intermediate unit 4.

The refrigerant that has flowed out from the intermediate units 4*b*, 4*c*, and 4*d* flows into the heat-source-side unit 2 through the third connection pipe 7.

Figure 11:
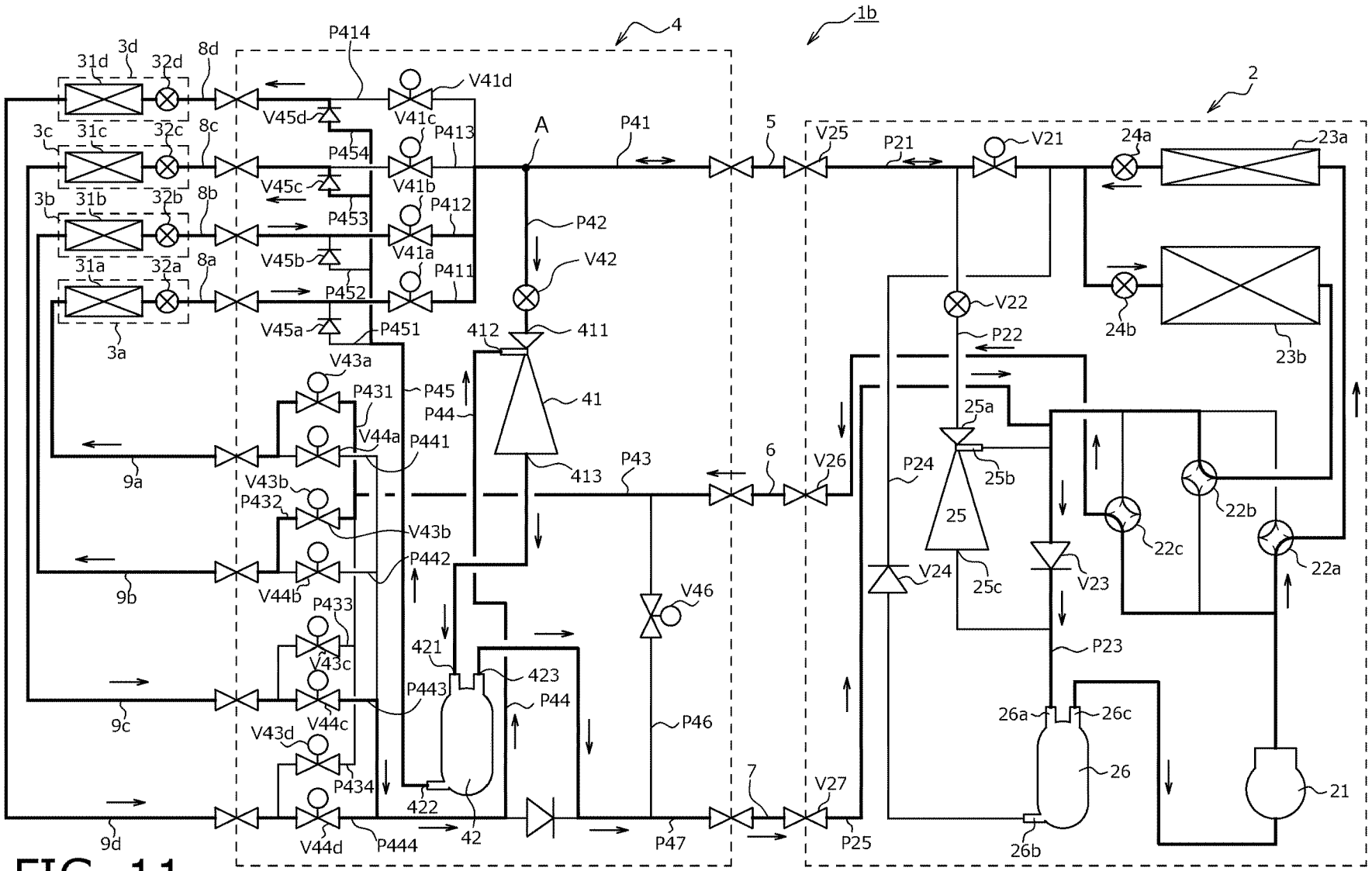
FIG. 11 is a schematic view of the air conditioner according to the second embodiments (illustrating the flow of the refrigerant during a cooling-heating-balanced operation).

(2-3-3) Cooling-Heating-Balanced Operation (2-3-3-1) Case where Ejector is Caused to Function As illustrated in FIG. 11, in the cooling-heating-balanced operation, for example, the use-side units 3*c* and 3*d* each perform a cooling operation and the use-side units 3*a* and 3*b* each perform a heating operation (that is, an operation in which the use-side heat exchangers 31*c* and 31*d* each function as the refrigerant evaporator and the use-side heat exchangers 31*a* and 31*b* each function as the refrigerant-heat radiator).

At this time, in the heat-source-side unit 2, the control unit 50 switches the first switching mechanism 22*a* so as to connect the discharge side of the compressor 21 to the gas side of the third heat-source-side heat exchanger 23*a* (the state of the switching mechanism 22*a* shown by a solid line in FIG. 11), in order to cause the third heat-source-side heat exchanger 23*a* to function as the refrigerant-heat radiator. The control unit 50 switches the second switching mechanism 22*b* so as to connect the suction side of the compressor 21 to the gas side of the second heat-source-side heat exchanger 23*b* (the state of the switching mechanism 22*b* shown by a solid line in FIG. 11). The control unit 50 switches the third switching mechanism 22*c* so as to connect the discharge side of the compressor 21 to the second connection pipe 6 (the state of the switching mechanism 22*c* shown by a solid line in FIG. 11), in order to send the refrigerant discharged from the compressor 21 to the second connection pipe 6. The control unit 50 opens the first heat-source-side expansion valve 24*a*, slightly opens the second heat-source-side expansion valve 24*b*, opens the heat-source-side first valve V21, and fully closes the heat-source-side second valve V22.

In the intermediate unit 4, the control unit 50 opens the intermediate first valves V41*a* and V41*b*, closes the intermediate first valves V41*c* and V41*d*, opens the intermediate second valve V42, opens the intermediate third valves V43*a* and V43*b*, closes the intermediate third valves V43*c* and V43*d*, closes the intermediate fourth valves V44*a* and V44*b*, opens the intermediate fourth valves V44*c* and V44*d*, and closes the intermediate sixth valve V46.

In the use-side units 3*a*, 3*b*, 3*c*, and 3*d*, the control unit 50 adjusts the opening degree of each of the use-side expansion valves 32*a*, 32*b*, 32*c*, and 33*d* in accordance with the heating load of each of the use-side units 3*a* and 3*b* and the cooling load of each of the use-side units 3*c* and 3*d*.

Thus, the control unit 50 controls the constituent devices of the heat-source-side unit 2, the use-side units 3*a*, 3*b*, 3*c*, and 3*d*, and the intermediate units 4*a*, 4*b*, 4*c*, and 4*d*. First, a case where the sum of the cooling-operation loads of the use-side units 3*a*, 3*b*, 3*c*, and 3*d* is equal to the sum of the heating-operation loads will be described.

A part of the refrigerant in a supercritical state discharged from the compressor 21 is sent to the first heat-source-side heat exchanger 23*a* via the first switching mechanism 22*a*, and the remaining part of the refrigerant flows out from the heat-source-side unit 2 to the second connection pipe 6 via the third switching mechanism 22*c*.

The refrigerant sent to the first heat-source-side heat exchanger 23*a* releases heat as a result of being cooled by exchanging heat with outdoor air in the first heat-source-side heat exchanger 23 a that functions as the refrigerant-heat radiator. Then, the refrigerant is sent from the first heat-source-side heat exchanger 23*a* to the second heat-source-side heat exchanger 23*b* by way of the first heat-source-side expansion valve 24*a* and the second heat-source-side expansion valve 24*b*. The refrigerant sent to the second heat-source-side heat exchanger 23*b* passes through the gas-liquid separator 26 by way of the second switching mechanism 22*b* and the heat-source-side third valve V23, and returns to the compressor 21.

The refrigerant that has flowed out to the second connection pipe 6 is sent to the intermediate unit 4 through the second connection pipe 6. The high-pressure refrigerant sent to the intermediate unit 4 flows into the intermediate third pipe P43, and flows out from the intermediate units 4*a* and 4*b* by way of the intermediate third valves V43*a* and V43*b*.

The refrigerant that has flowed out from the intermediate units 4*a* and 4*b* is sent to the use-side units 3*a* and 3*b* through the fifth connection pipes 9*a* and 9*b*. The refrigerant sent to the use-side units 3*a* and 3*b* is sent to the use-side heat exchangers 31*a* and 31*b*. The high-pressure refrigerant sent to the use-side heat exchangers 31*a* and 31*b* releases heat as a result of being cooled by exchanging heat with indoor air, which is supplied from an indoor space, in the use-side heat exchangers 31*a* and 31*b* each of which functions as the refrigerant-heat radiator. The refrigerant flows out from the use-side units 3*a* and 3*b* through the use-side expansion valves 32*a* and 32*b*. On the other hand, the indoor air heated in the use-side heat exchangers 31*a* and 31*b* is sent to the indoor space, and thus heating of the indoor space is performed.

The refrigerant that has flowed out from the use-side units 3*a* and 3*b* is sent to the intermediate unit 4 through the fourth connection pipes 8*a* and 8*b*. The refrigerant sent to the intermediate unit 4 flows into the first branch pipes P411 and P412, and flows into the driving-flow inlet 411 of the ejector 41 by way of the intermediate first valves V41*a* and V41*b* and the second valve V42. The refrigerant is mixed with the refrigerant from the suction-flow inlet 412, which has evaporated in the evaporator, and is discharged from the discharge opening 413. The refrigerant in a gas-liquid two-phase state, which has flowed out from the ejector 41, flows into the refrigerant inlet 421 of the gas-liquid separator 42. Then, the refrigerant separated by the gas-liquid separator 42 and flowing out from the liquid-side outlet 422 flows out from the intermediate units 4*b*, 4*c*, and 4*d* by way of the intermediate fifth valves V45*c* and V45*d*.

The refrigerant that has flowed out from the intermediate units 4*c* and 4*d* is sent to the use-side units 3*c* and 3*d* through the fourth connection pipes 8*c* and 8*d*. The refrigerant sent to the use-side units 3*c* and 3*d* is sent to the use-side heat exchangers 31*c* and 31*d* by way of the use-side expansion valves 32*c* and 32*d*. The refrigerant sent to the use-side heat exchangers 31*c* and 31*d* evaporates as a result of being heated by exchanging heat with indoor air, which is supplied from an indoor space, in the use-side heat exchangers 31*c* and 31*d* each of which functions as the refrigerant evaporator. The refrigerant flows out from the use-side units 3*c* and 3*d*. On the other hand, the indoor air cooled in the use-side heat exchangers 31*c* and 31*d* is sent to the indoor space, and thus cooling of the indoor space is performed.

The refrigerant that has flowed out from the use-side units 3*c* and 3*d* is sent to the intermediate unit 4 through the fifth connection pipes 9*c* and 9*d*. The refrigerant sent to the intermediate unit 4 flows into the suction-flow inlet 412 of the ejector 41 by way of the intermediate fourth valves V44*c* and V44*d*. The low-pressure refrigerant that has flowed into the ejector 41 is pressurized by being mixed in the ejector 41 with the refrigerant that has flowed thereinto from the driving-flow inlet 411 described above. The refrigerant in a two phase state that has been pressurized and discharged flows into the refrigerant inlet 421 of the gas-liquid separator 42. Then, the refrigerant separated by the gas-liquid separator 42 and flowing out from the gas-side outlet 423 flows out from the intermediate unit 4 through the intermediate seventh pipe P47.

The refrigerant that has flowed out from the intermediate unit 4 is sent to the heat-source-side unit 2 through the third connection pipe 7. The refrigerant sent to the heat-source-side unit 2 passes through the heat-source-side fifth pipe P25, and flows into the refrigerant inlet 26*a* of the gas-liquid separator 26 by way of the heat-source-side third valve V23. Then, the refrigerant separated by the gas-liquid separator 26 and flowing out from the gas-side outlet 26*c* is sucked into the compressor 21.

Next, a case where the sum of the cooling-operation loads of the use-side units 3*c* and 3*d* is larger than the sum of the heating-operation loads of the use-side units 3*a* and 3*b* will be described.

In the heat-source-side unit 2, the refrigerant that has released heat in the first heat-source-side heat exchanger 23*a*, which functions as the refrigerant-heat radiator, flows out from the heat-source-side unit 2 to the first connection pipe 5 by way of the first heat-source-side expansion valve 24*a* and the heat-source-side first valve V21. The refrigerant flows into the intermediate first pipe P41 of the intermediate unit 4 through the first connection pipe 5. At the point A, the refrigerant merges with the refrigerant that has exchanged heat in the use-side heat exchangers 31*a* and 31*b* and has passed through the intermediate first valves V41*a* and V41*b*. The merged refrigerant flows into the driving-flow inlet 411 of the ejector 41 by way of the intermediate second valve V42.

Next, a case where the sum of the heating-operation loads of the use-side units 3*a* and 3*b* is larger than the sum of the cooling-operation loads of the use-side units 3*c* and 3*d* will be described.

The refrigerant that has exchanged heat in the use-side heat exchangers 31*a* and 31*b*, that has passed through the intermediate first pipe P41 of the intermediate units 4*a* and 4*b*, and that has flowed out from the intermediate unit 4 flows into the heat-source-side unit 2 through the first connection pipe 5. The refrigerant flows through the heat-source-side first pipe P21, and is sent to the second heat-source-side heat exchanger 23*b* by way of the heat-source-side first valve V21 and the second heat-source-side expansion valve 24*b*. The refrigerant that has evaporated in the second heat-source-side heat exchanger 23*b* flows into the refrigerant inlet 26*a* of the gas-liquid separator 26 by way of the second switching mechanism 22*b* and the heat-source-side third valve V23. Then, the refrigerant separated by the gas-liquid separator 26 and flowing out from the gas-side outlet 26*c* is sucked into the compressor 21.

Thus, during the cooling-balanced operation described above, the ejector 41 of the intermediate unit 4 is caused to function to pressurize the refrigerant that has evaporated in the use-side units 3*c* and 3*d* that performs a cooling operation, and then the refrigerant is returned to the compressor 21 through the third connection pipe 7. The refrigerant that has released heat in the use-side units 3*a* and 3*b* each of which performs a heating operation is not pressurized by the ejector 41*a*.

(2-3-3-2) Case where Ejector is not Caused to Function

In the intermediate unit 4, in a case where the ejector 41 is not caused to function, the control unit 50 opens the intermediate first valves V41*c* and V41*d*, closes the intermediate second valves V42*c* and V42*d*, closes the intermediate third valves V43*c* and V43*d*, opens the intermediate fourth valves V44*c* and V44*d*, and closes the intermediate sixth valve V46. The action in this case is similar to that of the intermediate unit 4 in the cooling-main operation.

Figure 12:
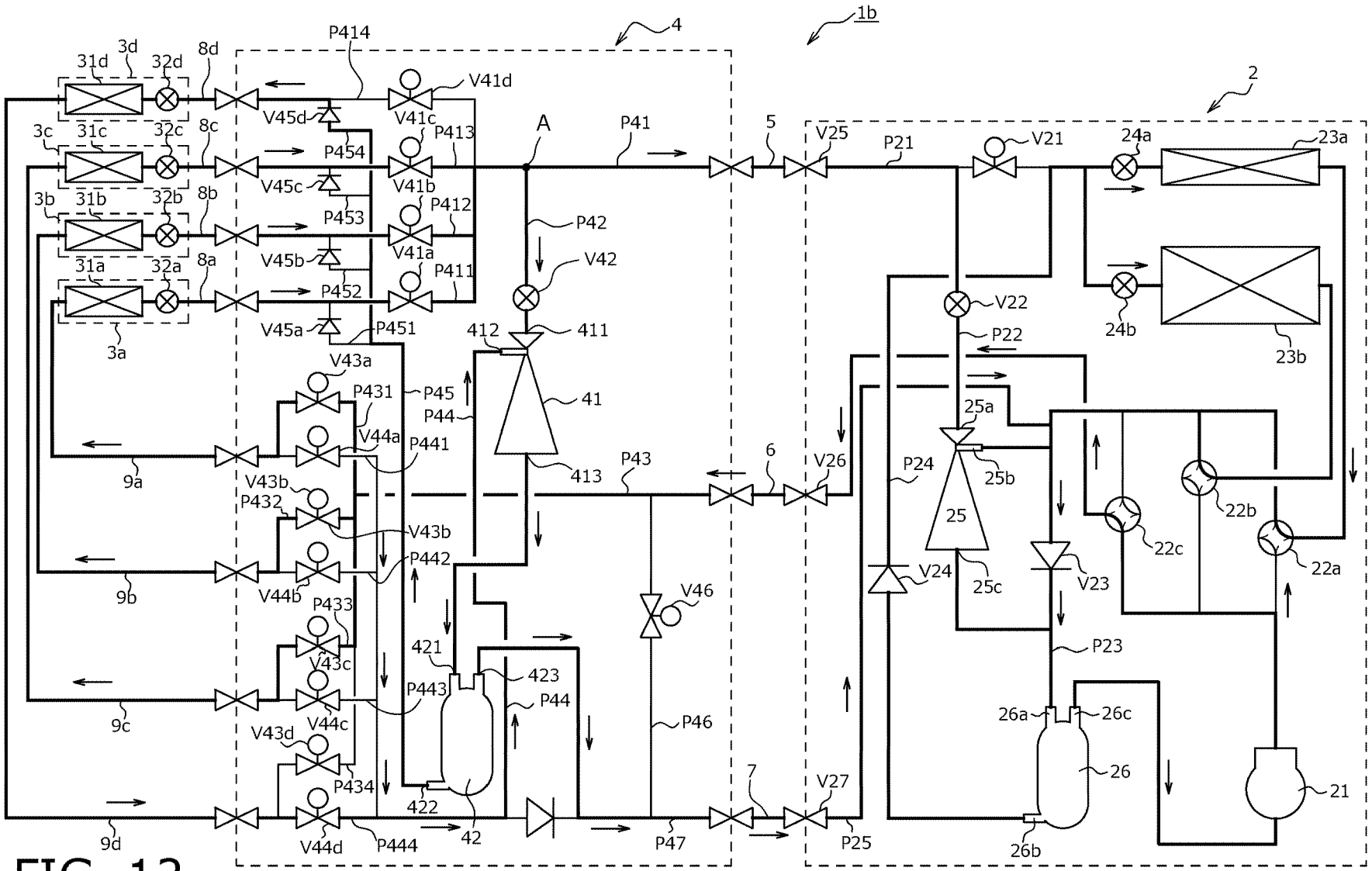
FIG. 12 is a schematic view of the air conditioner according to the second embodiments (illustrating the flow of the refrigerant during a heating-main operation).

(2-3-4) Heating-Main Operation (2-3-4-1) Case where Ejector is Caused to Function As illustrated in FIG. 12, in the heating-main operation, for example, the use-side unit 3*d* performs a cooling operation, and the use-side units 3*a*, 3*b*, and 3*c* each perform a heating operation.

At this time, in the heat-source-side unit 2, the control unit 50 switches the first switching mechanism 22*a* and the second switching mechanism 22*b* so as to connect the suction side of the compressor 21 to the gas side of the first heat-source-side heat exchanger 23*a* and the second heat-source-side heat exchanger 23*b* (the state shown by the solid lines of the first switching mechanisms 22*a* and 22*b* in FIG. 12), in order to cause the first heat-source-side heat exchanger 23*a* and the second heat-source-side heat exchanger 23*b* to each function as the refrigerant evaporator. The control unit 50 switches the switching mechanism 22*c* so as to connect the discharge side of the compressor 21 to the second connection pipe 6 (the state of the switching mechanism 22*c* shown by a solid line in FIG. 12), in order to send the refrigerant discharged from the compressor 21 to the second connection pipe 6. The control unit 50 opens the first heat-source-side expansion valve 24*a*, opens the second heat-source-side expansion valve 24*b*, closes the heat-source-side first valve V21, and opens the heat-source-side second valve V22.

In the intermediate unit 4, the control unit 50 opens the intermediate first valves V41*a*, V41*b*, and V41*c*, closes the intermediate first valve V41*d*, opens the intermediate second valve V42, opens the intermediate third valves V43*a*, V43*b*, and V43*c*, closes the intermediate third valve V43*d*, closes the intermediate fourth valves V44*a*, V44*b*, and V44*c*, opens the intermediate fourth valve V44*d*, and closes the intermediate sixth valve V46.

In the use-side units 3*a*, 3*b*, 3*c*, and 3*d*, the control unit 50 adjusts the opening degree of each of the use-side expansion valves 32*a*, 32*b*, 32*c*, and 33*d* in accordance with the heating load of a corresponding one of the use-side units 3*a*, 3*b*, and 3*c* and the cooling load of the use-side unit 3*d*.

When the control unit 50 thus controls the constituent devices of the heat-source-side unit 2, the use-side units 3*a*, 3*b*, 3*c*, and 3*d*, and the intermediate units 4*a*, 4*b*, 4*c*, and 4*d*, a refrigerant in a supercritical state discharged from the compressor 21 flows out from the heat-source-side unit 2 to the second connection pipe 6 through the third switching mechanism 22*c*.

The refrigerant that has flowed out to the second connection pipe 6 is sent to the intermediate unit 4. The high-pressure refrigerant sent to the intermediate unit 4 flows into the intermediate third pipe P43, and flows out from the intermediate unit 4 by way of the intermediate third valves V43*a*, V43*b*, and V43*c*.

The refrigerant that has flowed out from the intermediate unit 4 is sent to the use-side units 3*a*, 3*b*, and 3*c* through the fifth connection pipes 9*a*, 9*b*, and 9*c*. Then, the high-pressure refrigerant sent to the use-side heat exchangers 31*a*, 31*b*, and 31*c* releases heat as a result of being cooled by exchanging heat with indoor air, which is supplied from an indoor space, in the use-side heat exchangers 31*a*, 31*b*, and 31*c* each of which functions as the refrigerant-heat radiator. The refrigerant flows out from the use-side units 3*a*, 3*b*, and 3*c* through the use-side expansion valves 32*a* and 32*b*, 32*c*. On the other hand, the indoor air heated in the use-side heat exchangers 31*a*, 31*b*, and 31*c* is sent to the indoor space, and thus heating of the indoor space is performed.

The refrigerant that has flowed out from the use-side units 3*a*, 3*b*, and 3*c* is sent to the intermediate unit 4 through the fourth connection pipes 8*a*, 8*b*, and 8*c*. The refrigerant sent to the intermediate unit 4 flows into the first branch pipes P411, P412, and P413. A part of the refrigerant flows into the intermediate second pipe P42 at a point A by way of the intermediate first valves V41*a*, V41*b*, and V41*c*, and the remaining part of the refrigerant flows into the heat-source-side unit 2 from the intermediate unit 4 through the first connection pipe 5, and flows into the driving-flow inlet 25*a* of the ejector 25 by way of the heat-source-side second valve V22.

The refrigerant that has flowed into the intermediate second pipe P42 flows into the driving-flow inlet 411 of the ejector 41. The refrigerant is mixed with the refrigerant from the suction-flow inlet 412, which has evaporated in the evaporator, and is discharged from the discharge opening 413. The refrigerant in a gas-liquid two-phase state, which has flowed out from the ejector 41, flows into the refrigerant inlet 421 of the gas-liquid separator 42. Then, the refrigerant separated by the gas-liquid separator 42 and flowing out from the liquid-side outlet 422 flows out from the intermediate unit 4 by way of the intermediate fifth valve V45*d*.

The refrigerant that has flowed out from the intermediate unit 4 is sent to the use-side unit 3*d* through the fourth connection pipe 8*d*. The refrigerant sent to the use-side unit 3*d* is sent to the use-side heat exchanger 31*d* that functions as the refrigerant evaporator by way of the use-side expansion valve 32*d*, and evaporates as a result of being heated by exchanging heat with indoor air supplied from an indoor space. The refrigerant flows out from the use-side unit 3*d*. On the other hand, the indoor air cooled in the use-side heat exchanger 31*d* is sent to the indoor space, and thus cooling of the indoor space is performed.

The refrigerant that has flowed out from the use-side unit 3*d* is sent to the intermediate unit 4 through the fifth connection pipe 9*d*. The refrigerant sent to the intermediate unit 4 flows into the suction-flow inlet 412 of the ejector 41 through the intermediate fourth pipe P44. The refrigerant that has flowed into the ejector 41 is pressurized by being mixed with the refrigerant that has flowed thereinto from the driving-flow inlet 411 described above. The refrigerant in a two phase state that has been pressurized and discharged from the discharge opening 413 flows into the refrigerant inlet 421 of the gas-liquid separator 42. Then, the refrigerant separated by the gas-liquid separator 42 and flowing out from the gas-side outlet 423 flows out from the intermediate unit 4 through the intermediate seventh pipe P47.

The refrigerant that has flowed out from the intermediate unit 4 is sent to the heat-source-side unit 2 through the third connection pipe 7. The refrigerant flows into the refrigerant inlet 26*a* of the gas-liquid separator 26 through the heat-source-side fifth pipe P25 and the third pipe P23.

The refrigerant that has exchanges heat in the use-side heat exchangers 31*a*, 31*b*, and 31*c* and that passes through the first connection pipe 5 from the point A of the intermediate unit 4 flows into the driving-flow inlet 25*a* of the ejector 25 of the heat-source-side unit 2 by way of the heat-source-side second valve V22. The refrigerant is mixed with the refrigerant from the suction-flow inlet 25*b*, which has evaporated in the evaporator, and is discharged from the discharge opening 25*c*. The refrigerant in a gas-liquid two-phase state, which has flowed out from the ejector 25, flows into the refrigerant inlet 26*a* of the gas-liquid separator 26.

The refrigerant separated by the gas-liquid separator 26 and flowing out from the liquid-side outlet 26*b* branches so as to flow to the first heat-source-side expansion valve 24*a* and the second heat-source-side expansion valve 24*b* by way of the heat-source-side fourth valve V24, and is sent to the first heat-source-side heat exchanger 23*a* and the second heat-source-side heat exchanger 23*b*.

The refrigerant sent to the first heat-source-side heat exchanger 23*a* and the second heat-source-side heat exchanger 23*b* evaporates as a result of being heated by exchanging heat with outdoor air in the first heat-source-side heat exchanger 23*a* and the second heat-source-side heat exchanger 23*b* each of which functions as the refrigerant evaporator. The evaporated refrigerant flows into the suction-flow inlet 25*b* of the ejector 25 by way of the first switching mechanism 22*a* and the second switching mechanism 22*b*. The low-pressure refrigerant is pressurized by being mixed in the ejector 41*d* with the refrigerant that has flowed thereinto from the driving-flow inlet 25*a* described above. The refrigerant in a two phase state that has been pressurized and discharged flows into the refrigerant inlet 26*a* of the gas-liquid separator 26.

Then, the refrigerant separated by the gas-liquid separator 26 and flowing out from the gas-side outlet 26*c* is sucked into the compressor 21.

Thus, during the heating-main operation described above, the ejector 41 of the intermediate unit 4 is caused to function to pressurize the refrigerant that has evaporated in the use-side unit 3*d* that performs a cooling operation, and then the refrigerant is returned to the compressor 21 through the third connection pipe 7. The refrigerant that has released heat in the use-side units 3*a*, 3*b*, and 3*c* each of which performs a heating operation is not pressurized by the ejector 41*a*.

(2-3-4-2) Case where Ejector is not Caused to Function

In the intermediate unit 4, when the ejector 41*d* is not caused to function, the control unit 50 opens the intermediate first valve V41*d*, closes the intermediate second valve V42*d*, closes the intermediate third valve V43*d*, opens the intermediate fourth valve V44*d*, and closes the intermediate sixth valve V46. The action in this case is similar to that of the intermediate unit 4*d* in the cooling-main operation.

(2-3-5) Heating-Only Operation

Figure 13:
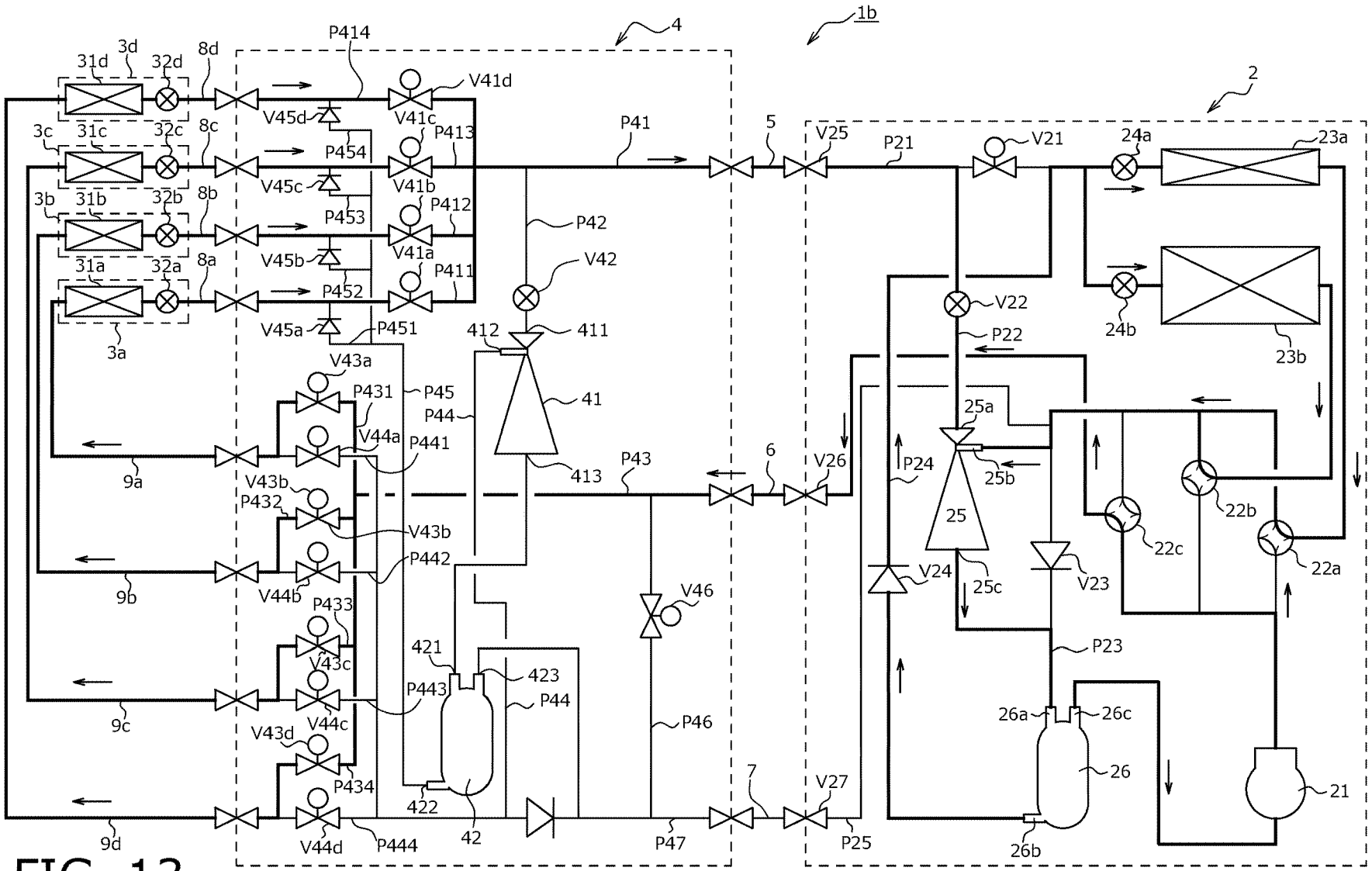
FIG. 13 is a schematic view of the air conditioner according to the second embodiments (illustrating the flow of the refrigerant during a heating-only operation).

As illustrated in FIG. 13, in the heating-only operation, for example, all of the use-side units 3*a*, 3*b*, 3*c*, and 3*d* each perform a heating operation (that is, an operation in which all of the use-side heat exchangers 31*a*, 31*b*, 31*c*, and 31*d* each function as the refrigerant-heat radiator and the heat-source-side heat exchangers 23*a* and 23*b* each function as the refrigerant evaporator).

At this time, in the heat-source-side unit 2, the control unit 50 switches the first switching mechanism 22*a* and the second switching mechanism 22*b* so as to connect the suction side of the compressor 21 to the gas side of the first heat-source-side heat exchanger 23*a* and the second heat-source-side heat exchanger 23*b* (the state shown by the solid lines of the first switching mechanisms 22*a* and 22*b* in FIG. 13), in order to cause the first heat-source-side heat exchanger 23*a* and the second heat-source-side heat exchanger 23*b* to each function as the refrigerant evaporator. Moreover, the control unit 50 switches the switching mechanism 22*c* so as to connect the discharge side of the compressor 21 to the second connection pipe 6 (the state of the switching mechanism 22*c* shown by a solid line in FIG. 13), in order to send the refrigerant discharged from the compressor 21 to the second connection pipe 6. The control unit 50 opens the first heat-source-side expansion valve 24*a*, opens the second heat-source-side expansion valve 24*b*, closes the heat-source-side first valve V21, and opens the heat-source-side second valve V22.

In the intermediate unit 4, the control unit 50 opens the intermediate first valves V41*a*, V41*b*, V41*c*, and V41*d*, closes the intermediate second valve V42, opens the intermediate third valves V43*a*, V43*b*, V43*c*, and V43*d*, closes the intermediate fourth valves V44*a*, V44*b*, V44*c*, and V44*d*, and closes the intermediate sixth valve V46.

In the use-side units 3*a*, 3*b*, 3*c*, and 3*d*, the control unit 50 adjusts the opening degree of each of the use-side expansion valves 32*a*, 32*b*, 32*c*, and 33*d* in accordance with the heating load of a corresponding one of the use-side units 3*a*, 3*b*, 3*c*, and 3*d*.

When the control unit 50 thus controls the constituent devices of the heat-source-side unit 2, the use-side units 3*a*, 3*b*, 3*c*, and 3*d*, and the intermediate unit 4, the refrigerant in a supercritical state discharged from the compressor 21 flows out from the heat-source-side unit 2 to the second connection pipe 6 via the third switching mechanism 22*c*.

The refrigerant that has flowed out to the second connection pipe 6 is sent to the intermediate unit 4. The high-pressure refrigerant sent to the intermediate unit 4 flows into the intermediate third pipe P43, further flows through the third branch pipes P431, P432, P433, and P434, and flows out from the intermediate unit 4 by way of the intermediate third valves V43*a*, V43*b*, V43*c*, and V43*d*.

The refrigerant that has flowed out from the intermediate unit 4 is sent to the use-side units 3*a*, 3*b*, 3*c*, and 3*d* through the fifth connection pipes 9*a*, 9*b*, 9*c*, and 9*d*. Then, the high-pressure refrigerant sent to the use-side heat exchangers 31*a*, 31*b*, 31*c*, and 31*d* releases heat as a result of being cooled by exchanging heat with indoor air, which is supplied from an indoor space, in the use-side heat exchangers 31*a*, 31*b*, 31*c*, and 31*d* each of which functions as the refrigerant-heat radiator. The refrigerant flows out from the use-side units 3*a*, 3*b*, 3*c*, and 3*d* through the use-side expansion valves 32*a*, 32*b*, 32*c*, and 32*d*. On the other hand, the indoor air heated in the use-side heat exchangers 31*a*, 31*b*, 31*c*, and 31*d* is sent to the indoor space, and thus heating of the indoor space is performed.

The refrigerant that has flowed out from the use-side units 3*a*, 3*b*, 3*c*, and 3*d* is sent to the intermediate unit 4 through the fourth connection pipes 8*a*, 8*b*, 8*c*, and 8*d*. The refrigerant sent to the intermediate unit 4 flows into the first branch pipes P411, P412, P413, and P414, and merges by way of the intermediate first valves V41*a*, V41*b*, V41*c*, and V41*d*. The merged refrigerant flows out from the intermediate unit 4 without passing through the ejector 41.

The refrigerant that has flowed out from the intermediate unit 4 flows into the heat-source-side unit 2 through the first connection pipe 5. The refrigerant that has flowed into the heat-source-side unit 2 flows into the driving-flow inlet 25*a* of the ejector 25. The refrigerant is mixed with the refrigerant from the suction-flow inlet 25*b*, which has evaporated in the evaporator, and is discharged from the discharge opening 25*c*. The refrigerant in a gas-liquid two-phase state, which has flowed out from the ejector 25, flows into the refrigerant inlet 26*a* of the gas-liquid separator 26. Then, the refrigerant separated by the gas-liquid separator 26 and flowing out from the liquid-side outlet 26*b* branches so as to flow to the first heat-source-side expansion valve 24*a* and the second heat-source-side expansion valve 24*b* by way of the heat-source-side fourth valve V24, and is sent to the first heat-source-side heat exchanger 23*a* and the second heat-source-side heat exchanger 23*b*. The refrigerant evaporates as a result of being heated by exchanging heat with outdoor air in the first heat-source-side heat exchanger 23*a* and the second heat-source-side heat exchanger 23*b* each of which functions as the refrigerant evaporator. The evaporated refrigerant merges by way of the first switching mechanism 22*a* and the second switching mechanism 22*b*, and flows into the suction-flow inlet 25*b* of the ejector 25. The low-pressure refrigerant is pressurized by being mixed in the ejector 25 with the refrigerant that has flowed thereinto from the driving-flow inlet 25*a* described above. The refrigerant in a two phase state that has been pressurized and discharged flows into the refrigerant inlet 26*a* of the gas-liquid separator 26. Then, the refrigerant separated by the gas-liquid separator 26 and flowing out from the gas-side outlet 26*c* is sucked into the compressor 21.

Thus, the ejector 41*d* of the intermediate unit 4 is not caused to function during the heating-only operation described above. In other words, the refrigerant that has released heat in the use-side units 3*a*, 3*b*, 3*c*, and 3*d* that perform a heating operation is not pressurized by the ejectors 41*a*, 41*b*, 41*c*, and 41*d*.

(2-4) Features

The ejector 41 according to one or more embodiments is connected to the plurality of use-side units 3*a*, 3*b*, 3*c*, and 3*d*. Thus, the air conditioner 1*b* according to one or more embodiments can be applied to the refrigerant circuit in which one ejector 41 can pressurize the refrigerant for the plurality of use-side units 3*a*, 3*b*, 3*c*, and 3*d*.

(3) Modifications (3-1) Modification A

In the first and second embodiments described above, a refrigerant that has released heat in the use-side units 3*a*, 3*b*, 3*c*, and 3*d* that perform a heating operation does not pass through the ejectors 41, 41*a*, 41*b*, 41*c*, and 41*d*. However, the present disclosure is not limited to this. In the present modification, a refrigerant that has released heat in the use-side units 3*a*, 3*b*, 3*c*, and 3*d* that perform a heating operation passes through the ejectors 41, 41*a*, 41*b*, 41*c*, and 41*d*, but is not pressurized by the ejectors 41, 41*a*, 41*b*, 41*c*, and 41*d*. In this case, for example, a driving flow does not flow through the ejectors 41, 41*a*, 41*b*, 41*c*, and 41*d*.

Although the driving flow may flow through the ejectors 41, 41*a*, 41*b*, 41*c*, and 41*d*, a suction flow (refrigerant that has released heat in the use-side units 3*a*, 3*b*, 3*c*, and 3*d* that perform a heating operation) need not flow into the suction-flow inlets 412, 412*a*, 412*b*, 412*c*, and 412*d*.

(3-2) Modification B

In the first and second embodiments described above, the heat-source-side unit 2 includes the ejector 25. However, the present disclosure is not limited thereto. In the present modification, the heat-source-side unit 2 does not include the ejector 25.

(3-3) Modification C

In the first embodiments, each of the ejectors 41*a*, 41*b*, 41*c*, and 41*d* pressurizes a refrigerant for a corresponding one of the use-side units 3*a*, 3*b*, 3*c*, and 3*d* included in the air conditioner 1*a*. In the second embodiments, one ejector 41 pressurizes a refrigerant for all of the plurality of use-side units 3*a*, 3*b*, 3*c*, and 3*d* included in the air conditioner 1*b*. In the present modification, the air conditioner includes a plurality of ejectors. A first ejector pressurizes a refrigerant for one use-side unit included in the air conditioner. A second ejector pressurizes a refrigerant for a plurality of use-side units included in the air conditioner.

(3-4) Modification D

In the air conditioners 1*a* and 1*b* according to the first and second embodiments, a case where carbon dioxide is used as a refrigerant has been described. As a refrigerant used in the air conditioner, a carbon-dioxide refrigerant or a mixed refrigerant including carbon dioxide, which is discharged from the compressor 21 with high pressure, may be used. However, the present disclosure is not limited to this. A refrigerant other than carbon dioxide or a mixed refrigerant including carbon dioxide may be used. For example, a refrigerant whose saturation pressure is 4.5 MPa or higher when the saturation temperature reaches 65° C. may be used. As such a refrigerant, for example, R410A can be used. A fluorocarbon-based refrigerant that enters a critical state when discharged from the compressor 21 may be used. As such a fluorocarbon-based refrigerant, for example, R23 can be used.

(3-5) Modification E

The number of the connection pipes 5, 6, and 7 that connect the heat-source-side unit 2 to the intermediate units 4, 4*a*, 4*b*, 4*c*, and 4*d*, which is three in the air conditioners 1*a* and 1*b* according to the first and second embodiments. However, the number of the connection pipes may be four or more.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

1*a*, 1*b* air conditioner
2 heat-source-side unit
3*a*, 3*b*, 3*c*, 3*d* use-side unit
4, 4*a*, 4*b*, 4*c*, 4*d* intermediate unit
5, 6, 7 connection pipe
21 compressor
23*a*, 23*b* heat-source-side heat exchanger
31*a*, 31*b*, 31*c*, 31*d* use-side heat exchanger
41, 41*a*, 41*b*, 41*c*, 41*d* ejector
42, 42*a*, 42*b*, 42*c*, 42*d* gas-liquid separator
50 control unit
411, 411*a*, 411*b*, 411*c*, 411*d* driving-flow inlet
P41, P41*a*, P41*b*, P41*b*, P41*c*, P41*d* first pipe
P42, P42*a*, P42*b*, P42*b*, P42*c*, P42*d* second pipe
V41*a*, V41*b*, V41*c*, V41*d* first valve
V42, V42*a*, V42*b*, V42*c*, V42*d* second valve

PATENT LITERATURE

PTL 1: Japanese Unexamined Patent Application Publication No. 2005-337659

What is claimed is:

1. An air conditioner comprising:
a heat-source-side unit comprising:
a compressor; and
a heat-source-side heat exchanger;
use-side units each comprising a use-side heat exchanger;
an intermediate unit that causes the use-side heat exchanger of each of the use-side units to individually function as an evaporator or a radiator of a refrigerant; and
three or more connection pipes that connect the heat-source-side unit to the intermediate unit, wherein
the intermediate unit comprises:
an ejector that pressurizes the refrigerant; and
a gas-liquid separator into which the refrigerant flowing out from the ejector flows,
the refrigerant that has released heat in any of the use-side units that perform a heating operation is not pressurized by the ejector,
the intermediate unit further comprises:
a first pipe that allows the refrigerant to flow between the heat-source-side heat exchanger and the use-side heat exchanger of one of the use-side units;
a first valve disposed in the first pipe; and
a second pipe that:
branches from a branch point of the first pipe between the heat-source-side heat exchanger and the first valve,
allows the refrigerant to flow to a driving-flow inlet of the ejector, and
the intermediate unit is configured such that the refrigerant, after having released the heat at one of the use-side units that perform the heating operation, flows through the first valve and then through the branch point.

2. The air conditioner according to claim 1, wherein the refrigerant that has evaporated in any of the use-side units that perform a cooling operation flows through the ejector.

3. The air conditioner according to claim 1, wherein the intermediate unit further comprises a second valve disposed in the second pipe, and the air conditioner further comprises a controller that controls the first valve and the second valve.

4. The air conditioner according to claim 1, wherein the intermediate unit further comprises one or more other ejectors that pressurize the refrigerant, and each of the ejectors is connected to a corresponding one of the use-side units.

5. The air conditioner according to claim 1, wherein the ejector is connected to the use-side units.

6. The air conditioner according to claim 1, wherein the compressor discharges the refrigerant in a supercritical state.

7. The air conditioner according to claim 6, wherein the refrigerant comprises carbon dioxide.

* * * * *